US006407764B1

(12) United States Patent
Susukida et al.

(10) Patent No.: US 6,407,764 B1
(45) Date of Patent: Jun. 18, 2002

(54) THERMAL HEAD AND METHOD OF MANUFACTURING THE SAME

(75) Inventors: Masato Susukida, Chiba; Katsuto Nagano, Yokohama; Atsushi Yoshida, Ichikawa; Jun Hirabayashi, Chiba; Yoshio Saita, Yotsukaido; Jun Hagiwara, Sakura, all of (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/125,400

(22) PCT Filed: Dec. 19, 1997

(86) PCT No.: PCT/JP97/04727

§ 371 (c)(1),
(2), (4) Date: Jan. 8, 1999

(87) PCT Pub. No.: WO98/26933

PCT Pub. Date: Jun. 25, 1998

(30) Foreign Application Priority Data

Dec. 19, 1996 (JP) ..... 8-339218
Dec. 24, 1996 (JP) ..... 8-344104
Jul. 15, 1997 (JP) ..... 9-189662

(51) Int. Cl.[7] ..... B41J 2/335
(52) U.S. Cl. ..... 347/209; 347/200; 29/611
(58) Field of Search ..... 347/200, 202, 347/203, 209; 29/611

(56) References Cited

U.S. PATENT DOCUMENTS 4,616,408 A 10/1986 Lloyd
4,734,563 A 3/1988 Lloyd
4,841,120 A * 6/1989 Yagino et al.

FOREIGN PATENT DOCUMENTS

JP A-55-21276 2/1980
JP A-57-64577 4/1982
JP A-62-170361 7/1987
JP B2-3-40911 6/1991
JP A-4-319448 11/1992
JP A-5-64905 3/1993
JP A-6-78004 3/1994
JP B2-8-29595 3/1996

OTHER PUBLICATIONS

K. Ichikawa et al., *Flip–Chip Joining Technique For 400 DPI Thermal Printing Heads*, Oki Electric Research and Development, vol. 55, No. 2, pp. 51–56.

* cited by examiner

*Primary Examiner*—Huan Tran
(74) *Attorney, Agent, or Firm*—Oliff & Berridge, PLC

(57) ABSTRACT

An wear-resistant layer 50 constituting a printing surface which is brought into contact with a thermal record medium is formed on a provisional substrate 70 having a groove formed in its surface, said groove having a substantially semicircular cross section, and a heat generating layer 51, electrically conductive layers 52*a* and 52*b* electrically connected to the heat generating layer, a protection layer 54*a* and a heat storage layer 58 are stacked in turn to form a printing section. Next, a driving IC 55 for controlling a heating electric power to be supplied to the printing section is connected to the electrically conductive layer and a wiring section 53 for connecting the driving IC to an external circuit is provided. Thereafter, the printing section is secured to a heat dissipating member 59 by means of a resin 62, and a common electrode 84 and wires 56 are secured to the heat dissipating member by means of both-sided adhesive tapes 82 and 83. After covering an assembly with an etching resist 85 except for the substrate 70, the substrate is removed by etching and the printing surface protruded outwardly is exposed.

84 Claims, 45 Drawing Sheets

THERMAL HEAD AND METHOD OF MANUFACTURING THE SAME

FIELD OF THE INVENTION

This invention relates to a thermal head for use in a thermo-recording machine such as printer and facsimile and a method of manufacturing the same, and more particularly to a thermal head comprising a printing section including a wear-resistant layer having a printing surface to be brought into contact with a thermal record medium, a heat generating layer for generating heat to be transmitted to the thermal record medium through the wear-resistant layer and an electrically conductive layer connected to the heat generating layer, a driving circuit section connected to the electrically conductive layer of the printing section to control a heating electric power to be supplied to the printing section, and a wiring section for connecting the driving circuit section to an external circuit and a method of manufacturing such a thermal head.

BACKGROUND OF THE INVENTION

A thermal head is an equipment, in which heat generated in accordance with a supplied electric signal is transmitted to a thermal record medium, for instance a thermal paper to record characters and figures of desired shapes. A conventional thermal head is composed of the following basic components:

(Component I) Printing Section

A printing section includes a printing surface to be brought into contact with a thermal paper and generates and transmits heat for coloring the thermal paper.

(Component II) Driving Circuit Section

A driving circuit section supplies an electric power according to an electric signal bearing information to be printed. Here, the information is to be understood to mean image data representing characters and figures. Since normal semiconductor integrated circuit chips are used as the driving circuit, the driving circuit is denoted as a driving IC for the sake of simplicity in the present specification.

(Component III) Wiring Section to External Circuit

A wiring section is provided for connecting the thermal head to a connector of a cable to be connected to an external circuit. The printing information and electric power are supplied to the thermal head from the external circuit via the wiring section. A connection to the external circuit is performed by a lead wire such as a flexible FPC (Flexible Print Circuit), and in this case, the wiring section includes pin-like conductors to be connected to the connector of the lead wire, a part of said pin-like conductors being exposed from the thermal head.

[Construction of Conventional Thermal Head]

Several examples of conventional thermal heads will be explained hereinbelow.

FIG. 1 is a cross sectional view showing a structure of an example of the conventional thermal head, in which a driving IC is connected to a printing section and a wiring section by means of wire-bonding. The thermal head shown in FIG. 1 has been used in a usual type thermo-recording printer. In FIG. 1, a reference numeral 10 denotes a wear-resistant layer having anti-physical and anti-chemical characters, a reference numeral 11 a heat generating layer, reference numerals 12*a* and 12*b* an electrically conductive layer constituting electrodes for the heat generating layer, a reference numeral 13 an electrically conductive layer constituting a wiring section for connecting the thermal head to an external circuit, a reference numeral 14 solders constituting connecting portions for connecting the wiring section and a wiring cable with each other, a reference numeral 15*a* driving IC, a reference numeral 16*a* wiring for connecting the driving to the external circuit, a reference numeral 17*a* heat storage layer, a reference numeral 18 a resin layer for isolating and protecting the driving IC and bonding wires, a reference numeral 19 an electrically insulating substrate, a reference numeral 20 bonding wires connecting terminals of the driving IC to the electrically conductive layer 12*b* and wiring section, a reference numeral 21 a thermal paper, and a reference numeral 22 represents a rubber roller for urging the thermal paper against the thermal head. A reference character P shows a printing section which is composed of a part of the wear-resistant layer 10, the heat generating layer 11 and parts of the electrically conductive layers 12*a* and 12*b*. A reference character S denotes the printing surface of the printing section P, that is a part of the surface of the wear-resistant layer 10 which is brought into contact with the thermal paper 21. A reference character L expresses a distance between the printing section P and the resin layer 18 protecting the driving IC 15.

In the known thermal head shown in FIG. 1, the heat storage layer 17 is formed on the substrate 19, on which the heat generating layer 11, electrically conductive layers 12*a* and 12*b* and wear-resistant layer 10 constituting the printing section P are successively stacked. The thermal head shown in FIG. 1 will be further explained by dividing it into several components.

(Component I) Printing Section (Component II) Driving IC (Component III) Wiring Section to External Circuit (Component IV) Heat storage Layer (Component V) Substrate And particularly the printing section is constructed by stacking the following layers:

(I-1) Wear-resistant Layer (I-2) Heat Generating Layer (I-3) Electrically Conductive Layer Therefore, the conventional thermal head illustrated in FIG. 1 is composed not only of the basic components (Component I), (Component II), and (Component III), but also by the heat storage layer of (Component IV). These components are arranged on the substrate 19 of (Component V). In other words, the (Component I)–(Component IV) are supported as a unit body by means of the (Component V).

The heat storage layer 17, however, is an additional component for attaining a power save. There are also proposed thermal heads, in which a heat radiating or other components for increasing a printing speed. By providing such a component, a performance of the thermal head can be improved. The heat generating layer II constituting the printing section P is divided into many heat generating elements in a direction normal to a plane of the drawing of FIG. 1. The electrically conductive layer 12*a* form a common electrodes to these heat generating elements and the electrically conductive layer 12*b* constitutes divided electrodes each being connected to respective heat generating elements in order to flow an electric current only through one or more desired heat generating elements according to the print information. The common electrode and divided electrodes are called the electrically conductive layer in a general term in this specification.

[Functions and Required Characteristics of Respective Components of Thermal Head]

Subsequently, functions of respective components will be explained.

At first, respective layers constituting the printing section P of (Component I) will be discussed.

(I-1) Wear-resistant Layer

The wear-resistant layer 10 is brought into contact with the thermal paper 21 to transmit the heat generated by the heat generating layer 11 to the thermal paper. Therefore the printing surface S is composed of the surface of the wear-resistant layer 10 situating in the printing section P. The wear-resistant layer 10 is required to have a basic characteristic that the layer does not chemically react to components contained in the thermal paper. Moreover good wear-resistant and heat-resistant characteristics, a lower coefficient of friction and a proper hardness are required for the wear-resistant layer. Furthermore, the wear-resistant layer preferably has a suitable electrical conductivity. This is due to a reason that dusts and charged particles might adhered to the printing surface S by an electrostatic charge caused by a friction between the printing surface and the thermal paper, said dust and particles causing a degradation in a print quality and undesired wear. Therefore, in order to prevent the charging, the wear-resistant layer preferably has a proper electric conductivity. However since an extended portion of the wear-resistant layer extending from the printing section P is brought into contact with respective electrodes of the electrically conductive layer 12*b,* the wear-resistant layer should have such a resistance that these electrodes are not short-circuited.

(I-2) Heat Generating Layer

The heat generating layer 11 has a function of generating heat for coloring the thermal paper. The principle of the heat generation is based on the Joule heat, wherein heat is generated by flowing an electric current through a resistive body. Accordingly the heat generating layer 11 is required to have a stable electric property around 400° C. Here, the electric property mainly means a resistance and its change with time.

(I-3) Electrically Conductive Layer

The electrically conductive layers 12*a* and 12*b* are used to establish an electrical connection within the thermal head. The electrically conductive layer 12*a* constitutes the common electrode which commonly connects one ends of respective heat generating elements of the heat generating layer 11 to, for instance the ground potential point. The electrically conductive layer 12*b* constitutes many electrodes for connecting respective heat generating elements of the heat generating layer 11 to the driving IC 15 separately. To this end, bonding wires 20 are soldered to the electrically conductive layer 12*b* and driving IC 15.

Since the electrically conductive layers 12*a* and 12*b* are contacted with the heat generating layer 11, the electrically conductive layers are influenced by the heat of about 400° C. generated during the printing operation. In a process of manufacturing the thermal head, the layers are heated to about 350° C. during the formation of the wear-resistant layer 10. Consequently the conductive layers 12*a* and 12*b* are also required to have a stable electric property at around 400 C. Here, the electric property mainly means a resistance and its change with time.

The electrically conductive layer 13 constituting the wiring section is soldered to the driving IC 15 and bonding wires 20, and is also connected to wires, for instance the pins 16 by solders 14 for establishing a connection to the external circuit, (Component IV) Heat storage Layer The beat storage layer 17 has a function for holding the heat generated by the heat generating layer 11 for a certain time period and preventing the heat from being transmitted to the driving IC 15 through the resin layer 18. Thus the heat storage layer 17 should have a low thermal conductivity and a high heat-resistance.

(Component V) Substrate

The substrate 19 constitutes fundamentally a supporting body of the thermal head. That is to say, the substrate has a function for supporting the printing section P, driving IC 15, electrically conductive layer 13 constituting the wiring section for connecting the thermal head to the external circuit, wires 16 connected to the wiring section. The substrate may be heated to about 400° C. during the manufacturing process. Thus the substrate 10 should have a high mechanical strength as well as a high heat-resistance. Moreover, the substrate preferably has a high thermal conductivity such that the heat generated by the thermal head during the printing operation could be dissipated.

Resin Layer 18

The resin layer 18 is used to protect the driving IC 15 and the bonding wire 20, and thus the resin layer should have a proper mechanical strength and a certain electrically insulating property.

[Substances of Respective Components of Thermal Head]

Now substances composing respective components of the thermal head, that is to say, respective layers of the printing section P and substrate 19 will be described. These components of the thermal head are made of substances which can satisfy the above mentioned characteristics.

Wear-resistant Layer

Although the wear-resistant layer 10 is preferably made of a substance which satisfies all the desired conditions mentioned above, such a substance could hardly be found. SiC based compound, SiB based compound, SiO based compound and SiON based compound may be listed as a substance which can satisfy the conditions to a relatively large extent.

Heat Generating Layer

The heat generating layer 11 has to be made of a substance which reveals a stable electric property at about 400° C. The heat generating layer is made of a metal such as Ta, an alloy such as Ni—Cr, a poly-Si and a mixture of a transition element and $SiO_2$ such as Nb—$SiO_2$. Among these substances, Nb—$SiO_2$ has been generally used, because its resistance can be easily controlled.

Electrically Conductive Layer

The electrically conductive layer 12*a,* 12*b* and wiring section 13 should be made of a substance also having a stable electric property at about 400° C. W, Ta, Au, Al and the like may be listed as such a substance.

In order to attain a desired resistance value and an easy connection to the driving IC 15, a multiple layer of the above stated metals may be used.

Heat Storage Layer

The heat storage layer 17 has to be made of a substance having a small thermal conductivity as well as a high heat-resistant property. Bakelite, polyimide, glass and the like may be listed as such a substance. The Bakelite is a trade name of phenol-formaldehyde. Glass has been generally used due to its hardness.

Substrate

The substrate 19 should be made of a substance having a high thermal conductivity and a high heat-resistance. MgO, ZnO, aluminum nitride, alumina ceramics and the like may be listed for such a substance. The alumina ceramics have been generally used due to its easy processing and low cost.

[Contact Between Printing Section and Thermal Paper]

Now a contact between the printing surface S of the printing section P and the thermal paper 21 during the printing operation will be explained.

The printing in the thermal head is carried out by conducting the heat generated by the heat generating layer 11 to the thermal paper 21 through the wear-resistant layer 10. Accordingly, in order to achieve a clear printing, the heat generated by the heat generating layer 11 has to be efficiently transmitted to the thermal paper 21, The more tight the contact between the printing surface S of the printing section P and the thermal paper 21 is, the better the heat transmission to the thermal paper 21 becomes. Therefore, the tight contact between the printing surface S of the printing section P and the thermal paper 21 has to be achieved by proper means. A method of making a tight contact between the printing surface S and the thermal paper 21 will be described while a facsimile is taken as an example.

In a machine in which the printing section P is arranged along a lateral line like as facsimile, the thermal paper 21 is generally urged against the printing surface S of the printing section P by means of the rubber roller 22. The rubber roller 22 also serves as a paper feeder. Accordingly upon designing the rubber roller 22, the hardness and shape of the rubber roller 22 are determined such that the tight contact can be attained between the printing surface S and the thermal paper 21 as far as possible.

[Connection of Driving IC]

Next, a method of establishing a connection to the driving IC 15 will be described with reference to FIGS. 2 and 3 in addition to FIG. 1. FIGS. 1–3 are cross sectional views showing the structure of known thermal heads. In the thermal heads depicted in FIGS. 2 and 3, the driving IC 15 is connected by means of the wire-bonding, and particularly the thermal head illustrated in FIG. 2 has the printing section which is higher than that of the thermal head shown in FIG. 1. In the thermal head illustrated in FIG. 3, the driving IC is connected by means of the flip chip bonding. Portions of the thermal heads shown in FIGS. 2 and 3 similar to those of FIG. 1 are denoted by the same reference numerals used in FIG. 1. It should be noted that in FIG. 2, a reference character I denotes a height from the surface of the substrate 19 to the printing section S, a reference character H a height from the surface of the substrate to a top of a bonding wire loop, and a reference character X represents a depressed portion of the printing section.

The driving IC 15 has been connected to the electrically conductive layer 12*b* and electrically conductive layers of the wiring section 13 by means of the following methods.

(Connecting Method 1) Wire Bonding

In the wire bonding method, a metal wire called a bonding wire is fused to the terminals of the driving IC as well as to an electrically conductive layer at a predetermined position. The wire bonding has been widely used as the connection method for the driving IC. The wire-bonding is described in, for instance Japanese Patent Application Publication No. 6-78004. FIGS. 1 and 2 show the driving IC 15 connected by a bonding wire 20.

(Connecting Method 2) Flip Chip Bonding

The flip chip bonding is a connecting method, in which solder balls are formed on a lower surface of the driving IC to be connected and the balls are fused to the conductive layer. The method is described in, for instance "Oki Electric Research and Development", No. 138, Vol. 55, No. 2. FIG. 3 illustrates the driving IC 15 connected by the flip chip bonding.

There has been further provided the following connecting method in addition to the above mentioned two methods.

(Connecting Method 3) TAB

TAB means Tape Automated Bonding. The tape is a connecting part formed by covering plural metal wires with an insulating resin and both ends of the metal wires are exposed on both ends. In the TAB method, the terminals of the driving IC are simultaneously connected to the electrically conductive layers at predetermined positions.

[Defect Caused by Wire Bonding]

As mentioned above, FIG. 1 shows the driving IC connected by the wire bonding. As can be understood from FIG. 1, when a distance between the driving IC 15 and the printing section P is small, the following defects might occur.

(1) As shown in FIG. 1, in the case that the driving IC 15 and the bonding wire 20 are covered with the protective resin 18, the resin might be brought into contact with the thermal paper 21 or rubber roller 22.

(2) On the other hand, in the case that the driving IC 15 and the bonding wire 20 are not covered with the protective resin 18, the driving IC and bonding wires might be brought into contact with the thermal paper 21 or rubber roller 22.

In each cases, there might be produced a problem that the bonding wires might be broken and adjacent electrically conductive layers might be short-circuited.

In order to solve such a problem, there may be considered the following two solutions.

[Solution for Avoiding Defect Caused by Wire Bonding and its Problem]

(Solution 1) A distance L Between the Driving IC and the Printing Section is Made Sufficiently Long In this case, the distance L has to be at least about 10 mm, so that the thermal head could not be further miniaturized.

(Solution 2) A Height I of the Printing Surface S is Increased

In this case, the height I of the printing surface S measured from the surface of the substrate 19 has to be not less than 200 $\mu$m. Now methods of making the height I of the printing surface S larger will be explained.

First as shown in FIG. 2, the heat storage layer 17 is formed on the substrate 19 such that its thickness is partially increased, and the printing surface S is formed on the heat storage layer such that the printing surface is protruded outwardly. Since the height H of a top of a loop of the bonding wires 20 is about 200 $\mu$m, the above problem could not be solved as long as the height I of the printing section P is not less than 200 $\mu$m. However, an actual height I of the printing surface S is about 50 $\mu$m.

In practice, if the height I of the printing surface S is made not less than 200 $\mu$m, surfaces of the heat generating layer 11 and electrically conductive layers 12*a*, 12*b* are also protruded outwardly, and therefore etching processes by a photolithography could not be performed accurately and a precision of pattern dimension might be decreased. Therefore, the electric characteristics are liable to fluctuate.

In the case of forming the heat storage layer 17 to have a partially hick portion, the depressed portion X is formed at a center of the printing surface S as shown in FIG. 2. Accordingly a tight contact could not be attained between the printing surface S and the thermal paper 21, and thus a print density might be reduced.

A solution for solving the problem of the depressed portion X in the printing section P is described in Japanese Patent Application Laid-open Publication No. 62-170361. In the solution, however, an addition process is required for forming a protruded portion on the heat storage layer 17 having a partially thickened portion, said protruded portion compensating the depressed portion X, and the process might become complicated and expensive.

(Solution for Mitigating Defect Caused by Wire Bonding]

The above mentioned (Solution 1) and (Solution 2) could not solve the problems of the undesired contact of the bonding wire 20 and resin 18 to the thermal paper 21 and rubber roller 22.

[Defect Caused by Flip Chip Bonding]

As explained above, in the example of FIG. 3, since the driving IC 15 is electrically connected by the flip chip bonding, after the driving IC is directly bonded to the conductive layer 12*b* and wiring section 13, the driving IC 15 is scaled with the resin 18. Therefore, the resin 18 might be brought into contact with the thermal paper 21 and rubber roller 22.

[Solution for Mitigating Defect caused by Flip Chip Bonding and its Problem]

In order to avoid the undesired contact of the resin 18 with the thermal paper 21 and rubber roller 22, the distance L between the driving IC and the printing section P has to be at least about 8 mm. Then, the thermal head could not be further miniaturized like as the above mentioned wire bonding.

Moreover a method of manufacturing the thermal head as shown in FIG. 4 is described in Japanese Patent Application Laid-open Publication No. 5-64905. In this method, a stainless steel plate is used as a provisional substrate 30 for manufacturing the thermal head as shown in FIG. 4 and after grinding the surface of the stainless steel plate as a mirror surface, a peeling-off layer 31 is formed by electroplating of copper, on which the wear-resistant layer 10, the heat generating layer 11, and the conductive layers 12*a* and 12*b* are deposited in turn as shown in FIGS. 4B~4D and a heat storage layer 32 made of a heat-resist resin is formed as shown in FIG. 4E. Then, an alumina substrate 34 is adhered on the heat storage layer 32 with an adhesive 33 as shown in FIG. 4F, and thereafter the provisional substrate 30 is peeled off at the interface of the peeled-off layer 31 to expose the wear-resistant layer 10 as a printing surface. Moreover a part of the wear-resistant layer 10 remote from the printing surface is removed to expose a part of the conductive layer 12*b*, to which the driving IC is connected to complete the thermal head.

This conventional method of manufacturing the thermal head has the following problems.

(1) It is very difficult to grind the stainless steel plate constituting the provisional substrate 30 as a flat mirror surface.

(2) When a number of thermal heads are simultaneously manufactured, it is very difficult to peel off the substrate 30 mechanically, because a surface area of the substrate is large.

(3) A thickness and plating conditions of the Cu plating layer constituting the peeled-off layer 31 could not be easily managed.

(4) Since peeling-off process could not be applied to a thermal head in which the printing section is protruded like as a partial graze, the thermal head having such a protruded printing section could never be manufactured.

(5) Since a thermal conductivity of the provisional substrate 30 made of stainless steel is different from that of the printing section formed on this substrate, the printing section is liable to be deformed during manufacturing.

(6) Characteristics of the printing section are liable to be changed due to a stress which is produced upon peeling off the substrate 30 made of stainless steel and is applied to the printing section.

(7) Since the driving IC is arranged on a side of the printing surface of the wear-resistant layer like as the conventional thermal heads shown in FIGS. 1–3, the distance L between the printing section and the driving IC could not be shortened and the problems mentioned above with reference to FIGS. 1–3 are remained unsolved.

In the known thermal heads, the problems of undesired contact of the driving IC itself as well as of the electric connection parts of the driving IC to the thermal paper must be solved, the thermal head has to be large to a certain extent and the printing section has to be projected largely.

However, this solution results in the following difficulties.

(1) The thermal head could not be miniaturized, and therefore a high manufacturing efficiency and a low manufacturing cost could not be realized.

(2) Since the printing section of the thermal head could not be formed easily, it is difficult to further improve a printing quality.

(3) According to the known manufacturing method, in which after forming the printing section by depositing the films on the stainless steel substrate, the substrate is peeled-off, there are not only the problems in difficulty of manufacturing and in the deformation, but also the problem in variation of characteristics of the printing section.

Therefore, the present invention has for its object to provide a thermal head, in which although a size of the thermal head is made small, a driving IC and its electric connection parts are not brought into contact with a thermal paper and a rubber roller, and thus the electric equipment could be protected against the cutting-off and short-circuit and as a result of which, the manufacturing could be performed efficiently at a low-cost.

It is another object of the invention to provide a thermal head having a smooth printing surface which could attain a good contact with a thermal paper.

It is still another object of this invention to provide a method of manufacturing such a thermal head in an easy and less expensive manner without special processes and operations.

DISCLOSURE OF THE INVENTION

In order to attain the above objects, according to the invention, a thermal head comprises:

a printing section including a wear-resistant layer having a first surface constituting a printing face to be brought into contact with a thermal record medium and a second surface opposite to the first surface, a heat generating layer formed an a side of the second surface of the wear-resistant layer and generating heat to be transmitted to the thermal record medium through the wear-resistant layer, and an electrically conductive layer formed on a side of the second surface of the wear-resistant layer and connected electrically to the heat generating layer;

a driving circuit section connected to the electrically conductive layer of the printing section to control a heat generating electric power to be supplied to said printing section; and a wiring section for connecting the driving circuit section to an external circuit;

wherein said driving circuit and wiring sections are arranged on a side of the second surface of the wear-resistant layer of the printing section.

In the thermal head according to the invention, since the driving circuit section and wiring section are arranged on a side of the wear-resistant layer opposite to the side which is to be brought into contact with a thermal record medium the driving circuit section and connecting wires could not be brought into contact with the thermal record medium and rubber roller, and therefore a distance between the printing section and the driving circuit section can be shortened and the thermal head can be miniaturized.

Upon practicing the thermal head according to the invention, the thermal head can be classified into the following four groups in accordance with its principal structure.

According to the first principal structure of the thermal head according to the invention;

said wear-resistant layer in the printing section has an extended part which extends beyond the printing section, said electrically conductive layer has an extended part which extends on a side of the second surface of the wear-resistant layer, said wiring section is provided on a side of the second surface of the extended part of the wear-resistant layer, and said driving circuit part is composed of integrated circuit chips, terminals of which are connected electrically to the extended part of the electrically conductive layer and to the wiring section.

In the second principal structure of the thermal head according to the invention, the thermal head comprises a supporting member provided on a side of the second surface of the wear-resistant layer of the printing section for supporting the printing section, driving circuit section, and wiring section.

Said supporting member comprises a resin member for bonding and fixing the printing section, driving circuit section and wiring section integrally, said resin member may be preferably made of epoxy resin, acrylic resin, or silicone resin.

In the third principal structure according to the invention, said supporting member comprises a heat dissipating member and an adhesive layer for fixing at least said printing section to said heat dissipating member.

According to the fourth principal structure of the thermal head according to the invention, said supporting member comprises a flat plate and an adhesive layer for fixing at least said printing section to the flat plate.

In each of the above mentioned first to fourth principal structures of the thermal head according to the invention, said printing surface may be flat or may be protruded outwardly, In the above explained third and fourth principal structures, said adhesive is preferably made of a resin selected from the group of epoxy resin, acrylic resin and silicone resin. Furthermore, said adhesive resin may contain powders such as alumina powders for increasing a thermal conductivity. Moreover, in the third and fourth principal structures, said means for fixing the driving circuit section and a part of the wiring section to said heat dissipating layer or flat plate may be preferably formed in the supporting member. This fixing member may be advantageously formed by a both-sided adhesive tape.

Moreover, in the third and fourth principal structures of the thermal head according to the invention, said adhesive layer is preferably made of thermosetting adhesive agent, heat-resistant inorganic adhesive agent or viscoelastic rubber.

In the thermal head according to the invention, said printing section is constructed by stacking the wear-resistant layer, heat generating layer and electrically conductive layer or by stacking the wear-resistant layer, electrically conductive layer and heat generating layer in this order viewed from the printing surface.

Furthermore, said printing section may comprise a protection layer on a side of the heat generating layer opposite to the printing surface, said protection layer preventing a diffusion of impurities into the beat generating layer. Said protection layer may be preferably made of at least one of SiNx and SiNx or a mixture thereof. In the thermal head according to the invention, said printing section may include a beat storage layer thermally coupled with the heat generating layer through the protection layer. Said heat storage layer may contain at least one of polyimide and glass. Particularly, the heat storage layer may be preferably made of a polyimide containing powders for adjusting its thermal conductivity.

The thermal head according to the invention may further comprises a heat dissipating body thermally coupled with the heat storage layer on a side opposite to the printing surface. Said heat dissipating body may be preferably made of at least one of Al, Cu, Ni, Fe, Mo and alumina ceramics.

In case of providing a heat dissipating member and flat plate, they may be preferably formed in such a shape that they are not directed contacted with the driving circuit section. Further, these heat dissipating body and flat plate may be preferably made of a material having a thermal conductivity not less than $6.27\times10^4$ J/m·h·° C. like as the above mentioned heat dissipating body, and particularly they may be made of Al, Cu, Ni, Fe, Mo and alumina ceramics.

According to the invention, a method of manufacturing a thermal head including a printing section which includes a wear-resistant layer having a printing surface to be brought into contact with a thermal record medium, a heat generating layer which generates heat to be transmitted to the thermal record medium through the wear-resistant layer, and an electrically conductive layer connected to the heat generating layer; a driving circuit section connected to the electrically conductive layer in the printing section to control a heat generating electric power to be supplied to the printing section; and a wiring section which connects the driving circuit section to an external circuit, comprises:

a step of forming the printing section on a substrate such that the printing surface of the wear-resistant layer is opposed to a surface of the substrate and at least a part of the electrically conductive layer is exposed on a side remote from the substrate;

a step of forming the wiring section on a side of the wear-resistant layer in the printing section remote from the substrate and providing said driving circuit section on the wiring section as well as on an exposed surface of the electrically conductive layer; and a step of separating said printing section, driving circuit section and wiring section from the substrate as an independent unit body.

In a preferable embodiment of the method of manufacturing the thermal head according to the invention, said wear-resistant layer is formed on the surface of the substrate to have an extended portion extending beyond the printing section, said electrically conductive layer is formed to have an extended portion beyond the printing section along said extended portion of the wear-resistant layer, and said driving circuit section is provided by connecting integrated circuit chips to the extended portion of the electrically conductive layer and to wiring section.

Furthermore, according to the invention, a recessed portion having a substantially semicircular cross sectional configuration is formed in the surface of the substrate and the wear-resistant layer of the printing section is formed along said recessed portion such that the printing surface to be brought into contact with the thermal record medium is formed to be outwardly projected, or said substrate has a flat surface and said wear-resistant layer is formed on this flat surface such that the printing surface to be brought into contact with the thermal record medium is formed to be flat.

In a preferable embodiment of the method of manufacturing the thermal head according to the invention, prior to separating said printing section, driving circuit section and wiring section from the substrate as an independent unit body, at least a part of the printing section, driving circuit section and wiring section is reinforced.

Such a reinforcing step may be carried out by adhering said printing section, driving circuit section and wiring section as a integral unit body or by adhering at least a part of the printing section, driving circuit section and wiring section to a supporting member or by adhering at least the printing section to a heat dissipating member with an adhesive layer or by adhering at least the printing section to a flat plate with an adhesive layer. In case of reinforcing with the adhesive layer, it is preferable to adhere at least said printing section to the supporting member, heat dissipating member or flat plate with a resin.

Furthermore, at least said printing section may be adhered to the supporting member, beat dissipating member or flat plate with thermosetting adhesive, silicone adhesive, heat-resistant inorganic adhesive or viscoelastic rubber.

Moreover, according to the invention, at least said printing section may be adhered to the supporting member, heat dissipating member or flat plate and at least a part of said driving circuit section and wiring section is secured to the supporting member, heat dissipating member or flat plate by means of a fixing member. This fixing member may be preferably formed by a both-sided adhesive tape. For instance, it is preferable to secure wires connected to the wiring section to the supporting member, heat dissipating member or flat plate by means of a both-sided adhesive tape and a common electrode connected to the electrically conductive layer constituting the common electrode may be secure to the supporting member, heat dissipating member or flat plate by means of a both-sided adhesive tape.

BRIEF DESCRIPTION OF THE DRAWINGS

FIGS. 39A–39H are cross sectional views illustrating successive steps of the method of manufacturing the thermal head having the third principal structure shown in FIG. 8.

BEST MODE OF CARRYING OUT THE INVENTION

Figure 1:
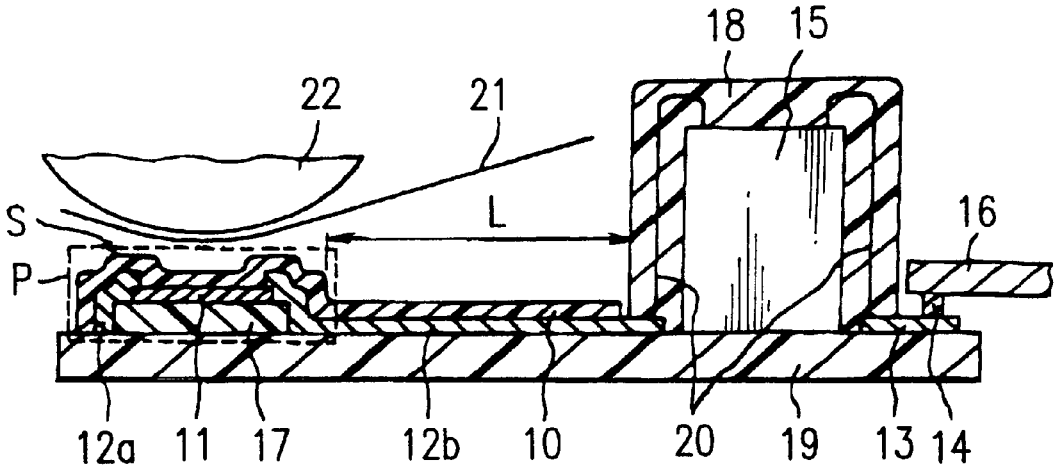
FIG. 1 is a cross sectional view showing an example of the conventional thermal head.

Now the present invention will be described in detailed with reference to the accompanying drawings. In these drawings, similar parts are denoted by the same reference numerals. For the sake of clearness, a driving IC is shown not as a cross sectional view.

[Thermal Head of First Principal Structure]

Figure 5:
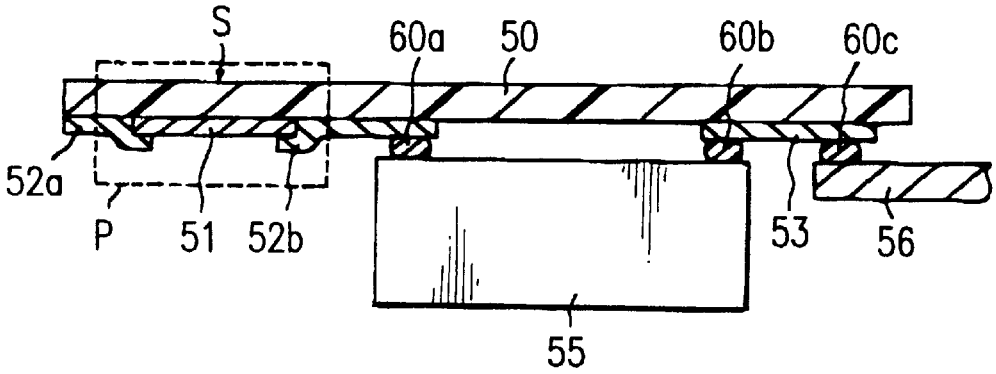
FIG. 5 is a cross sectional view representing the first principal structure of the thermal head according to the invention.

FIG. 5 is a cross sectional view showing an embodiment of the thermal head having the first principal structure of the thermal head of this invention. This thermal head shows the principal construction of the present invention. In FIG. 5, a reference numeral 5 denotes a wear-resistant layer, a reference numeral 51*a* beat generating layer and the reference numerals 52*a* and 52*b* electrically conductive layers constituting a common electrode and separate electrodes, respectively for supplying an electric current to the heat generating layer, a reference numeral 53 a wiring section formed by an electrically conductive layer for connecting a driving IC to an external circuit, a reference numeral 55 a driving IC, a reference numeral 56 a wire for connecting the wiring section 53 to the external circuit, and reference numerals 60*a,* 60*b,* and 60*c* designate connecting portions for electrically connecting the electrically conductive layer 52*b* and wiring section 53 to the driving IC 55 and connecting portions for electrically connecting the wiring section 53 to the wire 56, respectively. A reference character P designates a printing section including a part of the wear-resistant layer 50 surrounded by a dotted line and parts of the heat generating layer 51 and electrically conductive layer 52*a* and 52*b*. A reference character S denotes a printing surface formed by a surface of the wear-resistant layer 50, said printing surface being brought into contact with a thermal record medium. In the present embodiment, the printing surface is formed to be flat, but according to the principal structure of the present invention, the printing surface S may be protruded outwardly in a convex fashion. Moreover, in the embodiment illustrated in FIG. 5, the wear-resistant layer 50 is extended from the printing section P, the electrically conductive layer 52*b* is also extended from the printing section, and the driving IC 55 and wiring section 53 are arranged on these extended portions, but a part of the wear-resistant layer situating in the printing section P may be separated from the extended part. Similarly, the electrically conductive layer 52*b* may be formed as separate portions.

Figure 6:
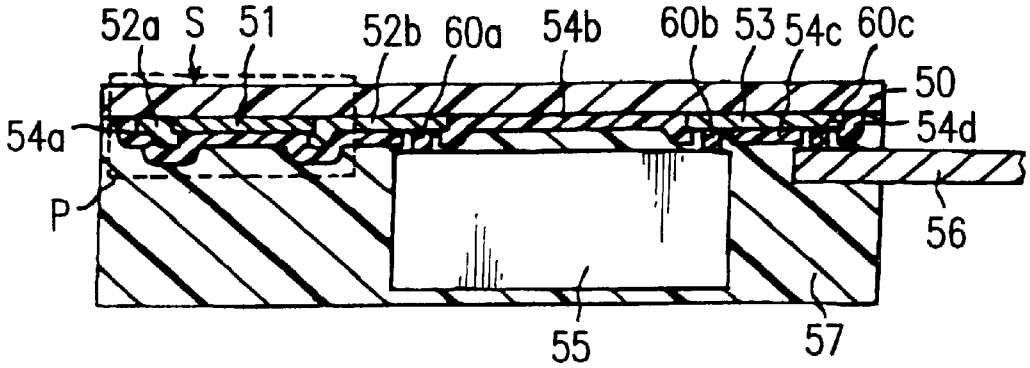
FIG. 6 is a cross sectional view showing the second principal structure of the thermal head according to the invention.

FIG. 6 is a cross sectional view showing an embodiment of the thermal head having the second principal structure of according to the present invention. Also in this embodiment, the printing surface S is formed to be flat, but the second principal structure may contain a protruded printing surface S.

In the second principal structure, the printing section P, driving IC 55 and wiring section 53 are reinforced by adhering them with a resin 57 as an integral unit body. In this embodiment, protection layers 54*a,* 54*b.* 54*c,* and 54*d* are formed such that the heat generating layer 51 in the printing section P, electrically conductive layers 52*a* and 52*b* and wiring section 53 are covered with the protection layers. The resin 57 of this second principal structure may be preferably made of epoxy resin, acrylic resin or silicone resin. And the protection layers 54*a,* 54*b,* 54*c,* and 54*d* may be preferably made of SiOx, SiNx or a mixture thereof SiOxNy.

Figure 7:
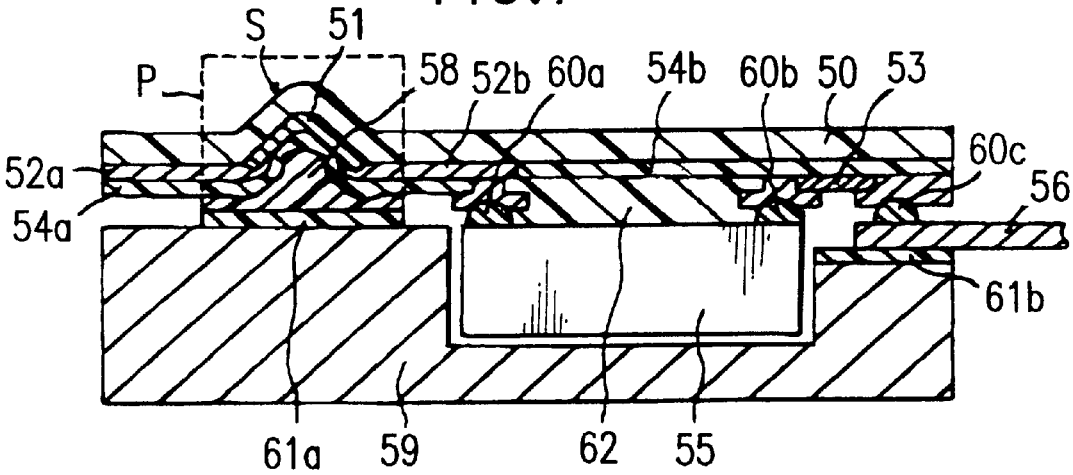
FIG. 7 is a cross sectional view depicting the third principal structure of the thermal head according to the invention.

FIG. 7 is a cross sectional view illustrating an embodiment of the thermal head having the third principal structure according to the invention. In this embodiment, the printing surface is formed to be smoothly protruded outwardly, but the third principal structure includes a flat printing surface. In this embodiment, a heat storage layer 58 is formed under a protection layer 54*a,* but the third structure contains thermal heads in which the protection layer or heat storage layer are dispensed with.

In the third principal structure, the printing section P, driving IC 55 and wiring section 53 are reinforced by forming them as an integral unit body by means of a heat dissipating member 59. That is to say, the electrically conductive layer 52*b* and wiring section 53 are electrically connected to the driving IC by means of connecting portions 60*a* and 60*b*, the wiring section 53 is electrically connected to the wire 56 by means of a connecting portion 60*c*, and the printing section P, driving IC 55 and wiring section 53 are secured to the heat dissipating member 59 with the aid of adhesive layer 61*a* and fixing member 61*b*. Further, the driving IC 55 and the protection layer 54*b* are secured to each other by filling a resin, preferable a silicone resin 62 therebetween.

It is preferable that the fixing member 61*b* is composed of a both-sided adhesive tape, but it may be also formed by an adhesive agent such as silicone adhesive or viscoelastic rubber. The adhesive layer 61 a is preferably made of epoxy resin, acrylic resin, and silicone resin considering a thermal conductivity of the heat storage layer 58 and heat dissipating member 59, but may be made of an adhesive such as thermosetting resin, silicone adhesive, heat-resistant inorganic adhesive and viscoelastic rubber. The heat dissipating member 59 is preferably made of a material having a thermal conductivity not less than $6.27\times10^4$ J/m·h·° C. such as Al, Cu, Ni, Fe, Mo and alumina ceramics. In the case that the heat dissipating member 59 is made of a metal, the fixing member 61*b* has to be electrically insulating because the fixing member 61 is formed between the wiring 56 and the heat dissipating member 59.

Figure 8:
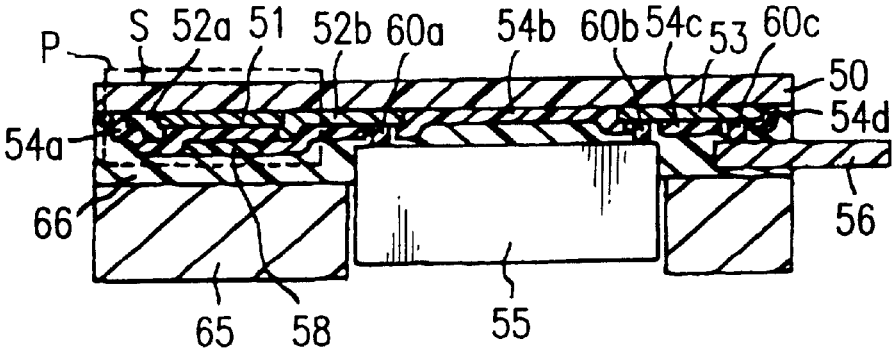
FIG. 8 is a cross sectional view illustrating the fourth principal structure of the thermal head according to the invention.

FIG. 8 is a cross sectional view illustrating an embodiment of the thermal head having the fourth principal structure according to the invention. In this embodiment, a printing surface S is formed to be flat, but the fourth principal structure contains also the protruded surface.

In the fourth principal structure, at least the printing section P is secured to a flat plate 65 by moans of a resin 66 as an integral unit body. In FIG. 8, in addition to the printing section P, the driving IC 55 and electrically conductive layer 53 forming the wiring section are secured to the flat plate 65 with the aid of the resin 66. The flat plate 65, herein, means a member like a plate whose opposing surfaces are in parallel or substantially parallel with each other. In this embodiment, in the flat plate 65, there is formed a through hole into which the driving IC 55 is inserted, but a recessed part may be formed in the inner wall of the flat plate for accommodating-the driving IC. Since the flat plate 65 has the function to reinforce the printing section P, driving IC 55 and wiring section as well as to dissipate the heat, the flat plate is preferably made of a material having a thermal conductivity not less than $6.27\times10^4$ J/m·h·° C. such as Al, Cu, Ni, Fe, Mo or alumina ceramics like as the heat dissipating member 59 of the third principal structure.

In the third and fourth principal structures shown in FIGS. 7 and 8 respectively, the resins 62 and 66 are preferably made of epoxy resin, acrylic resin, and silicone resin. The protection layers 54*a*, 54*b*, 54*c*, and are preferably made of SiOx, SiNx, or SiOxNx. Moreover, the above mentioned heat storage layer 58 is preferably made of glass, resin such as polyimide and Bakelite (trade name). Particularly, the heat storage layer is preferably made of a material having a thermal conductivity not higher than $4.18\times10^4$ J/m·h·° C. Particularly, the heat storage layer is preferably made of a resin, for instance a polyimide containing alumina or metal powders for adjusting a thermal conductivity to a value within the above range.

As above mentioned, in the thermal head of this invention, the printing section P having the wear-resistant layer 50, heat generating layer 51, electrically conductive layer 52*a* and 52*b* forming the electrodes and the wiring section 53 for performing the connection to the driving IC 55 and external circuit are arranged on a side of the wear-resistance layer 50 opposite to the printing surface S which is brought into contact with the thermal record medium. Therefore, on a side of the printing surface S, any part is not protruded from the wear-resistant layer 50, and thus the thermal head is not brought into contact with the thermal record medium and rubber roller for urge the record medium against the printing surface. Therefore, a whole size of the thermal head viewed in a traveling direction of the record medium can be small and the thermal head can be miniaturized. Due to such a miniaturization, the manufacturing efficiency can be improved and a low-cost can be realized. Moreover, in the thermal head according to the invention, the printing surface S is smooth, and therefore the thermal head can be brought into good contact with the thermal record medium.

Figure 9A:
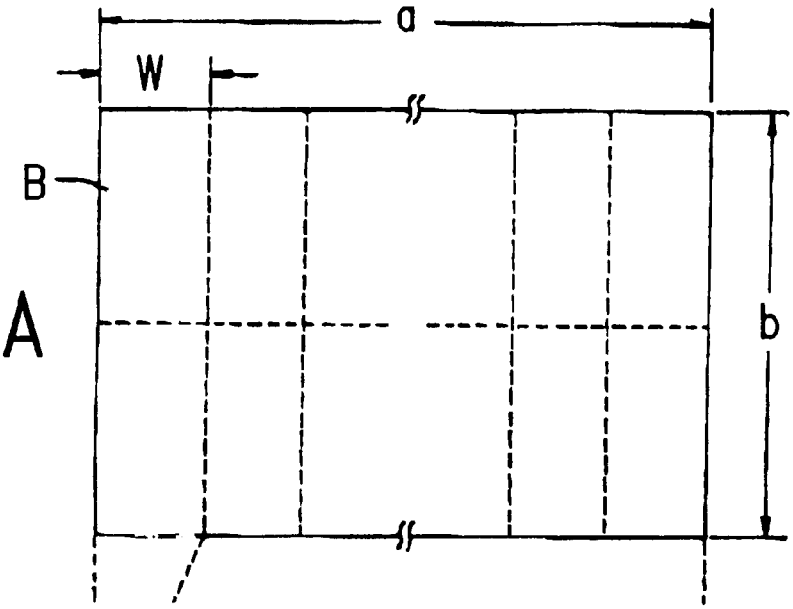
FIGS. 9A and 9B are diagrams representing conditions in which a number of the conventional thermal heads and a number of the thermal heads according to the invention are formed on substrates, respectively.
Figure 9B:
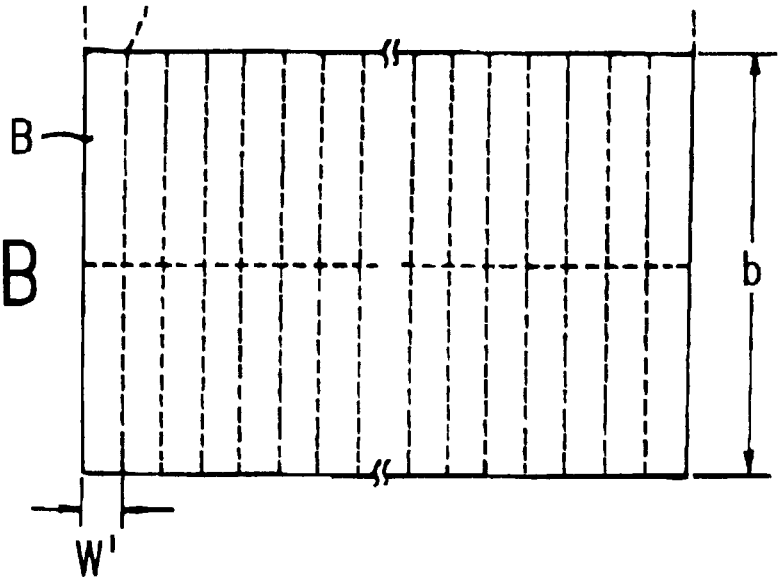
Figure 10A:
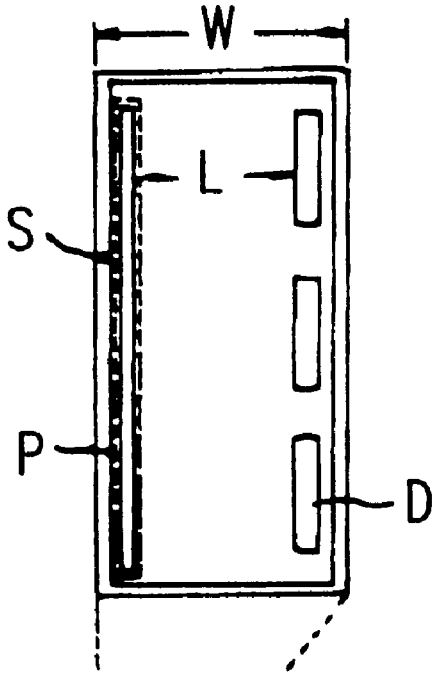
FIGS. 10A and 10B are plan views showing whole structures of the known thermal head and the thermal head of this invention, respectively.
Figure 10B:
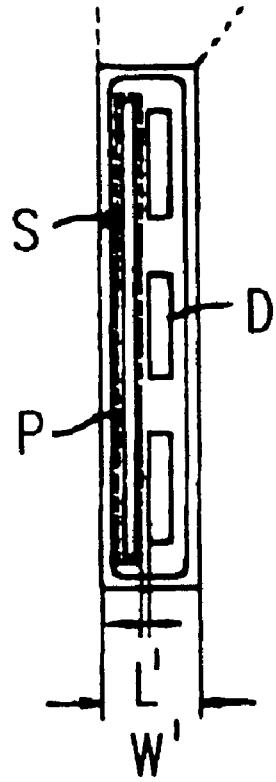

In case of practically manufacturing the thermal head, efficiency and cost of manufacturing the thermal head according to the invention are superior to those of manufacturing the known thermal head. This will be explained with reference to FIGS. 9 and 10, FIG. 9 is a schematic view showing a fact that the number of thermal heads according to the invention simultaneously manufactured in a single composite substrate can be greater than that of known thermal heads. FIG. 9A illustrates a case of manufacturing the conventional thermal heads and FIG. 9B shows a case of manufacturing the thermal heads according to the present invention. FIG. 10 is a schematic view showing a difference in size between the conventional thermal head and the thermal head according to the invention. FIG. 10A represents the known thermal head and FIG. 10B shows the thermal head according to the invention. It should be noted that FIGS. 10A and 10B depict ones of the thermal heads shown in FIGS. 9A and 9B, respectively on an enlarged scale. In FIG. 10, only the printing section P, printing surface S and driving circuit section D. A reference character a designates a lateral length of the composite substrate B, a reference character b a longitudinal length of the composite substrate B, reference characters L and L' a distance between the printing section S and the driving circuit section D of the known thermal head and the thermal head according to the invention, respectively and reference characters W and W' denote a width of the known thermal head and the thermal head according to the invention viewed in a travelling direction of the thermal record medium.

In general, in case of manufacturing the htermal heads on a mass production scale, respective thermal head are not manufactured separately, but after forming plural thermal heads on a composite substrate B having a certain size as shown in FIG. 9, the substrate is cut to obtain separate thermal heads. Thus, the composite substrate B means a substrate having a relatively large surface area such that plural thermal heads can be formed simultaneously.

In the conventional thermal head, the distance L between the printing section P and the driving circuit section D is so long that the lateral length W of each thermal head is large as shown in FIGS. 9A and 10A. Therefore, the number of the thermal heads obtained from a single composite substrate B is decreased and a manufacturing cost becomes expensive.

Contrary to the above conventional thermal head, in the thermal head according to the invention, the distance L' between the printing section P and the driving circuit section D is so short that the lateral length W' of each thermal head is short accordingly. Thus, the number of thermal heads manufactured from a single composite substrate B is increased and a manufacturing coat becomes decreased.

[Embodiment of Thermal Head Having Second Principal Structure]

Now, several embodiments of the thermal head according to the invention having the second principal structure explained above with reference to FIG. 6. Portions similar to those of FIGS. 5–8 are denoted by the same reference numerals and a detailed description thereof is omitted. In the second principal structure, the printing section P, driving IC section 55, and wiring section 53 and wires 56 for connecting the driving IC to an external circuit are reinforced by fixing them with the aid of the resin 57.

Figure 11:
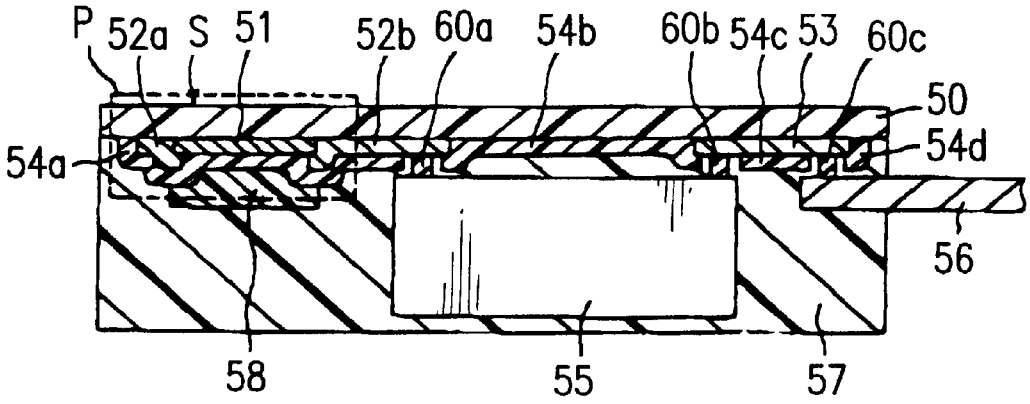
FIG. 11 is a cross sectional view illustrating an embodiment of the thermal head having the second principal structure according to the invention.

FIG. 11 shows an embodiment of the thermal head of this invention having the second principal structure. In this embodiment, a heat storage layer 58 is formed which is thermally coupled with a heat generating layer 51 constituting the printing section P. The remaining structure is similar to that of FIG. 5. That is to say, the heat storage layer 58 is formed under the heat generating layer 51 through the protection layer 54*a*. Therefore, the heat generated from the heat generating layer 51 is prevented from being transferred to the resin 57 and is retained within for a certain time period. In this manner, the heat storage layer 58 has to be formed near the heat generating layer 51, although it is sufficient to provide the heat storage layer 58 near the heat generating layer 52, it may be arranged beyond the heat generating layer.

As above mentioned, the heat storage layer 58 has a function for preventing the heat generated from the heat generating layer 51 from being transferred to the resin 57 and retaining the heat therein for a certain time period. Therefore, a thermal conductivity of the heat storage layer has to be low to a certain extent, in practice, has to be not higher than $4.18\times10^4$ J/m·h·° C. This heat storage layer 58 is preferably contain at least one of polyimide and glass, and more particularly, the heat storage layer may be made of a polyimide containing powders for adjusting a thermal conductivity. By providing the above mentioned beat storage layer 58, a printing at a low power becomes possible, and thus an efficiency of electric power of the thermal head can be improved.

Figure 12:
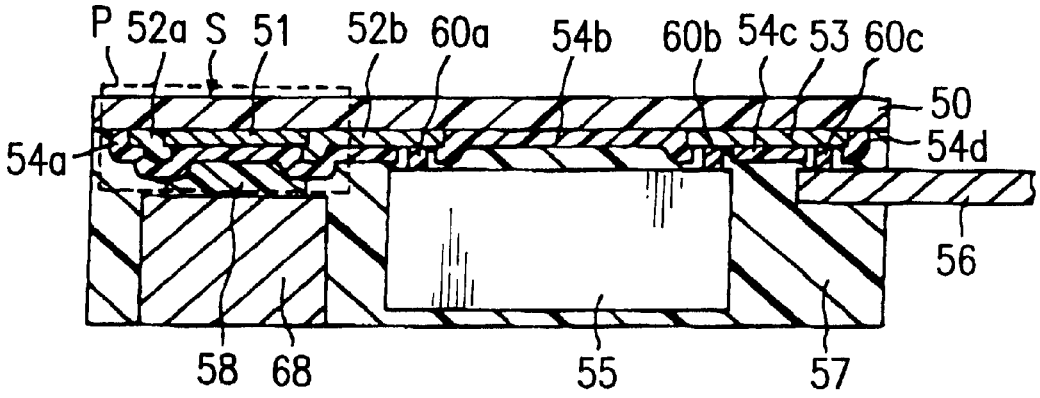
FIG. 12 is a cross sectional view depicting another embodiment of the thermal head having the second principal structure according to the present invention.

FIG. 12 is a cross sectional view showing an embodiment of the thermal head having the second principal structure according to this invention. In this embodiment, the printing surface S of the printing section P is formed flat and the heat dissipating body 68 is formed under the heat storage layer 58. The thermal head of this embodiment is identical with that shown in FIG. 6 except for the heat storage layer 58 and heat dissipating body 68, The heat dissipating body 68 is preferably made of a metal such as Al, Cu, Ni, Fe, and Mo or alumina ceramics.

By providing the heat dissipating body 68 under the heat storage layer 58, the heat stored in the heat storage layer is dissipated to the external, and thus a cooling rate of the printing section P during the heat dissipation can be made high. The "during the heat dissipation" means a condition in which an electric current does not flow through the heat generating layer 11.

In FIG. 12, the heat dissipating body 68 is arranged to be directly contacted with the lower part of the heat storage layer 58, but may be provided via another layer such as adhesive layer having a high thermal conductivity. The adhesive layer is preferably made of a silicone or epoxy resin containing alumina or metal powders for adjusting a thermal conductivity. Moreover, a part of the heat dissipating body 68 is preferably exposed from the resin 57.

[Function and Effect of Heat Dissipating Body]

As explained above, the heat dissipating body 68 serves to dissipate the heat stored in the heat storage layer 58 and to increase a cooling rate of the printing section P during the heat dissipation.

Figure 2:
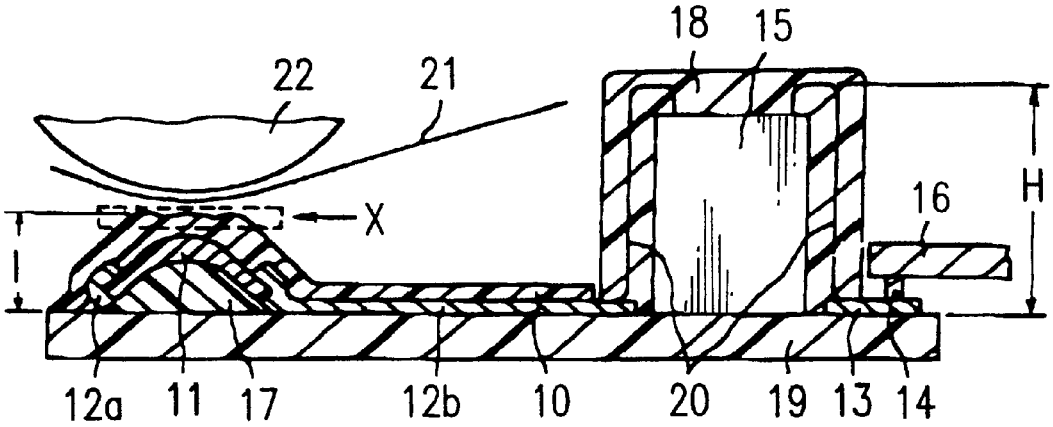
FIG. 2 is a cross sectional view illustrating another known thermal head.
Figure 3:
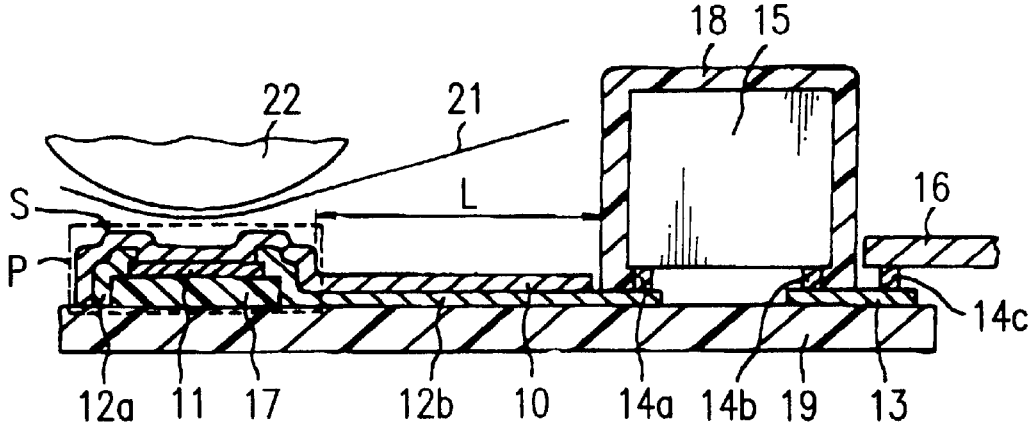
FIG. 3 is a cross sectional view depicting still another example of the conventional thermal head.
Figure 4A:
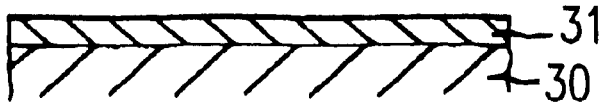
FIGS. 4A–4G are cross sectional views showing successive steps of a known method of manufacturing a thermal head.
Figure 4B:
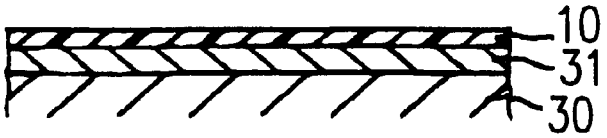
Figure 4C:
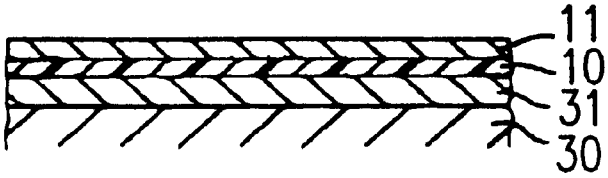
Figure 4D:
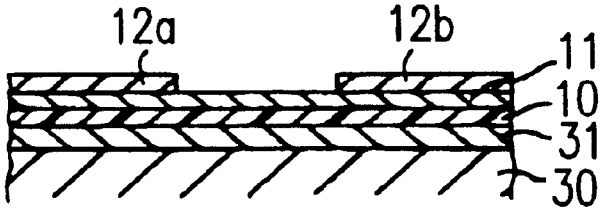
Figure 4E:
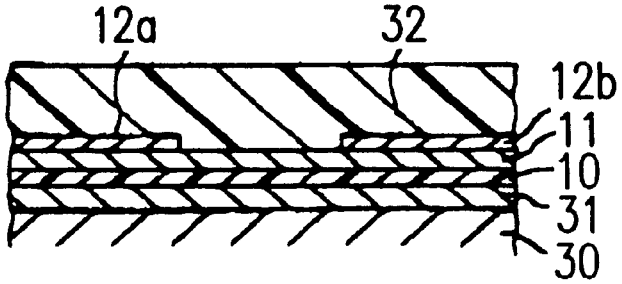
Figure 4F:
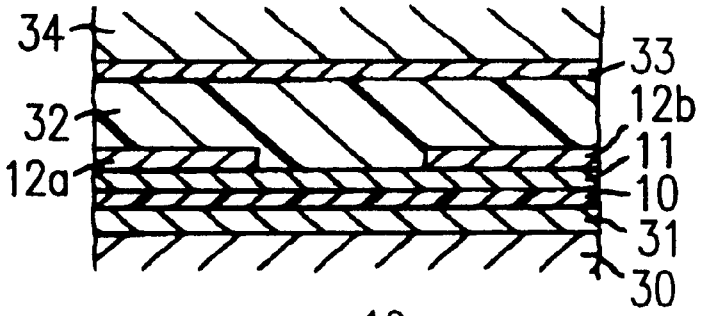
Figure 4G:
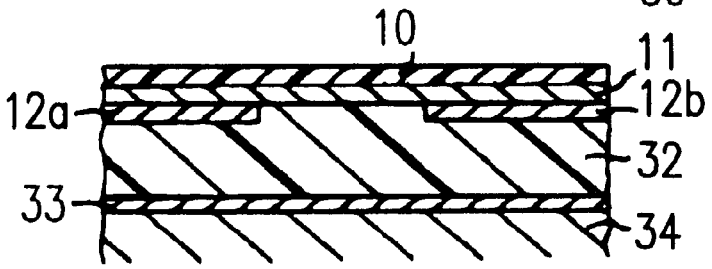
Figure 13:
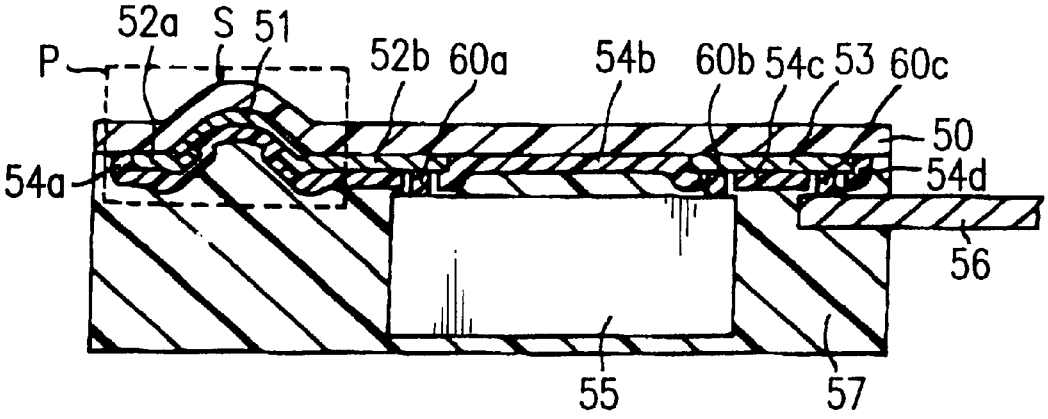
FIG. 13 is a cross sectional view showing another embodiment of the thermal head having the second principal structure according to the invention.
Figure 14:
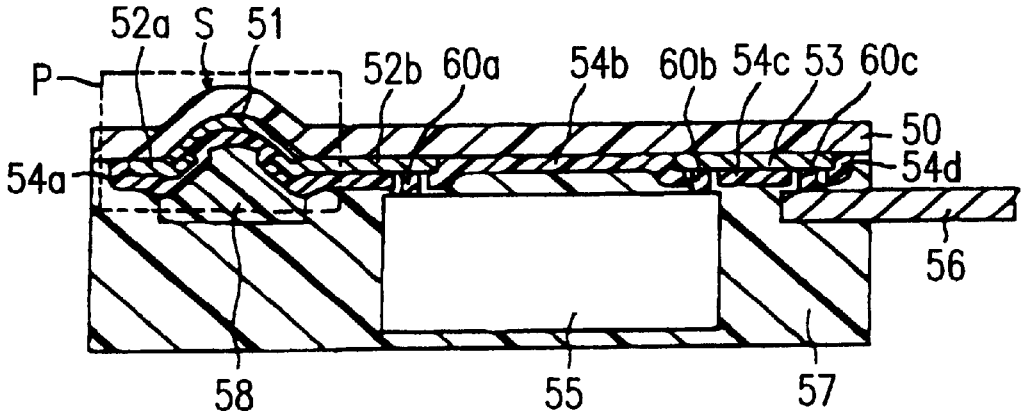
FIG. 14 is a cross sectional view illustrating another embodiment of the thermal head having the second principal structure according to the invention.
Figure 15:
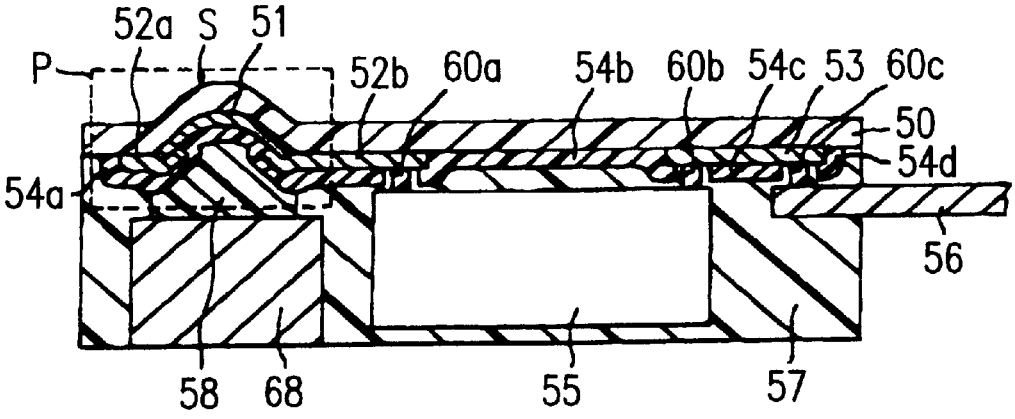
FIG. 15 is a cross sectional view showing another embodiment of the thermal head having the second principal structure according to the invention.

FIGS. 13, 14 and 15 are cross sectional views showing another embodiments of the thermal head having the second principal structure according to the invention. In these embodiments, the printing surface S has a smooth outwardly protruding surface, In the thermal head according to the present invention, although the thermal head has the printing surface S protruded outwardly, there is not formed a groove in the printing surface in the known thermal head shown in FIG. 2, but the smooth printing surface can be obtained. Thus, there can be attained a better contact between the printing surface S and the thermal record medium.

The embodiment of FIG. 13 corresponds to that shown in FIG. 6, the embodiment illustrated in FIG. 14 corresponds to that of FIG. 11 having the heat storage layer 58, and the embodiment shown in FIG. 15 corresponds to that depicted in FIG. 12 having the heat storage layer 58 and heat dissipating body 68.

In the thermal head according to the invention, the printing surface S may be flat or protruded outwardly. When the printing surface S is protruded outwardly, the thermal head can be brought into intimate contact with the thermal record paper, and therefore a heat can be efficiently transferred to the thermal record paper and a printing quality is improved.

FIGS. 16–21 show another embodiments of the thermal head having the second principal structure according to the invention. In the embodiments shown in FIG. 6 and FIGS. 11–15, the heat generating layer 51 and electrically conductive layers 52*a* and 52*b* in the printing section P are successively stacked in this order, but according to the present invention, the heat generating layer electrically conductive layers in the printing section P may be stacked in a reverse order. FIGS. 16–21 show such embodiments.

Figure 16:
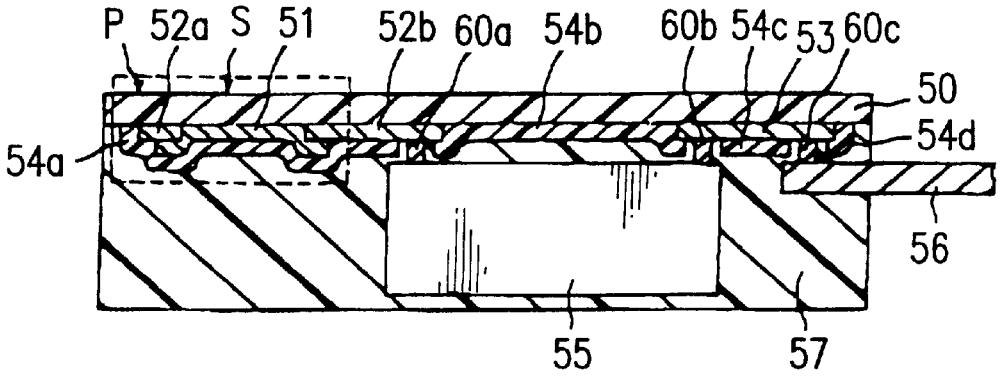
FIG. 16 is a cross sectional view showing another embodiment of the thermal head having the second principal structure according to the invention.
Figure 17:
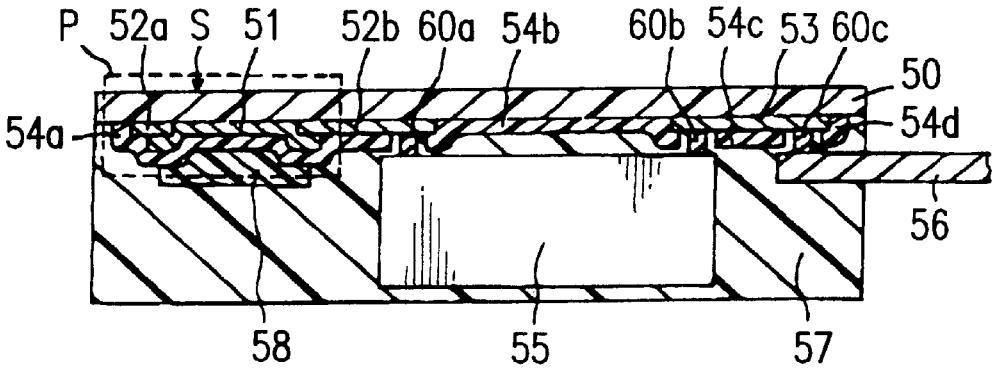
FIG. 17 is a cross sectional view depicting another embodiment of the thermal head having the second principal structure according to the invention.
Figure 18:
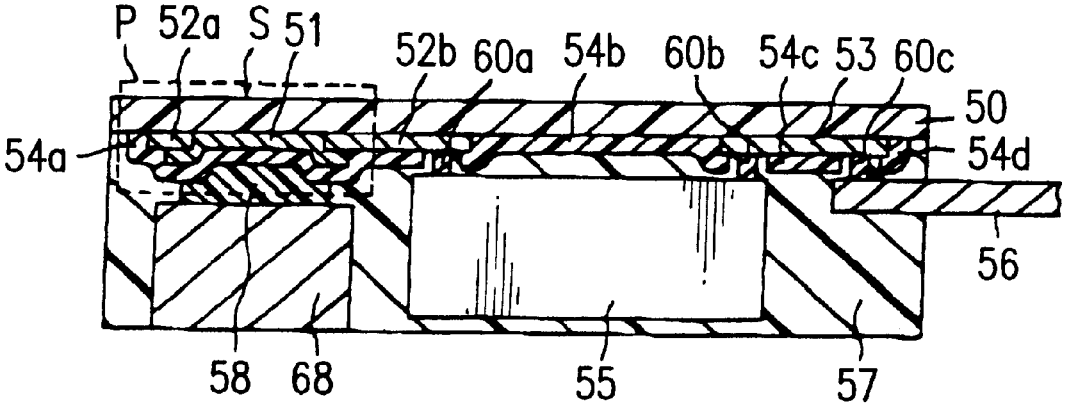
FIG. 18 is a cross sectional view illustrating another embodiment of the thermal head having the second principal structure according to the present invention.
Figure 19:
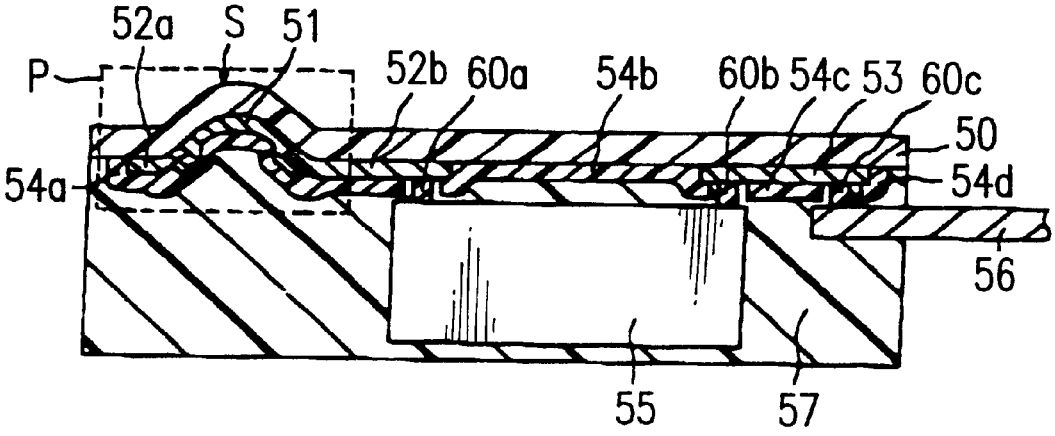
FIG. 19 is a cross sectional view showing another embodiment of the thermal head having the second principal structure according to the invention.

FIGS. 16, 17 and 18 show the thermal heads having the printing surface S formed to be flat. The embodiment depicted in FIG. 16 corresponds to that shown in FIG. 6, the embodiment illustrated in FIG. 17 corresponds to that shown in FIG. 11 having the beat storage layer 58, and the embodiment depicted in FIG. 18 corresponds to that illustrated in FIG. 12 having the beat storage layer 58 and heat dissipating body 68. FIGS. 19. 20 and 21 show the thermal heads having the printing surface S formed to be protruded outwardly. The embodiment shown in FIG. 19 corresponds to that illustrated in FIG. 13, the embodiment of FIG. 20 corresponds to that shown in FIG. 14 having the heat storage layer 58, and the embodiment illustrated in FIG. 21 corresponds to that depicted in FIG. 15 having the heat storage layer 58 and heat dissipating body 68. In the thermal heads shown in FIGS. 16–21, the heat generating layer 51 is arranged on the electrically conductive layers 52*a* and 52*b* viewed from the wear-resistant layer 50. It should be noted that an order to stacking these two layers is determined by the method of forming the heat generating layer 51 and a material constituting the electrically conductive layers 52*a* and 52*b*.

In the third and fourth principal structures according to the invention shown in FIG. 7 and FIG. 8, respectively, the thermal head is reinforced by means of the heat dissipating member 59 and the flat plate 65, respectively. Functions and materials of the heat dissipating member 59 and flat plate 65 will be explained hereinbelow, mainly with reference to the flat plate 65.

As shown in FIG. 8, the flat plate 65 is formed under the heat storage layer 58 by interposing the resin 66 therebetween. The flat plate has the function of supporting the whole components of the thermal head mechanically and shortening a cooling time of the printing section P during the heat dissipation. By using the flat plate 65, therefore, a mechanical strength of the thermal head is improved and a printing speed is increased.

The flat plate 65 with the above mentioned functions should have a proper mechanical strength and a relatively high thermal conductivity. Particularly, a thermal conductivity of the flat plate 65 is preferably not less than $6.27\times11^4$ J/m·h·° C.

The heat dissipating member 59 and flat plate 65 are not particularly limited, but may be formed in various shapes. Considering miniaturization, efficient heat transfer and reliability, however, they are preferably formed in such a shape that they are not brought into contact with the driving IC. For instance, a portion of these members corresponding to a position of the driving IC 55 may be depressed or cut out.

Moreover, the surfaces of the heat dissipating member 59 and flat plate 65 opposite to the resin 66 may be formed to have heat dissipating fins. By forming the flat plate 65 in such a shape, the heat dissipating faculty can be further improved.

A size of the heat dissipating member 59 and flat plate 65 may be properly determined considering the miniaturization, mechanical strength and heat dissipation.

The heat dissipating member 59 and flat plate 65 are preferably made of a substance having a thermal conductivity not less than $6.27\times10^4$ J/m·h·° C. as mentioned above. Such substances are listed in the following Table 1. It should be noted that a substance having a higher thermal conductivity can yield improved heat dissipation and heat-resistant characteristics, and therefore Al and Cu may be preferably used.

TABLE 1

| Substance | $Al_2O_3$ | Pb | Fe | Ni | Al | Cu |
|---|---|---|---|---|---|---|
| Thermal conductivity ($\times 10^4$ J/m · h · ° C.) | 7.6 | 12.5 | 24.2 | 32.1 | 73.2 | 13.9 |

[Embodiment of Thermal Head Having Fourth Principal Structure]

Figure 22:
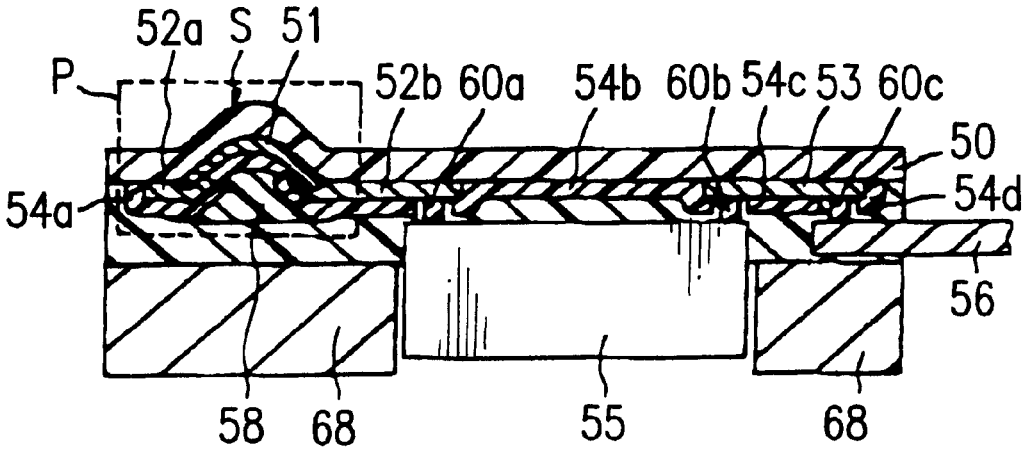
FIG. 22 is a cross sectional view representing an embodiment of the thermal head having the fourth principal structure according to the present invention.
Figure 23:
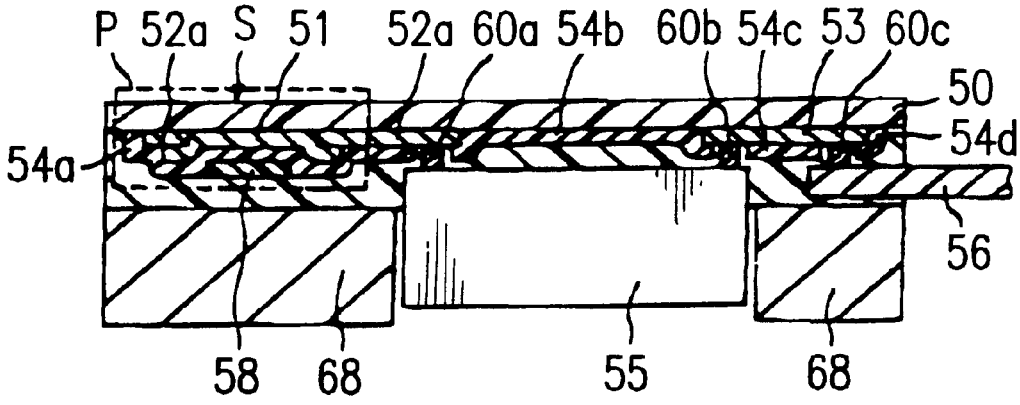
FIG. 23 is a cross sectional view illustrating another embodiment of the thermal head having the fourth principal structure according to the invention.
Figure 24:
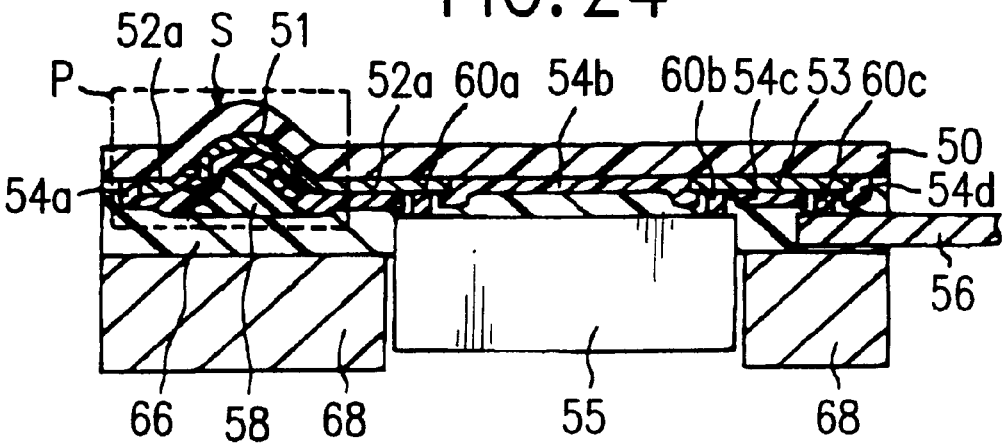
FIG. 24 is a cross sectional view depicting another embodiment of the thermal head having the fourth principal structure according to the present invention.

FIGS. 22–24 show several embodiments of the thermal head having the fourth principal structure according to the invention using the flat plate 65 as stated above. In the embodiment shown in FIG. 22, the printing surface S is formed into a concave shape and the heat storage layer 58 is provided below the printing section P.

In the embodiment of FIG. 23, the printing surface S is formed to be flat and the heat storage layer 58 is formed below the printing section P.

In the embodiment depicted in FIG. 24, the printing surface S is formed to be convex and the heat storage layer 58 is formed below the printing section P like as the embodiment of FIG. 22, but an order of stacking the heat generating layer 51 and electrically conductive layers 52*a*, 52*b* is reversed to that of the embodiment illustrated in FIG. 22.

Now a relationship between the method of manufacturing the heat generating layer 51, a substance of the electrically conductive layers 52*a* and 52*b* and a stacking order will be explained.

In Case of Forming Heat Generating Layer by High Temperature Process

The high temperature process, herein, means a process of forming a film at a temperature not lower than 500° C. As a typical example of the high temperature film forming process is LPCVD (Low Pressure Chemical Vapor Deposition), in which a chemical vapor deposition is carried out at a low pressure.

In case of forming the heat generating layer 51 by the high temperature process, a stacking order of the heat generating layer and electrically conductive layer is determined by a melting point and the like of a substance constituting the electrically conductive layers 52*a* and 52*b*. This will be further described as follows.

In Case of Making Electrically Conductive Layers of Low Melting Point Substance

When the electrically conductive layers 52*a* and 52*b* are made of a substance having a low melting point and electric characteristics are unstable at a high temperature, the heat generating layer 51 could not be formed after forming the electrically conductive layers. Aluminum may be given as a typical substance belonging to such a substance. In the case that the electrically conductive layers 52*a* and 52*b* are made of a metal having a low melting point, the electrically conductive layers has to be formed after forming the heat generating layer 51.

In Case of Making Electrically Conductive Layers of High Melting Point Substance When the electrically conductive layers 52*a* and 52*b* are made of a substance having a high melting point and electric characteristics of the layers are stable even at a high temperature, the heat generating layer 51 could be formed after forming the electrically conductive layers 52*a* and 52*b*. Substances having a melting point not lower than 2800° C. are preferably used, and W and Ta may be used. A melting point of W is 2990° C. and that of Ta is 3400° C.

In Case of Making Heat Generating Layer by Low Temperature Process

The low temperature process, herein, means a process of forming a film at a temperature not higher than 300° C. As a typical example of such a film forming process at a low temperature is plasma CVD and sputtering. The plasma CVD, herein, means Plasma-enhanced Chemical Vapor Deposition, and is one of the film forming method using the chemical vapor deposition.

In this case, the above mentioned problems caused by the electrically conductive layers 52*a* and 52*b* at a high temperature do not occur. Therefore, the heat generating layer 51 could be formed after or before forming the electrically conductive layers 52*a* and 52*b*.

Figure 25:
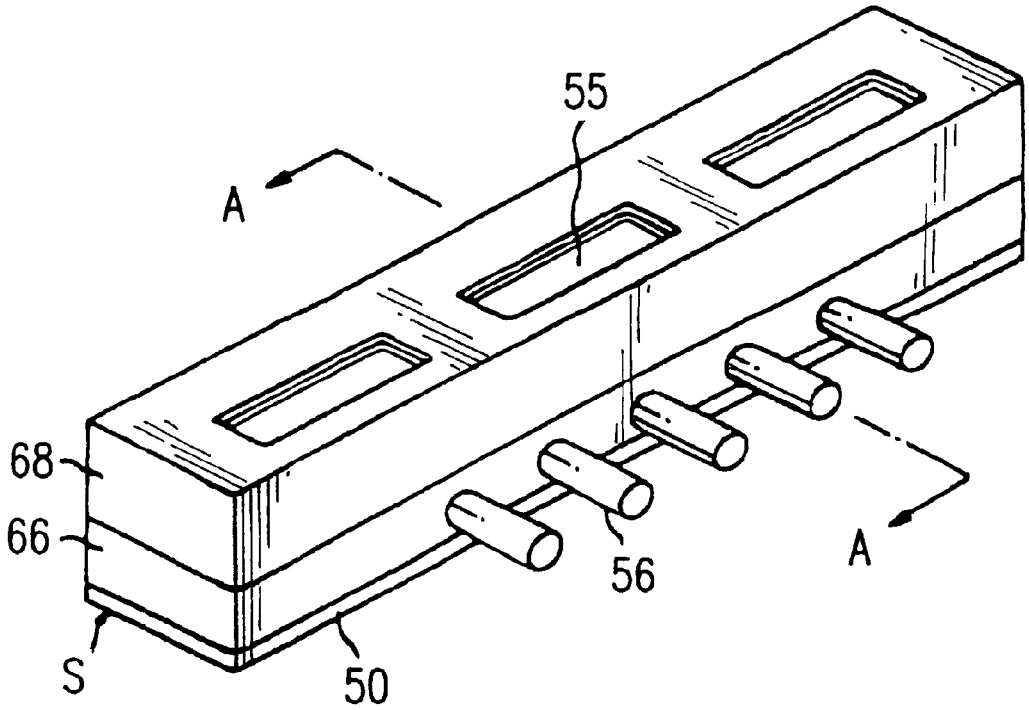
FIG. 25 is a cross sectional view showing another embodiment of the thermal head having the fourth principal structure of this invention.
Figure 26:
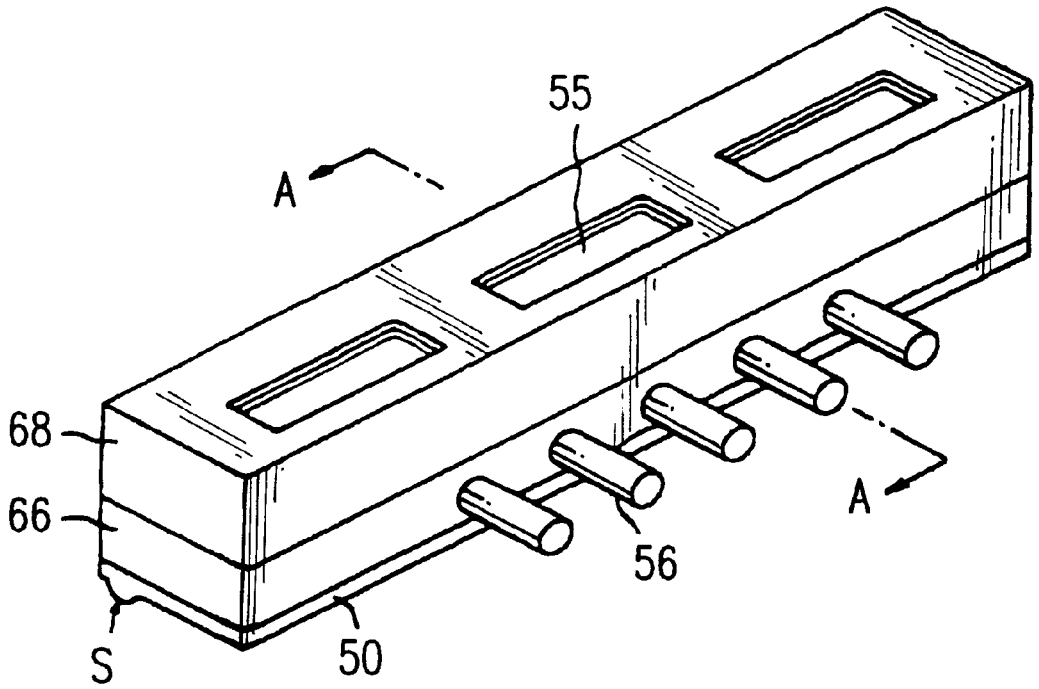
FIG. 26 is a cross sectional view representing another embodiment of the thermal head having the fourth principal structure according to the invention.

As explained above, the flat plate may be formed to have the through hole at a position corresponding to the driving IC 55 as shown in FIG. 8. FIGS. 25 and 26 are perspective views showing the thermal head according to the invention with the printing surface S is directed downward. A cross sectional view taken along A—A line in FIG. 25 corresponds to FIG. 8 or 23 wherein the printing surface S is formed to be flat and a cross sectional view taken along A—A line in FIG. 26 corresponds to FIG. 22 or 24 wherein the printing surface S is formed to be protruded outwardly.

As stated above, the thermal head according to the invention can be constructed to have any of the above explained first to fourth principal structures, and is not limited to the above embodiments shown in the drawings.

In the thermal head according to the present invention, various portions of the thermal head may be made of substances which have been used in the known thermal head. For example, a FPC used in the known thermal head may be used as the wiring 56 for connecting the driving IC to an external circuit. In the thermal head according to the invention, however, the wiring 56 to an external circuit is preferably formed by terminals such as lead frame or metal stick. The lead frame may be made ox generally used substances such as Fe alloy or Cu alloy. Among these substances, 42 wt %Ni-58 wt %Fe is preferable as the Fe alloy, and a substance adding Fe, Sn, and Zr to Cu is preferable as the Cu alloy. Further, the metal tick may be made of generally used substances such as Fe, Cu and Al. It should be noted that metal stick may be made of the above mentioned alloys.

Next, the method of manufacturing the thermal head according to the invention will be explained.

Before describing embodiments, fundamental matters in the method of manufacturing the thermal head according to the present invention will be explained.

In the method of manufacturing the thermal head according to the invention, a stacking order is revered as compared with the conventional methods, and thus at first, the wear-resistant layer is formed. A substrate used as a support in the known thermal head is used as a tool for manufacturing the thermal head according to the invention.

In the method of manufacturing the thermal head according to the invention, an excellent printing surface protruded outwardly without a groove can be obtained, and since the substrate serving as a manufacturing tool can be used repeatedly, a manufacturing cost can be decreased.

The method of manufacturing the thermal head according to the present invention includes the following five fundamental steps:

step A Pre-treatment of Substrate step B: Formation of Main Components step C Formation of Additional Components step D Fixation of Various Components step B: Separation of Thermal Head from Substrate Each of the above steps contains several small steps. Now these steps will be described.

(step A) Pre-treatment of Substrate (step A1) Processing of Substrate

A substrate is etched to have a desired shape corresponding to a shape of a printing surface. Si, glass, alumina and the like can be used as a material of the substrate. It is preferable to use a borosilicate glass because the borosilicate glass is cheap and can be easily removed by etching.

(step A-2) Formation of Sacrificial Layer for Peeling-off

A sacrificial layer is formed on the substrate for separating the thermal head form the substrate after forming the thermal head. The sacrificial layer may be mande of MgO, CaO, ZnO and the like. Conventional methods like as sputtering may be used for forming the sacrificial layer.

(step B) Formation of Main Components (step B-1) Formation of Wear-resistant Layer A wear-resistant layer is formed by depositing SiC compound, SiB compound, SiO compound or SiON compound. Several conventional methods such as plasma CVD may be used for the formation of the wear-resistant layer.

(step B-2) Formation of Heat Generating Layer

A heat generating layer is formed by depositing Ta, Ni-Cr or Nb-SiO2. Several known methods such as LPCVD, plasma CVD, and sputtering may be used for forming the heat generating layer. Dry-etching such as RIE (Reactive Ion Etching) is preferably used as the etching method for etching the heat generating layer into a desired pattern, but wet-etching may also be used. $SF_6$, $CF_4$, $Cl_2$, $O_2$ or a mixture thereof may be generally used as an etchant of the dry-etching. The term "etchant", herein, means a reactive gas used in the dry-etching. The heat generating layer may be made of a metal such as Ta or an alloy such as Ni—Cr or Nb—$SiO_2$ or may be made of $TiO_2$ or BN.

(step B-3) Formation of Electrically Conductive Layer

An electrically conductive layer may be made of W, Ta, Au, Al and the like, Several conventional methods such as sputtering may be used for forming the electrically conductive layer. The electrically conductive layer includes the electrically conductive layers 52*a* and 52*b* and the electrically conductive layer constituting wiring section 53. Wet-etching may be preferably used as the etching method for etching the electrically conductive layer, but dry-etching may also be used. $H2SO_4$ and $HNO_3$ may be used as an etchant of the wet-etching. Particularly a mixed acid solution of $H_3PO_4$, $C_2H_4O_2$ and $HNO_3$ may be used as an etchant for etching Al. The term "etchant", herein, means a solution used in wet-etching. The above mental may be, herein, used as a multi-layer.

(step B4) Forming Protection Layer

The protection layer may be made of SiOx, SiNx, SiOxNy, and the like. $SiO_2$ (x=2) having a stoichiometric composition may be used as the SiOx, but SiOx of about $1 \leqq x \leqq 2$ may be preferably used. Similarly, SiNx of $2/3 \leqq x \leqq 4/3$ may be preferably used, while a stoichiometric $Si_3N_4$ (x=4/3) may be also used as SiNx. A value of x is not, however, limited to the above mentioned range. Furthermore, a mixture of SiOx and SiNx termed as SiOxNy may be preferably used. The protection layer is formed by one or more of the above mentioned layers. Conventional methods such as LPCVD, plasma CVD and sputtering may be used for forming the electrically conductive layer.

As an etching method of piercing the protection layer 54 for constituting the electrical connection between the electrically conductive layer 52*b* and the driving IC 55, between the driving IC and the wiring section 53, and between the wiring section and the wiring 56 to an external circuit, a wet-etching may be preferably used, but a dry-etching may be also used. HF and a mixed solution of HF and $NH_4F$ are generally used as an etchant of the wet-etching.

By providing the protection layers 54*a*, 54*b*, 54*c*, and 54*d*, the heat generating layer and electrically conductive layer can be isolated, and at the same time the diffusion of substances from the heat storage layer 58 or resin 57, 62, and 66 to the heat generating layer 51, electrically conductive layers 52*a* and 52*b* or wiring section 53 can be prevented, and therefore the characteristics of these layers can be maintained stable for a long time Moreover by forming the electrically conductive layers 54*a*, 54*b*, 54*c*, and 54*d* such that all the electrically conductive layers except for portions providing electric connections between the driving IC 55 and the electrically conductive layers 52*a* and 52*b* and between the wiring section 53 and the wiring 56, the driving IC and other members can be prevented from being short-circuited, and thus a degradation of the electrically conductive layer due to a composition of the resin can be prevented although the electrically conductive layer is heated to a high temperature under such a condition that the electrically conductive layer is brought into contact with the resin and an electric current flows through the electrically conductive layer.

(step B-5) Connection of Wire to Driving IC and External Circuit

Electrical connections are established between the electrically conductive layer 52*b* and the driving IC 55, between the driving IC and the wiring section 53, and between the wiring section and the wiring 56. Particularly, a flip chip-bonding may be preferably used in establishing a connection to the driving IC, The step B-1 and step B-2 may be carried out in any suitable order in accordance with an order to stacking the heat generating layer 51 and electrically conductive layers 52*a*, 52*b*. The above mentioned two steps B-3 and B-4 may be performed in any order by suitably selecting a method of manufacturing the heat generating layer and a substance of the electrically conductive layer.

In the present invention, the electrical connection between the wiring section 53 and the wiring 56 means a connection between the wiring section of the thermal head and tip portions of terminals connected to a cable, and does not include a connection between the wire 56 and an external circuit. The process of connecting the wire 56 to the cable may be carried out after separating the thermal head from the substrate.

(step C) Formation of Additional Components (step C-1) Formation of Heat Storage Layer The heat storage layer may be made of a substance having a thermal conductivity not higher than $4.18 \times 10^5$ J/m·h·° C. such as Bakelite (trade name), polyimide and glass or a mixture containing at least one of such substances. Several conventional methods like screen printing may be used for forming the heat storage layer. (step C-2) Provision of Heat Dissipation Body The heat dissipating body may be made of a substance having a thermal conductivity not higher than $4.18\times10^5$ J/m·h·° C. such as Al, Mg, Cu and Mo and may be provided by using an adhesive agent. Since the printing section can be reinforced by providing the heat dissipating body, a next step D may be omitted. This step C may be performed in any suitable manner in order to form the thermal head into a desired shape.

(step D) Reinforcement

The printing section P, driving IC 55 and wiring section 53 may be reinforced with epoxy resin, acrylic resin, silicone resin, etc. and at least the printing section P may be fixed to the beat dissipating member 59 or flat plate 65 with adhesive or both-sided adhesive tape. It is preferable to use a resin having a coefficient of linear expansion after curing close to that of the substrate which is used as a tool for manufacturing the thermal head. This is due to a fact that by selecting the two substances having similar coefficients of linear expansion, a stress generated after hardening can be remained small. The printing section, driving IC and wiring section may be integrated into a single unit by means of the above resin producing a small stress, but when an amount of the resin is large, the substrate might be bent by the stress. Thermosetting adhesive, silicone adhesive, heat-resistant adhesive, viscoelastic rubber, etc. may be preferably used as the adhesive. The printing section P may be adhered to the heat dissipating member or flat plate with an adhere layer and at least a part of the driving IC section and wiring section may be secured to the supporting member by means of a resin.

(step E) Separation of Thermal Head from Substrate (step E-1) Peeling-off of Substrate by Removal of Sacrificial Layer The sacrificial layer is removed by etching the substrate such that the thermal head is independent from the substrate. Wet-etching which can perform a selective etching easily may be preferably used as the etching method. In this case, the wear-resistant layer acts as an etching stopper. The substrate may be etched effectively by removing a part of the substrate by a mechanical grinding, and then by removing all the remaining portion by a wet-etching. An etching efficiency may be increased by using an etching solution containing grinding balls, in such an etching a mechanical etching is also performed. It is preferable to use a substrate made of a glass, because the glass has a coefficient of heat expansion closer to those of the films formed in the printing section of the thermal head compared with a stainless steel, and thus an influences of heat expansion and beat shrinkage to the printing section is small and characteristics of the thermal head are influenced to a less extent. Moreover, a problem of damage during the separation does not occur as compared with the peeling-off, and the thermal head can be easily manufactured.

Now the method of manufacturing the thermal head according to the invention will be explained with reference to several embodiments.

[Embodiment 1]

FIGS. 27A–27G show successive steps for manufacturing the thermal head having the flat printing surface S as shown in FIG. 6.

(step A-2) Formation of Sacrificial Layer for Peeling-off

Figure 27A:
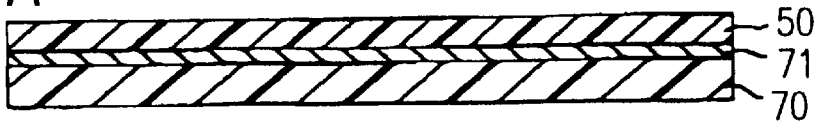
FIGS. 27A–27G are cross sectional views showing successive steps of the method of manufacturing the thermal head shown in FIG. 6.

At first a provisional substrate 70 serving as a manufacturing tool was made of 7059 glass of Corning Company (barium borosilicate glass) as shown in FIG. 27A, and a MgO layer serving as the sacrificial layer 71 was formed on the substrate by sputtering. A thickness of this MgO layer was 2 μm.

(step B-1) Formation of Wear-resistant Layer

Next, after forming the sacrificial layer 71 for peeling-off, a wear-resistant layer 50 was formed by depositing SiB layer and SiON layer by plasma CVD. The SiB layer and SiON layer were formed successively in this order. The SiB layer and the SiON layer were formed to have a thickness of 7 μm and 3 μm, respectively.

(step B-2) Formation of Heat Generating Layer

Figure 27B:
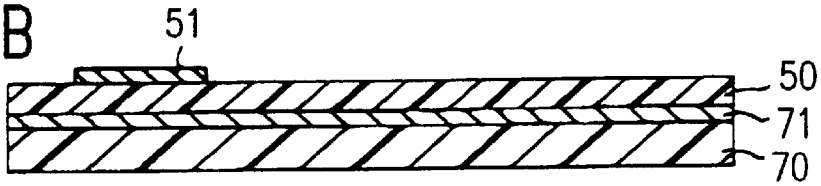

After forming the wear-resistant layer 50, a $NbSiO_2$ layer constituting the heat generating layer 51 was formed by sputtering. A thickness of the $NbSiO_2$ layer was 0.2 μm. The thus formed $NbSiO_2$ layer was etched into a desired pattern by RIE to form the heat generating layer 51 as shown in FIG. 27B. $SF_6$ was used as an etchant.

(step B-3) Formation of Electrically Conductive Layer

Figure 27C:
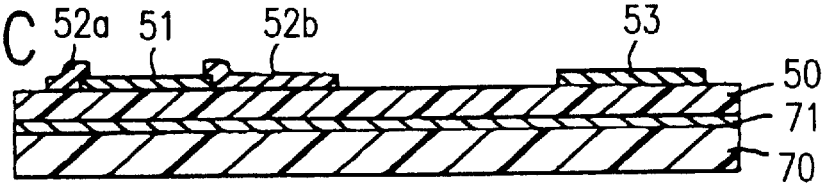

After forming the heat generating layer 51, an Al layer constituting the electrically conductive layers 52*a* and 52*b* and wiring section 53 was formed to have a thickness of 0.7 μm by sputtering, and then the Al layer was etched by wet-etching into a desired pattern to form the electrically conductive layers 52*a* and 52*b* as shown in FIG. 27C. A mixed acidic solution was used as an etchant.

(step B-4) Formation of Protection Layer

Figure 27D:
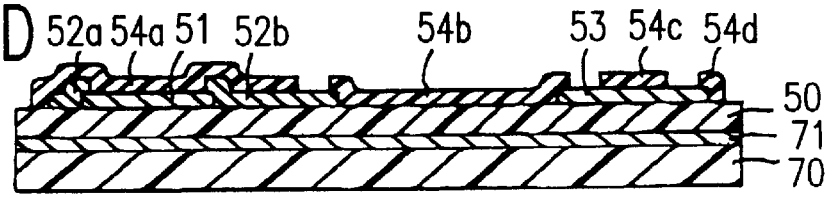

As above mentioned, after forming the electrically conductive layers 52*a* and 52*b* and wiring section 53, a $SiO_2$ layer constituting the protection layer 54*a*–54*d* was formed by plasma CVD. A thickness of the $SiO_2$ layer was 1.0 μm. The thus formed $SiO_2$ layer was processed by RIE to form the protection layers 54*a*–54*d* as shown in FIG. 27D. $CHF_3$ was used as an etchant.

Figure 27E:
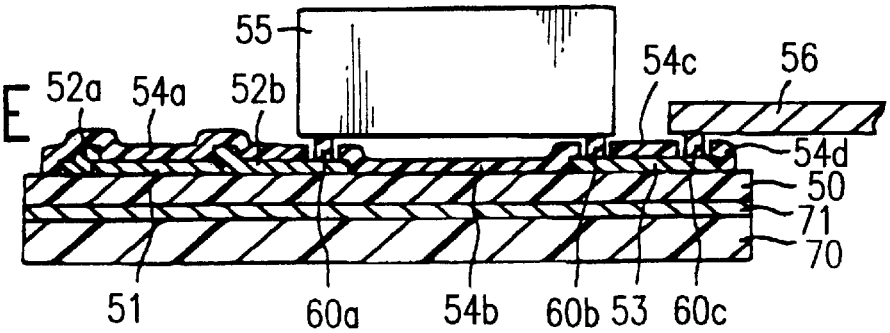

(step B-5) Connection of Wires to driving IC and External Circuit After fanning the protection layers 54*a*–54*d*, the wires 56 for establishing the connection to the driving IC 55 and external circuit were connected as shown in FIG. 27E. The driving IC 55 was herein connected to the electrically conductive layer 52*b* and wiring section 53 through the connecting portions 60*a* and 60*b* by flip chip-bonding using solder-bump. The driving IC 55 had a size of 1 mm×5 mm×0.5 mm. The wires 56 to the external circuit were connected to the wiring section 53 through the connecting portions 60*c* by soldering.

(step D) Reinforcement

Figure 27F:
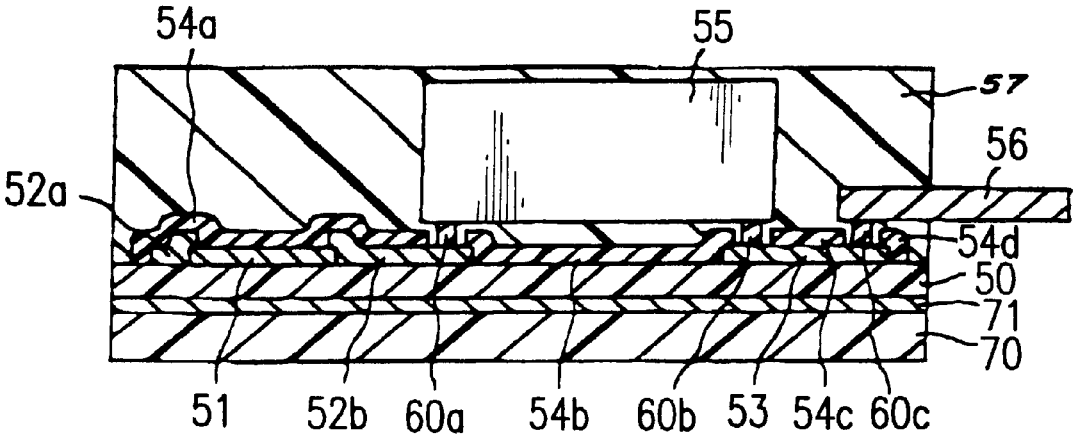

As above mentioned, after connecting the wires 56 for connecting the driving IC 55 and thermal head to the external circuit, respective components were reinforced with the resin 57. Thereafter, an assembly was heated to harden the resin and the components were adhered and united into a single unit body as shown in FIG. 27F. In this embodiment, an epoxy resin containing alumina fillers was used as the resin 57 and a heating temperature was 300° C.

(step E-1) Peeling-off of Substrate by Removal of Sacrificial Layer

In order to separate the thermal head thus formed the substrate as stated above, the MgO layer serving as the sacrificial layer 71 for peeling-off was removed. In this process, wet-etching using a $H_3PO_4$ solution was adopted. By performing the above explained steps, the thermal head shown in FIG. 6 was obtained as shown in FIG. 27G.

[Embodiment 2]

Figure 27G:
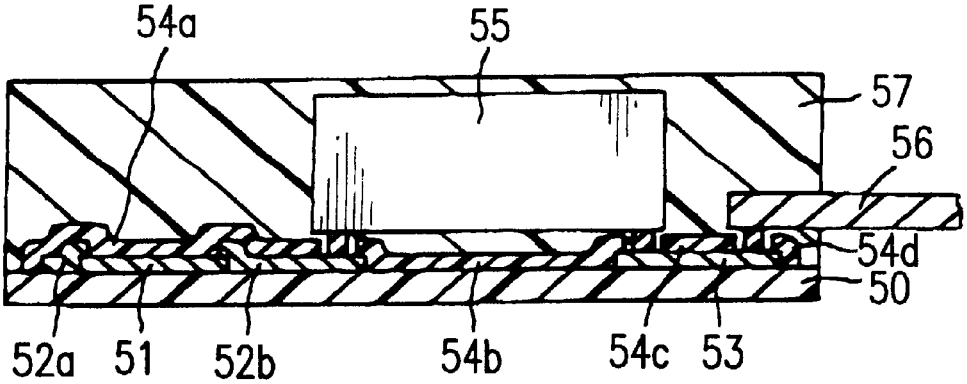
Figure 28A:
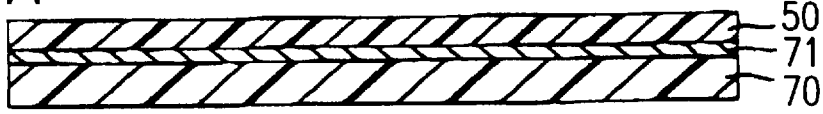
FIGS. 28A–28H are cross sectional views depicting successive steps of the method of manufacturing the thermal head illustrated in FIG. 11.
Figure 28B:
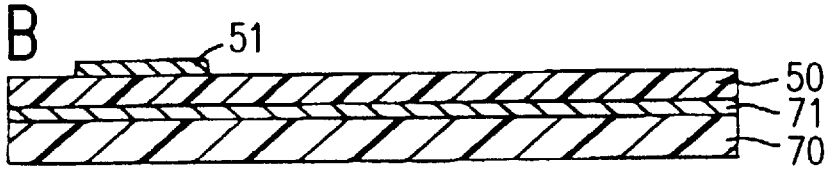
Figure 28C:
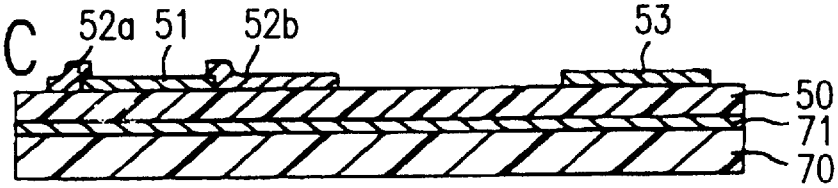
Figure 28D:
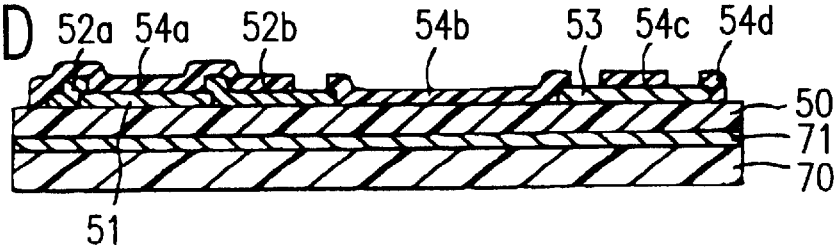
Figure 28E:
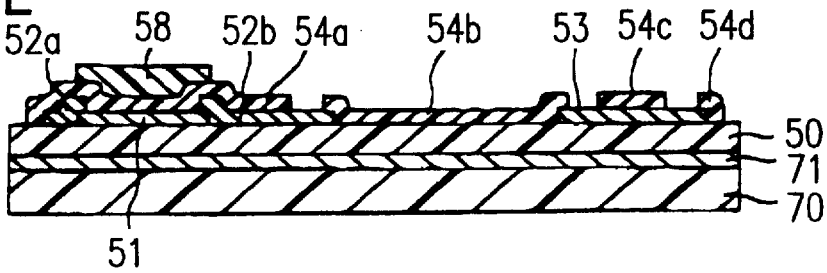

FIGS. 28A–28H show successive steps of manufacturing the thermal head having the flat printing surface and the heat storage layer 58 provided under the printing section P as shown in FIG. 11. The (step A-2). (step B-1). (step B-2), (step B-3) and (step B-4) illustrated in FIGS. 28A–28D were conducted in a similar manner to the embodiment shown in FIG. 27. In the present embodiment, as shown in FIG. 28E, after forming the protection layers 54*a*–54*d*, a mixed polyimide layer constituting the heat storage layer 58 was applied by screen printing. The mixed polyimide layer was formed on the groove formed in the upper surface of the heat generating layer 51 via the protection layer 54*a*. A thickness of the mixed polyimide layer was 20 μm. Thereafter, the mixed polyimide layer was heated and hardened at a temperature of 400° C. to form the heat storage layer 58. The mixed polyimide of this embodiment was the polyimide containing spherical alumina fillers to control a thermal conductivity of the protection layer.

Figure 28F:
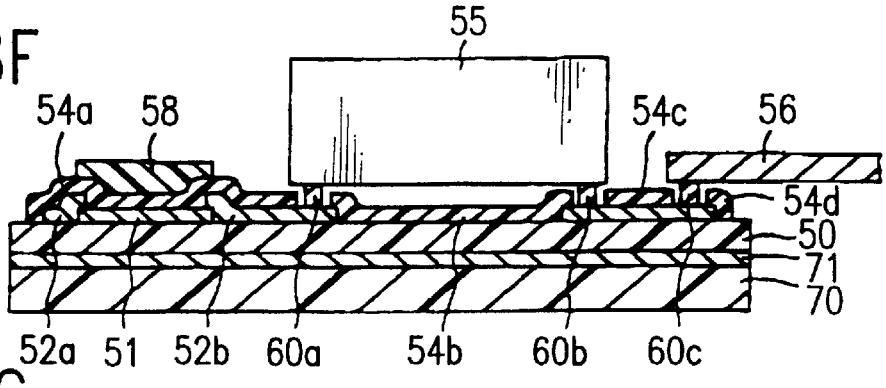
Figure 28G:
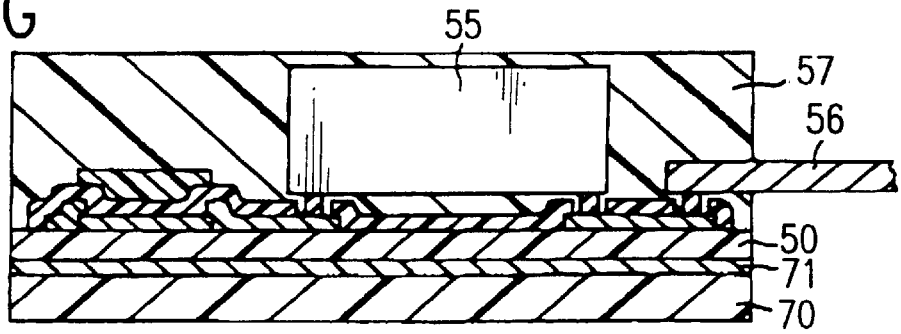
Figure 28H:
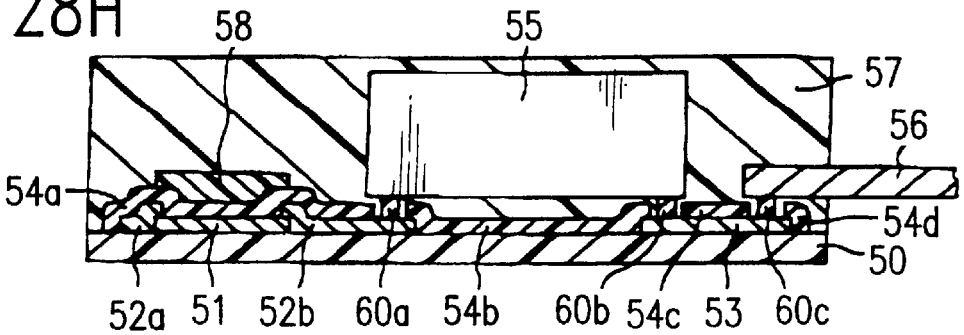

After forming the heat storage layer 58, the (step B-5) shown in FIG. 28F, (step D) in FIG. 28G and (step B-1) illustrated in FIG. 28H were carried out in a similar manner to the steps depicted in FIGS. 27E, 27F and 27G, respectively. By performing the above steps, the thermal head shown in FIG. 11 was obtained.

[Embodiment 3]

FIGS. 29A–29I show successive steps of manufacturing the thermal head having the flat printing surface, heat storage layer 58 and heat dissipating body 68 as shown in FIG. 12.

Figure 29A:
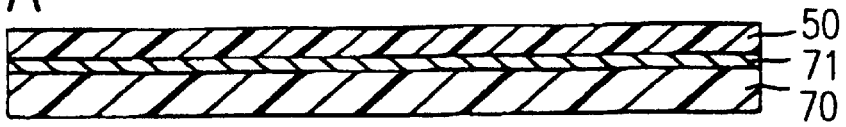
FIGS. 29A–29I are cross sectional views illustrating successive steps of the method of manufacturing the thermal head shown in FIG. 12.
Figure 29B:
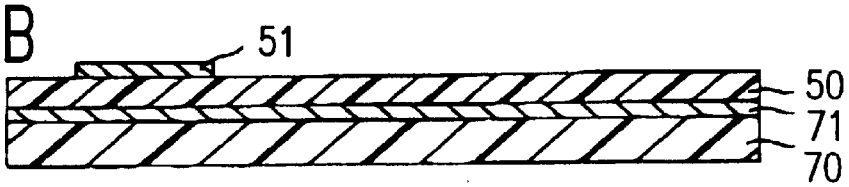
Figure 29C:
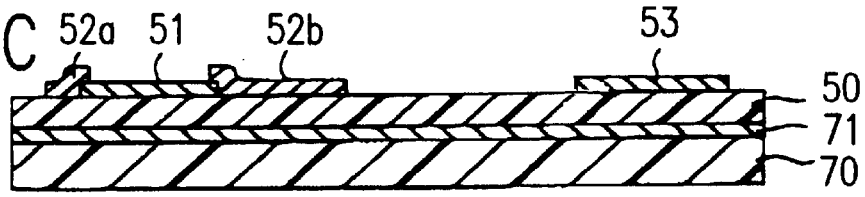
Figure 29D:
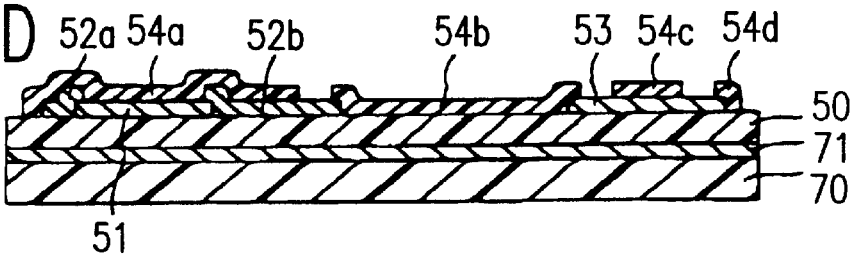
Figure 29E:
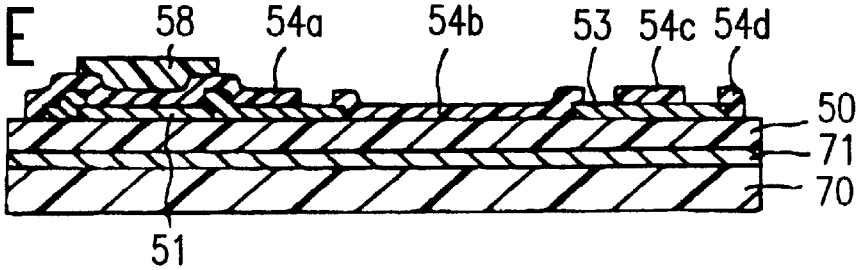
Figure 29F:
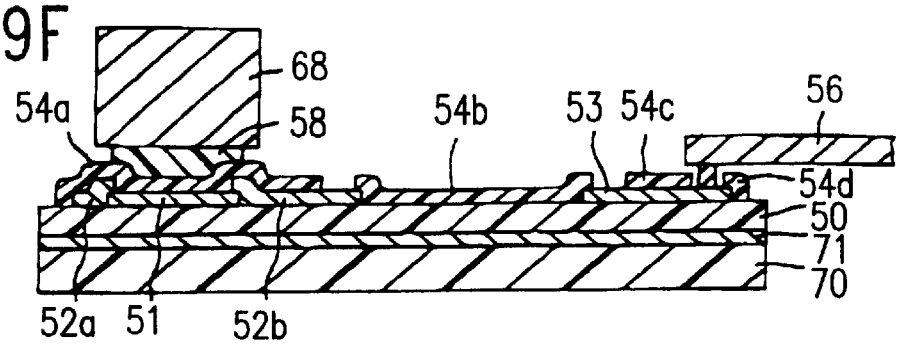

The (step A-2) and (step B-1) shown in FIG. 20A, (step B-2) illustrated in FIG. 29B. (step B-3) depicted in FIG. 29C, (step B-4) shown in FIG. 29D and (step C-1) illustrated in FIG. 29E were conducted in a similar manner to those shown in FIGS. 28A–28E. In the present embodiment, after forming the heat storage layer 58, the heat dissipating body 58 made of aluminum was adhered to the heat storage layer. A width of the heat dissipating body 68 made of Al was 1.0 mm and an epoxy resin adhesive agent was used.

Figure 29G:
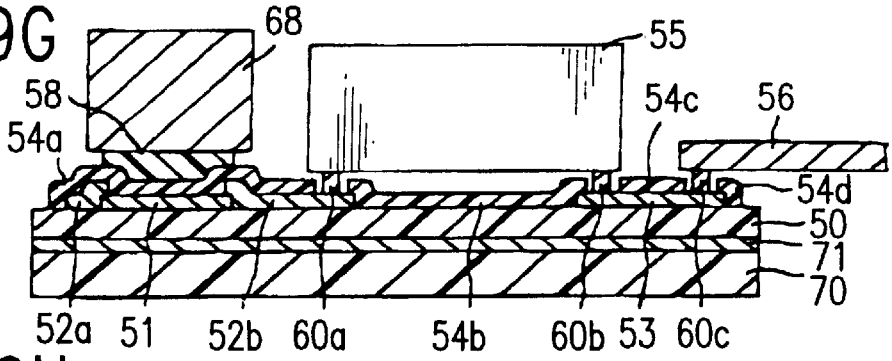
Figure 29H:
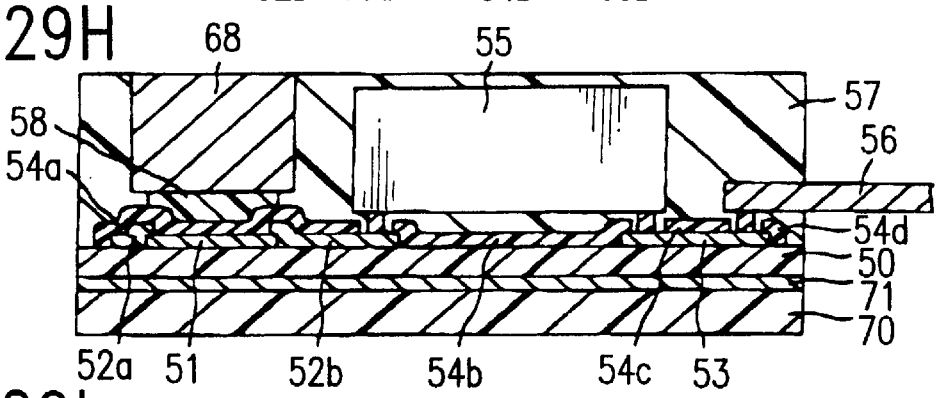
Figure 29I:
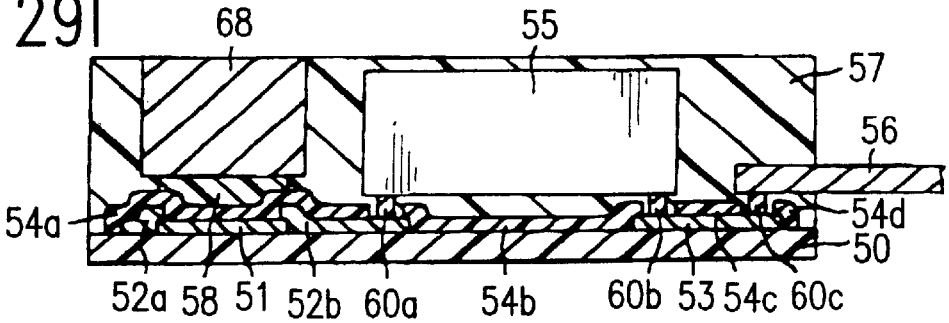

After providing the heat dissipating body 68, the (step B-5) shown in FIG. 29G, (step D) illustrated in FIG. 29H and (step B-1) depicted in FIG. 29I were performed in a similar manner to those shown in FIGS. 28F–28H. However, in the present embodiment, a surface of the heat dissipating body 68 remote from the adhesive layer was exposed from the resin 57. By carrying out the above steps, the thermal head illustrated in FIG. 12 was obtained.

[Embodiment 4]

FIGS. 30A–30H show successive steps of manufacturing the thermal head having the printing surface S protruded outwardly as shown in FIG. 13.

(step A-1) Processing of Substrate

Figure 30A:
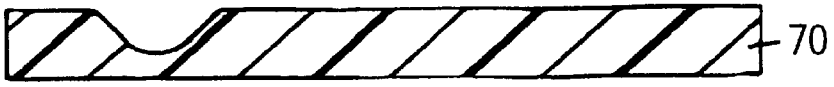
FIGS. 30A–30H are cross sectional views showing successive steps of the method of manufacturing the thermal head of FIG. 13.

As shown in FIG. 30A, the substrate serving as the manufacturing tool was made of a 7059 glass manufactured by Corning Company. On a surface of the substrate, a photoresist pattern was formed by photolithography and a groove having a substantially semicircular lateral cross section was formed by wet-etching. A negative resist was used in the photolithography and HF was used as an etchant. After etching the substrate 70, the photoresist was peeled-off.

Figure 30B:
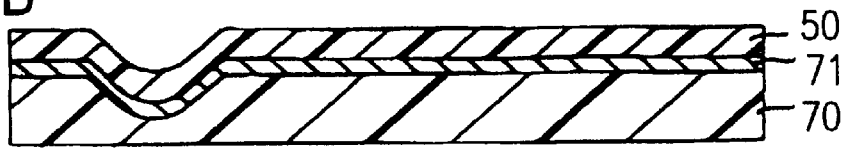
Figure 30C:
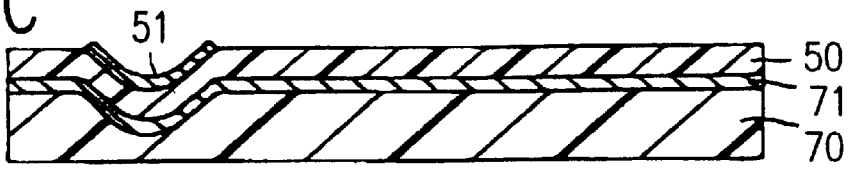
Figure 30D:
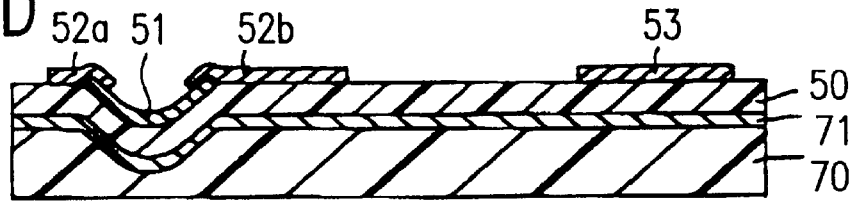
Figure 30E:
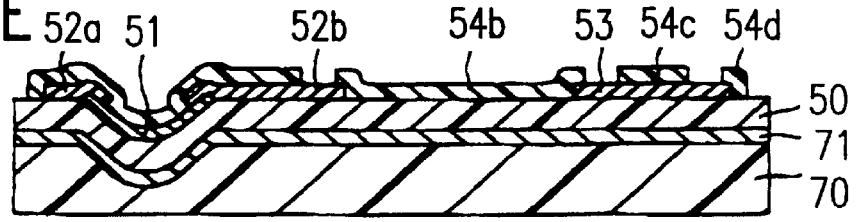
Figure 30F:
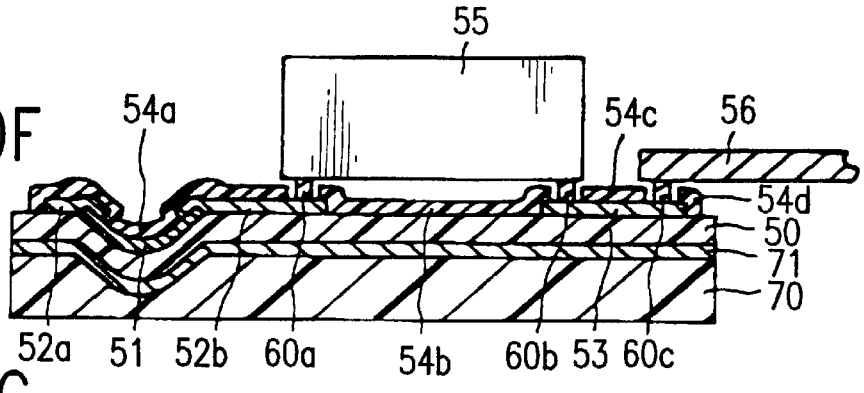
Figure 30G:
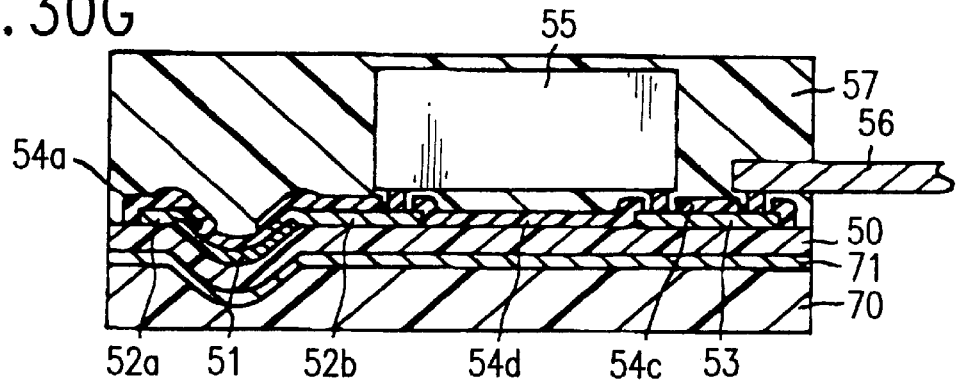
Figure 30H:
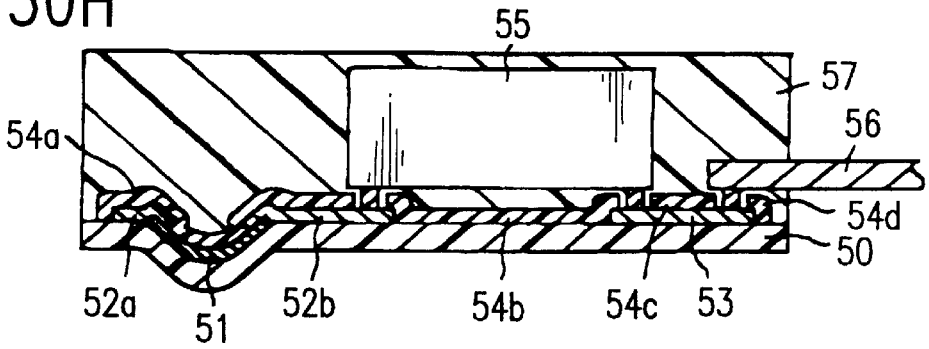

The succeeding processes, that is, the (step A-2) and (step B-1) shown in FIG. 30B, (step B-2) in FIG. 30C, (step B-3) in FIG. 30D, (step B-4) in FIG. 30E, (step B-5) in FIG. 30F, (step D) in FIG. 30G and (step E-1) illustrated in FIG. 30H were conducted in a similar manner to those shown in FIGS. 27A–27G. By carrying out the above steps, the thermal head shown in FIG. 13 was obtained.

[Embodiment 5]

FIGS. 31A–31H show successive steps of manufacturing the thermal head which comprises the outwardly protruded printing surface S as shown in FIG. 14 and includes the beat storage layer 58 provided under the printing section P.

Figure 31A:
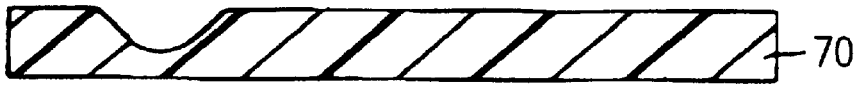
FIGS. 31A–31I are cross sectional views representing successive steps of the method of manufacturing the thermal head shown in FIG. 14.
Figure 31B:
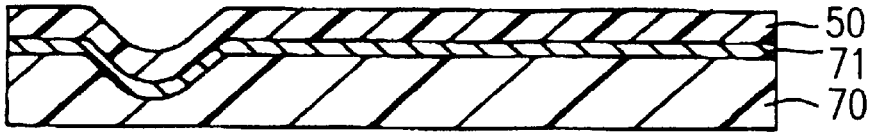
Figure 31C:
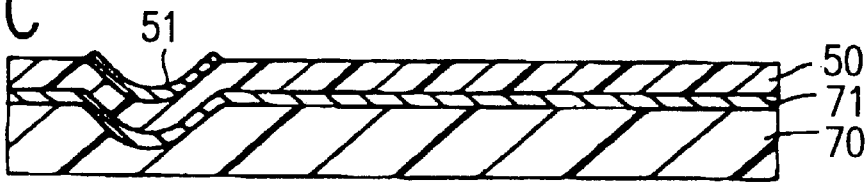
Figure 31D:
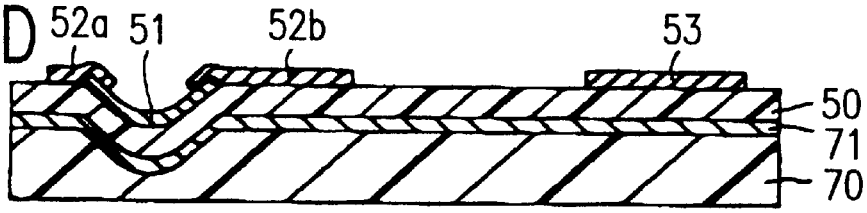
Figure 31E:
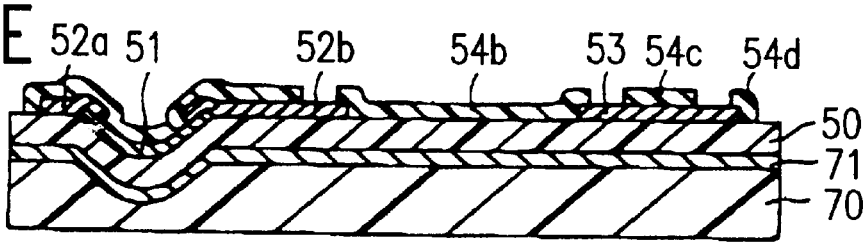
Figure 31F:
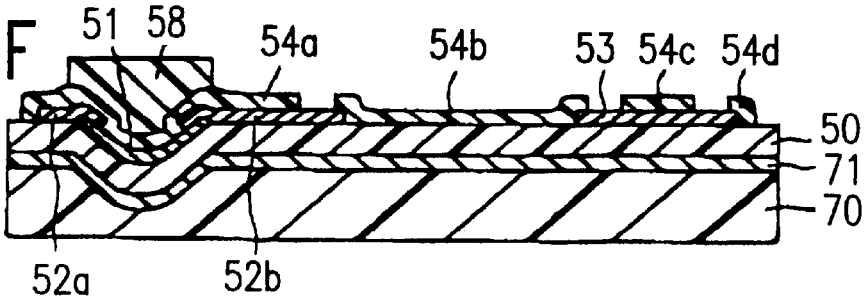
Figure 31G:
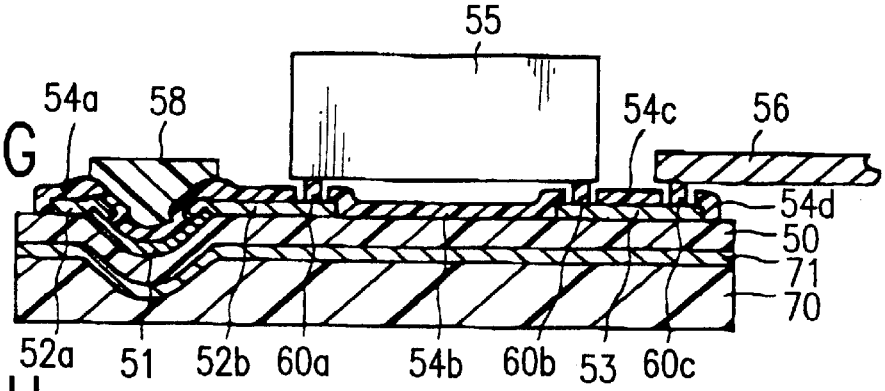
Figure 31H:
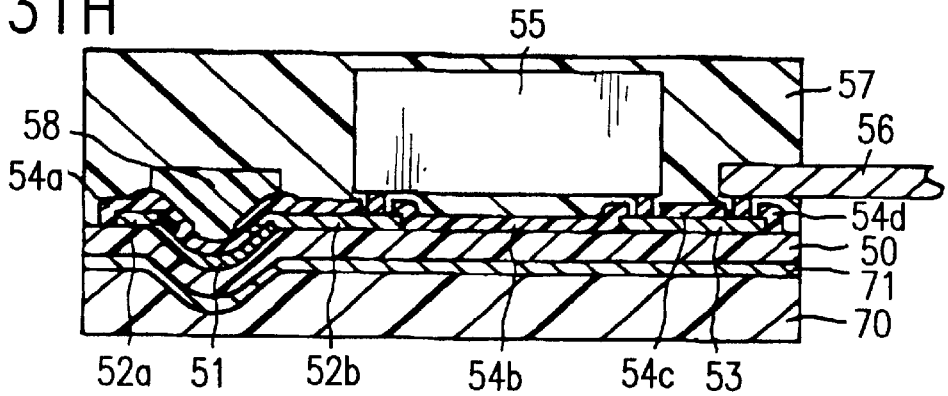
Figure 31I:
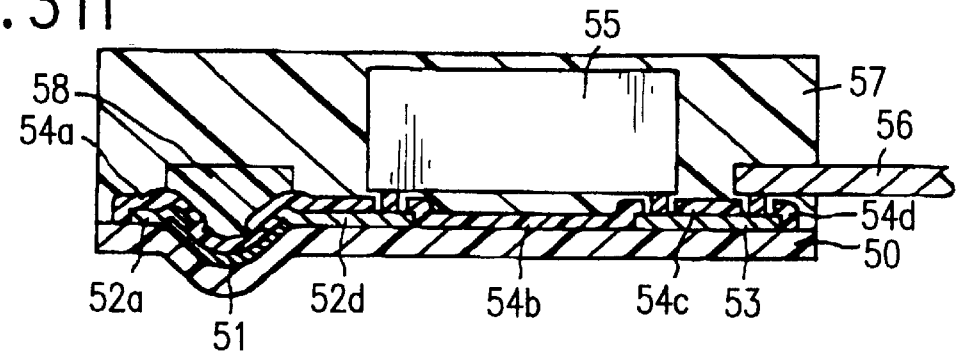

At first, the (step A-1) shown in FIG. 31A was performed in a similar manner to that shown in FIG. 30A. Thereafter, the (step A-2) illustrated in FIG. 31B, (step B-1) in FIG. 31C, (step B-2) in FIG. 31D. (step B-3) in FIG. 31E, (step B-4) and (step C-1) in FIG. 31F, (step B-5) in FIG. 31G, (step D) in FIG. 31H and (step E-1) depicted in FIG. 31I were carried out in a similar manner to those shown in FIGS. 28A–28H. By conducting the above steps, the thermal head shown in FIG. 14 was obtained

[Embodiment 6]

FIGS. 32A–32J show successive steps of manufacturing the thermal head which has the outwardly protruded printing surface S as shown in FIG. 15 and comprises the heat storage layer 58 and heat dissipating body 68 provided under the printing section P.

Figure 32A:
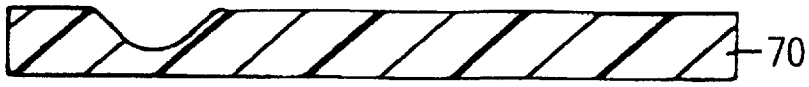
FIGS. 32A–32J are cross sectional views showing successive steps of the method of manufacturing the thermal head depicted in FIG. 15.
Figure 32B:
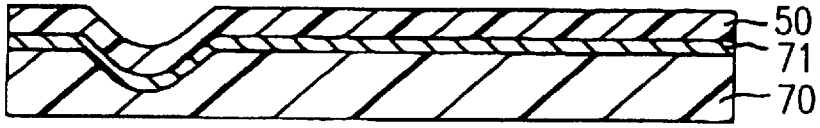
Figure 32C:
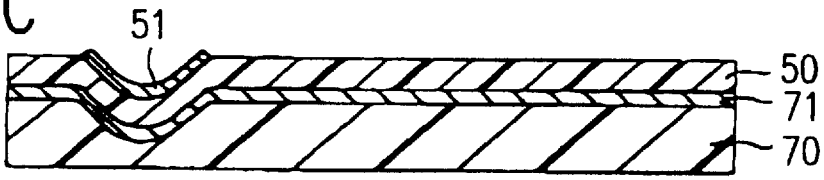
Figure 32D:
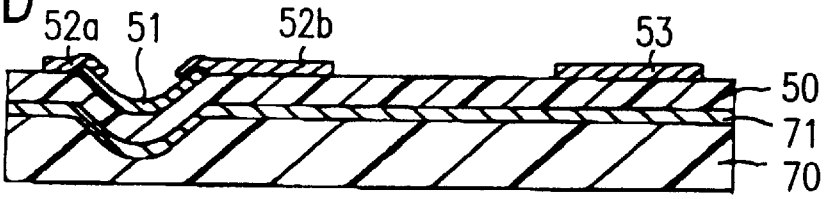
Figure 32E:
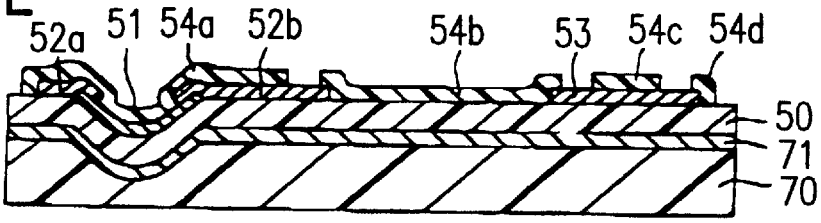
Figure 32F:
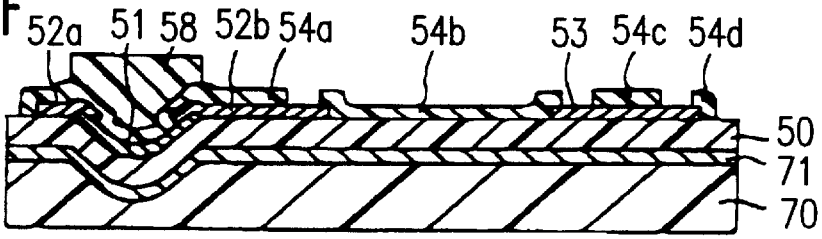
Figure 32G:
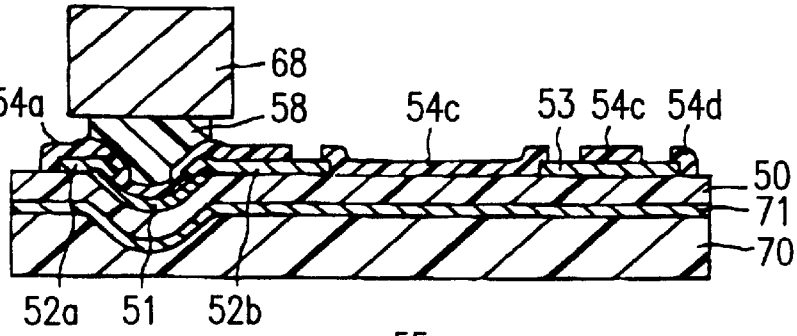
Figure 32H:
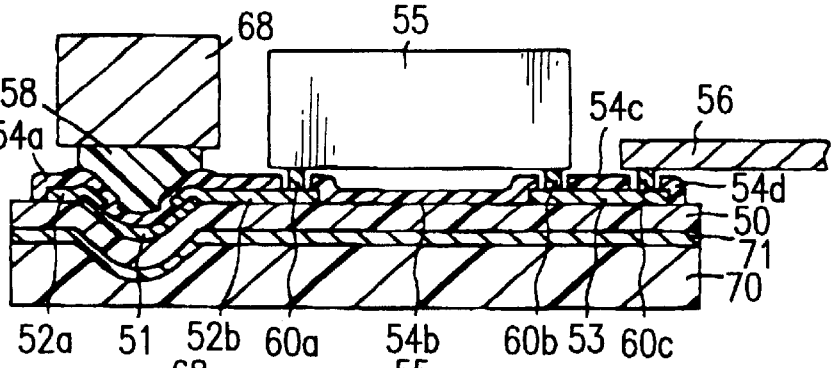
Figure 32I:
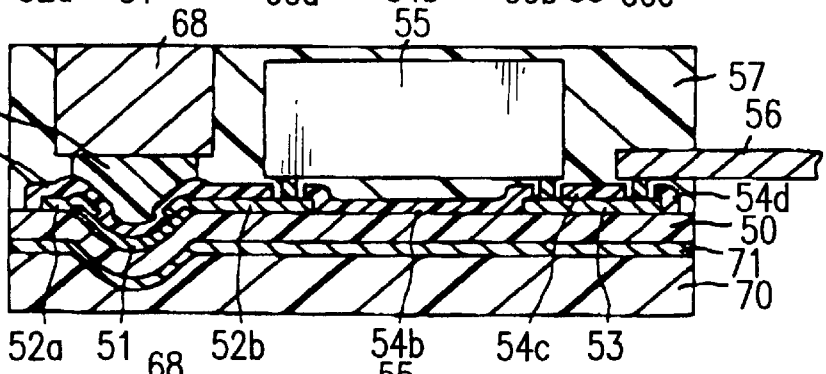
Figure 32J:
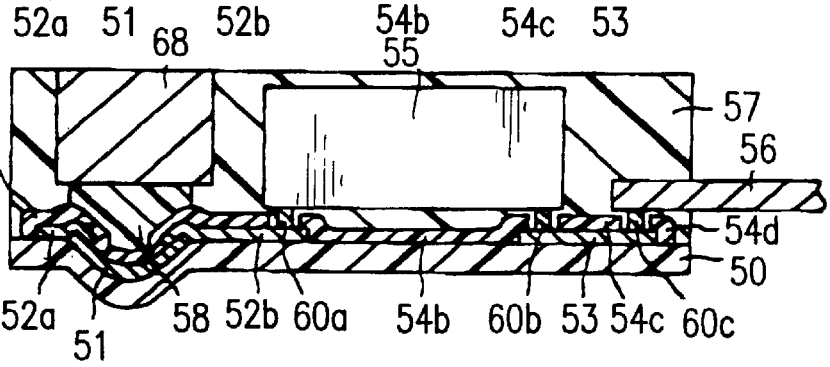

At first, the (step A-1) shown in FIG. 32A, (step A-2) in FIG. 32B, (step B-1) in FIG. 32C, (step B-2) in FIG. 32D, (step B-3) in FIG. 32E and (step B-4) illustrated in FIG. 32F were performed in a similar manner to those depicted in FIGS. 31A–31F. Next, the heat dissipating body 68 was adhered to the heat storage layer 58 as shown in FIG. 32G. This step was performed in a similar manner to that shown in FIG. 29F. Succeeding steps, that is, (step B-5) shown in FIG. 32H, (step D) in FIG. 32I and (step E-1) depicted in FIG. 32J were conducted in a similar manner to those shown in FIGS. 29G–29I. By performing the above steps, the thermal head shown in ig. 15 was obtained.

Figure 33A:
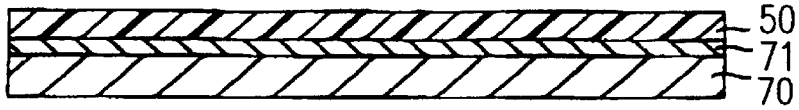
FIGS. 33A–33I are cross sectional views illustrating successive steps of the method of manufacturing the thermal head of FIG. 18.
Figure 33B:
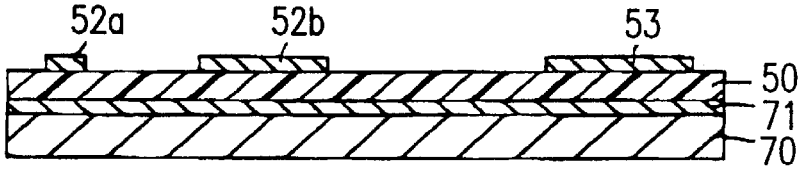

FIGS. 33A–33I represent successive steps of manufacturing the thermal had having tho flat printing surface S and including the heat storage layer 58 and heat dissipating body 68 provided under the printing section P and the electrically conductive layers 52*a* and 52*b* stacked on the heat generating layer 51 of the printing section P as shown in FIG. 18. In this embodiment, the steps shown in FIGS. 29A–29I were carried out except that (step B-3) shown in FIG. 33B and (step B-2) illustrated in FIG. 33C were conducted in a reverse order. That is to say, the (step A-2) and (step B-1) were first performed as shown in FIG. 33A were conducted in a similar manner to that illustrated in FIG. 29A, and then (step B-3) shown in FIG. 33B was carried out in the following manner.

(step B-3) Formation of Electrically Conductive Layer

Figure 33C:
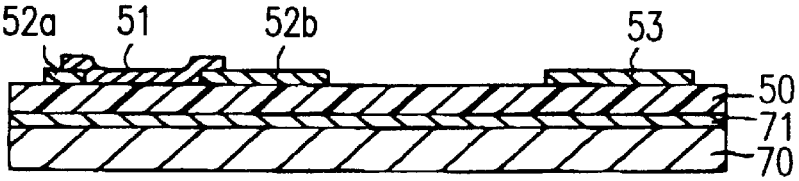
Figure 33D:
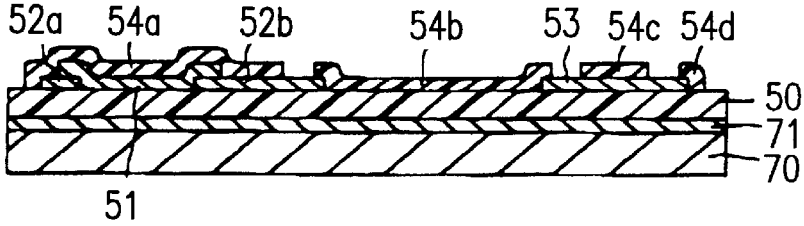
Figure 33E:
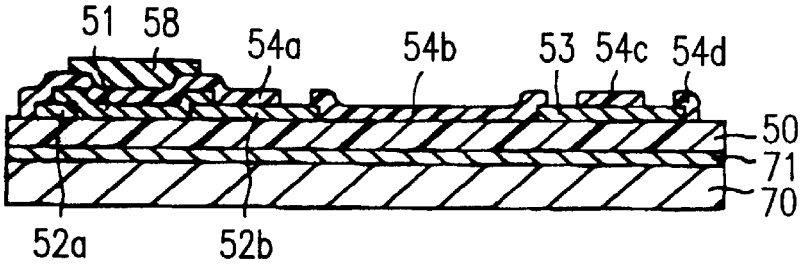
Figure 33F:
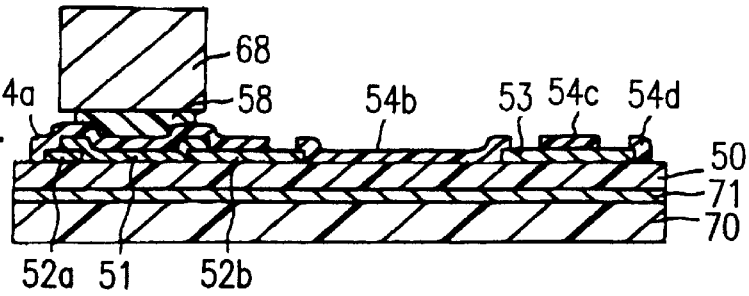
Figure 33G:
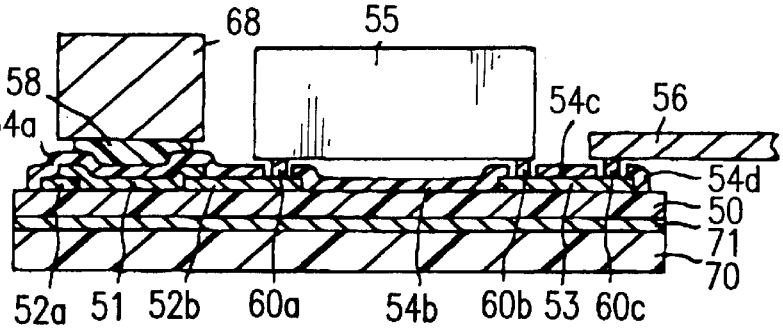
Figure 33H:
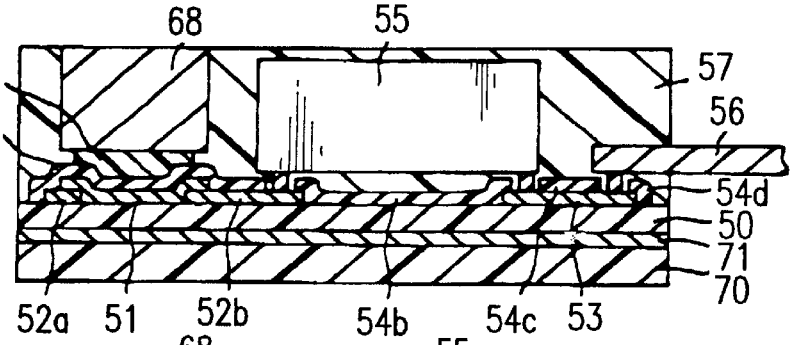
Figure 33I:
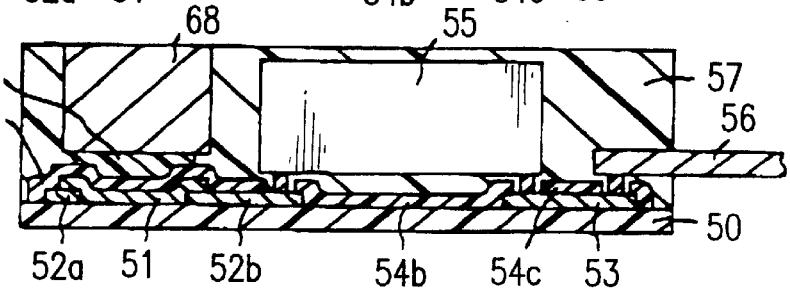

As shown in FIG. 33A, after forming the wear-resistant layer 50, the W layer constituting the electrically conductive layers 52*a* and 52*b* was formed by sputtering. A thickness of the W layer was 0.3 μm. Thereafter, the thus formed W layer was wet-etched in accordance with a desired pattern to form the electrically conductive layers 52*a* and 52*b* and wiring section 53. $HNO_3$ was used as an etchant. Next, as shown in FIG. 33C, the step B-2 was performed in a similar manner to that shown in FIG. 29B. Succeeding steps, that is, (step B-4) shown in FIG. 33D. (step C-1) in FIG. 33E, (step C-2) in FIG. 33F, (step B-5) in FIG. 33G, (step D) in FIG. 33H and (step E-1) illustrated in FIG. 331 were carried out in a similar manner to those depicted in FIGS. 29D–29I. By conducting the above steps, the thermal head shown in FIG. 18 was obtained.

[Embodiment 8]

Figure 21:
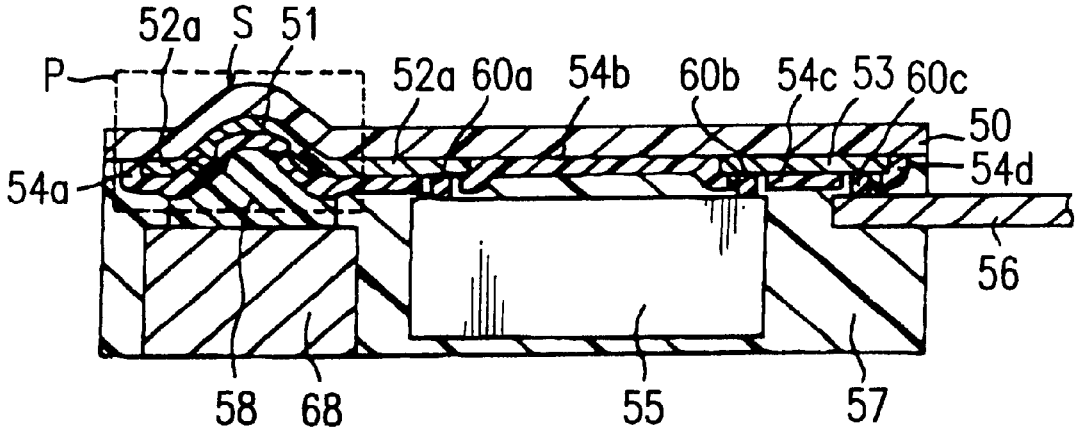
FIG. 21 is a cross sectional view illustrating another embodiment of the thermal head having the second principal structure according to the invention.
Figure 34A:
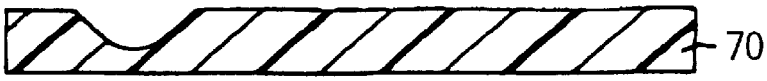
FIGS. 34A–34J are cross sectional views showing successive steps of the method of manufacturing the thermal head shown in FIG. 21.
Figure 34B:
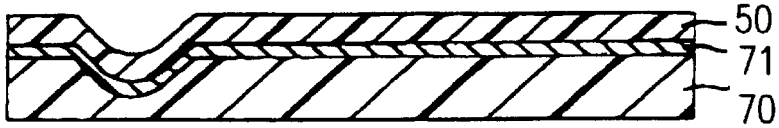
Figure 34C:
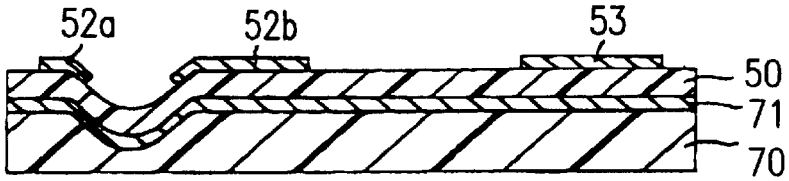
Figure 34D:
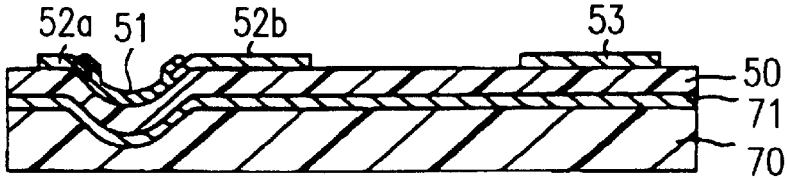
Figure 34E:
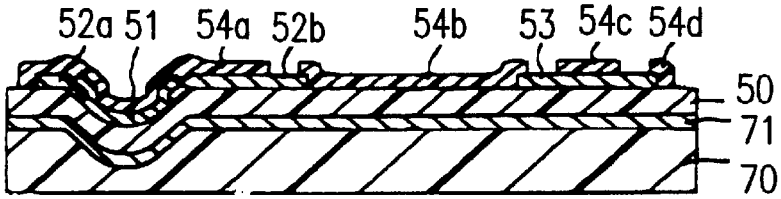
Figure 34F:
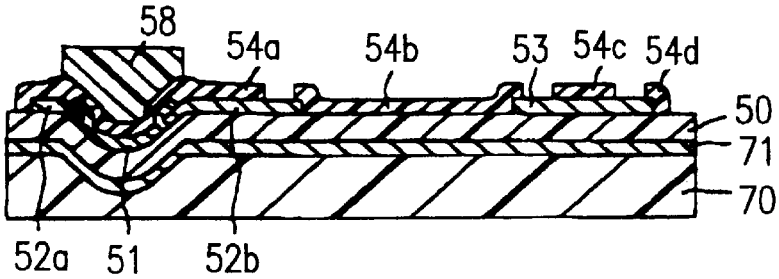
Figure 34G:
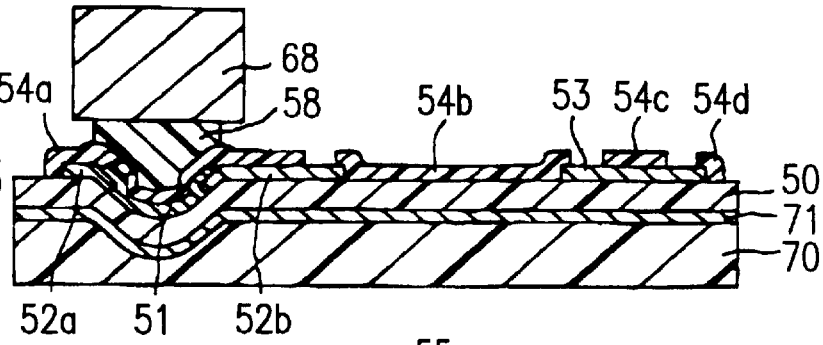
Figure 34H:
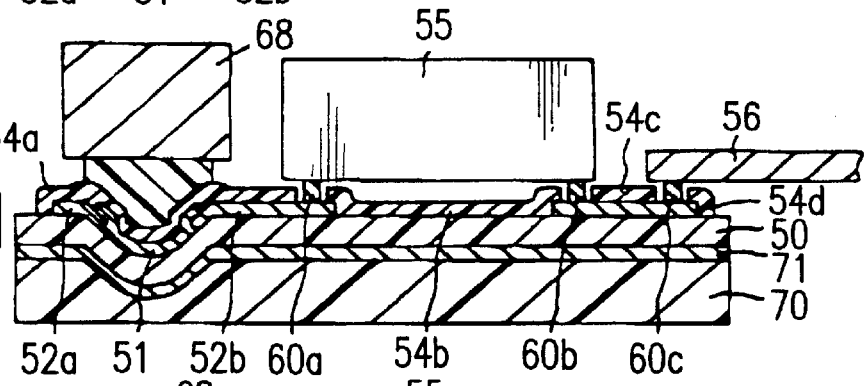
Figure 34I:
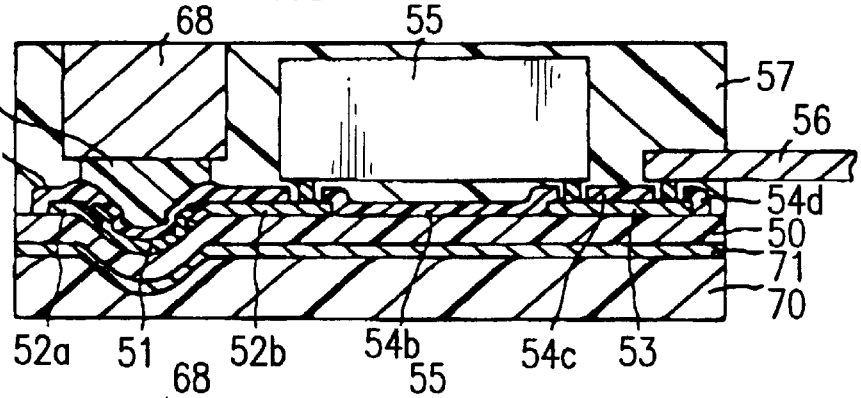
Figure 34J:
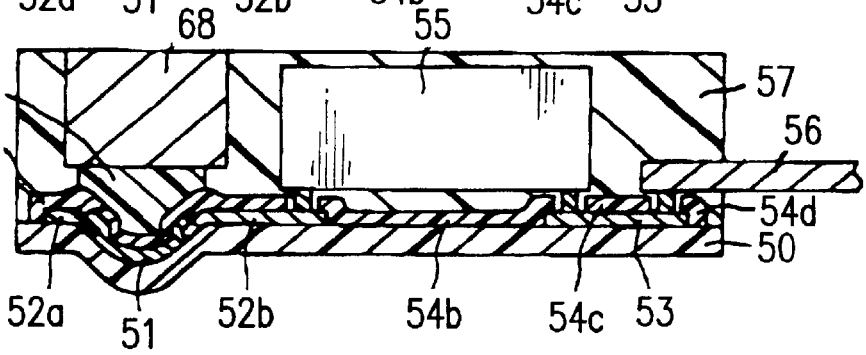

FIGS. 34A–34J show successive steps of manufacturing the thermal head having the protruded printing surface S and including the heat storage layer 58 and heat dissipating body 68 provided under the printing section P and the electrically conductive layers 52*a* and 52*b* stacked on the heat generating layer 51 of the printing section P as illustrated in FIG. 21. In this embodiment, as shown in FIG. 34A, after forming the groove having a substantially semicircular cross section in the surface of the substrate as shown in FIG. 34A, steps shown in FIGS. 34B–341 were carried out in a similar manner to those illustrated in FIGS. 33A–33I. By conducting the above mentioned steps, the thermal head shown in FIG. 21 was obtained.

Figure 20:
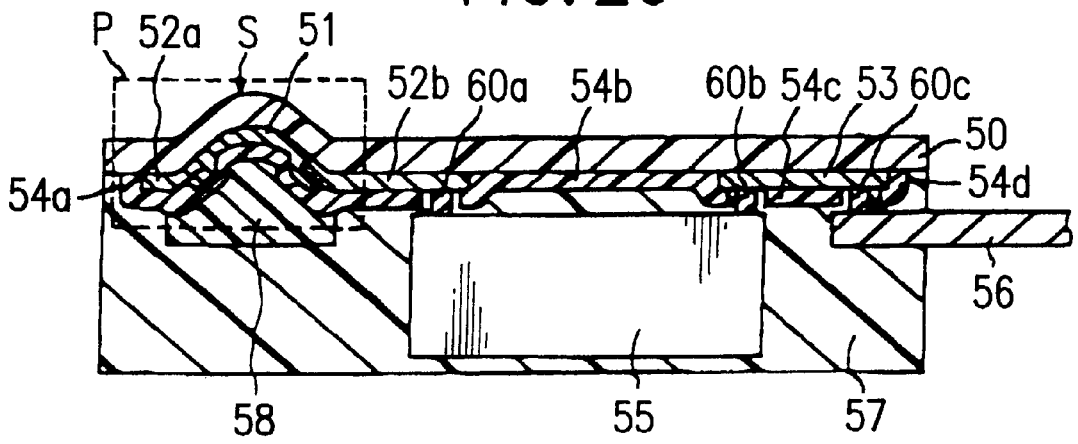
FIG. 20 is a cross sectional view depicting another embodiment of the thermal head having the second principal structure according to the invention.

In the above explained embodiments 1–8, the methods of manufacturing the thermal head having the second principal structure according to the invention are shown. It should be noted that the thermal head with the second principal structure, but without the heat dissipating body 68 as shown in FIGS. 17 and 20 and the thermal head with the second principal structure, but without the heat storage layer 58 and heat dissipating body 68 as shown in FIGS. 16 and 19 may be manufactured by conducting steps similar to those of the above embodiments.

Moreover in the above embodiments, the sacrificial layer 71 for peeling-off was used in separating the thermal head from the substrate 70, but according to this invention, the etching may be also used in removing the substrate 70. In this case, since the wear-resistant layer acts as an etching stopper, the etching can be carried out easily. For example, in respective embodiments explained above, after forming the thermal head, the substrate 70 may be removed by performing the etching with HF. The thermal head was separated from the substrate 70 by such a process. In this case, it is preferable to make the substrate of a borosilicate glass without Ba which can be easily etched with HF, i.e. a low-alkaline glass or non-alkaline glass manufactured by Nihon Electric Glass Company.

[Embodiment 9]

Figure 35A:
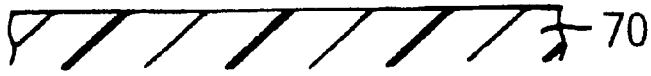
FIGS. 35A–35F are cross sectional views depicting successive steps of another embodiment of the method of manufacturing the thermal head according to the invention.
Figure 35B:
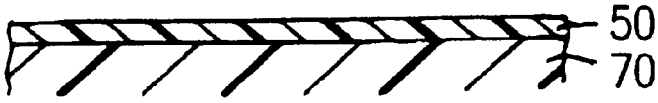
Figure 35C:
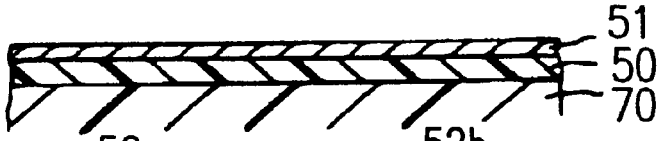
Figure 35D:
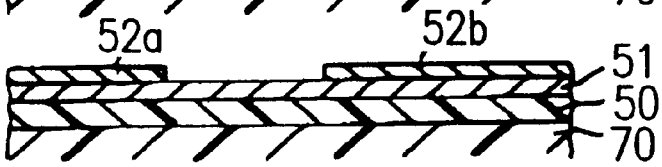
Figure 35E:
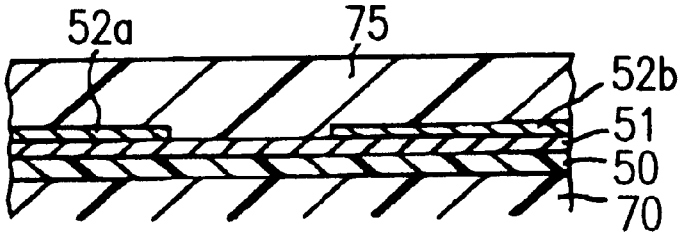
Figure 35F:
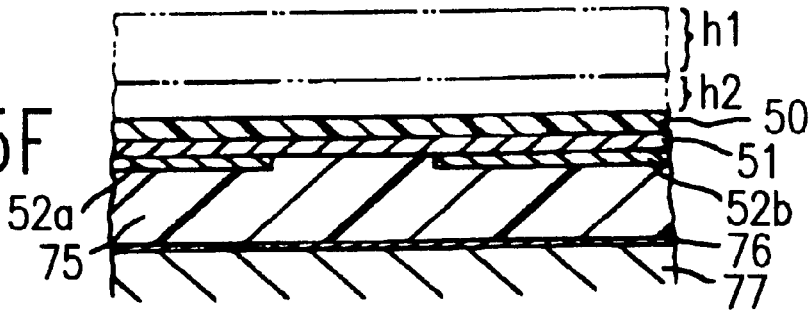

FIGS. 35A–35F show successive steps of another embodiment of the method of manufacturing the thermal head according to the invention. As shown in FIG. 35, the substrate 70 made of a borosilicate glass was prepared, on which the wear-resistant layer 50 consisting of SiB layer and SiON layer was formed as shown in FIG. 35B, and then the beat storage layer 51 made of $NbSiO_2$ was formed. Next, as shown in FIG. 35D, the electrically conductive layers 52*a* and 52*b* made of aluminum were formed on the heat generating layer 51, and a supporting layer 75 made of polyimide resin, acrylic resin or glass having a low melting point was formed as shown in FIG. 35E. Thereafter, a part of the substrate 70 was removed over a depth of h1 by mechanical grinding using a whetstone, and the remaining portion of the substrate was removed over a depth of h2 by wet-etching. As mentioned above, by removing the substrate 70 by mechanical grinding, the substrate 70 can be efficiently removed. Moreover, by constructing the printing section as a separate component which is independent from the driving IC 55, the printing section may be attached to another structural member 77 with an adhesive layer 76. Then, a degree of freedom in arrangement can be improved.

[Embodiment 10]

Figure 36A:
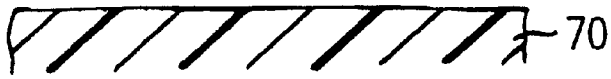
FIGS. 36A–36H are cross sectional views showing successive steps of another embodiment of the method of manufacturing the thermal head according to the invention.
Figure 36B:
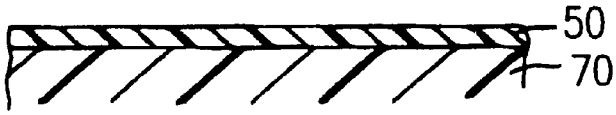
Figure 36C:
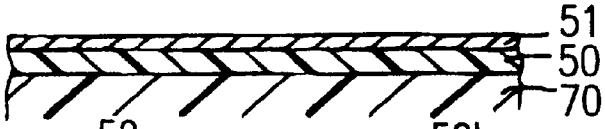
Figure 36D:
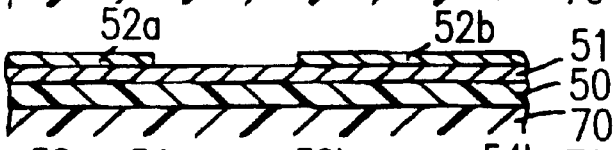
Figure 36E:
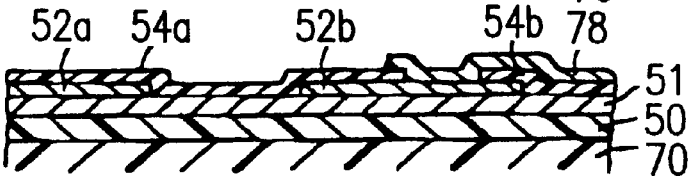
Figure 36F:
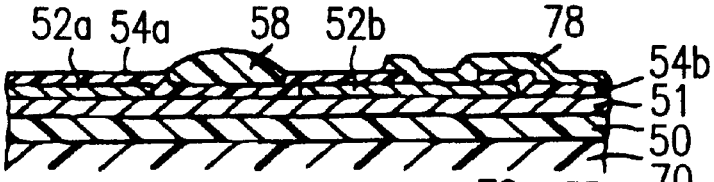
Figure 36G:
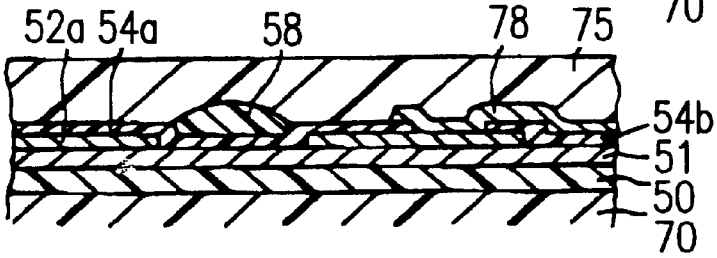
Figure 36H:
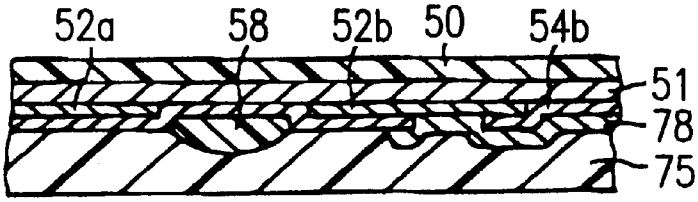

FIGS. 36A–36H are cross sectional views showing successive steps of another embodiment of the method of manufacturing the thermal head according to the present invention. In this embodiment, steps shown in FIGS. 36A–36D are similar to those illustrated in FIGS. 35A–35D in the previous embodiment 9. In the present embodiment, thereafter, as shown in FIG. 36E, the protection layers 54*a* and 54*b* were formed and another electrically conductive layer 78 was formed such that it is contacted with the extended part of the electrically conductive layer 52*b*, and after the beat storage layer 58 was formed on the protection layer 54*a* of the printing secction as shown in FIG. 36F, a polyimide resin constituting the supporting layer 75 was formed illustrated in FIG. 36G, and then the substrate 70 was removed by grinding and etching as depicted in FIG. 36H. According to the present invention, the electrically conductive layer 78 for connecting the electrically conductive layer 52*b* of the printing section to an external circuit may be separately formed from the electrically conductive layers 52*a* and 52*b*. The electrically conductive layer 78 may be connected to the driving IC on a side of the wear-resistant layer 50 which is opposite to the printing surface S or same as the printing surface S.

[Embodiment 11]

Figure 37A:
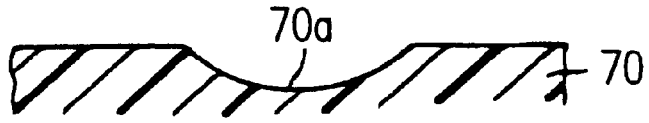
FIGS. 37A–37G are cross sectional views illustrating successive steps of another embodiment of the method of manufacturing the thermal head according to this invention.
Figure 37B:
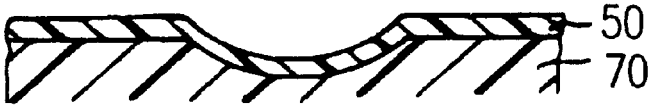
Figure 37C:
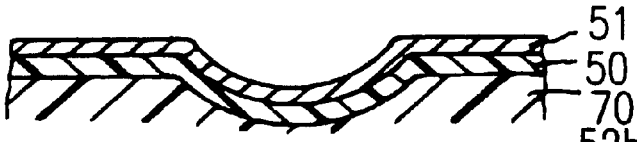
Figure 37D:
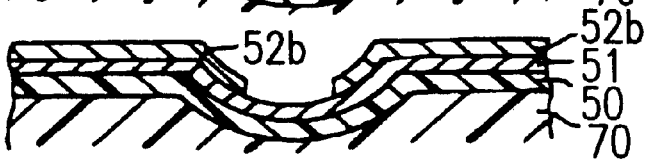
Figure 37E:
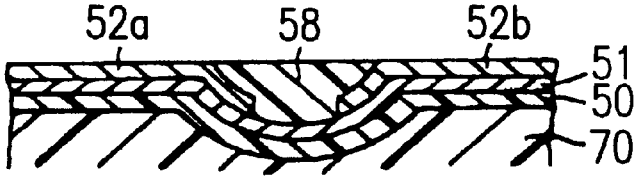
Figure 37F:
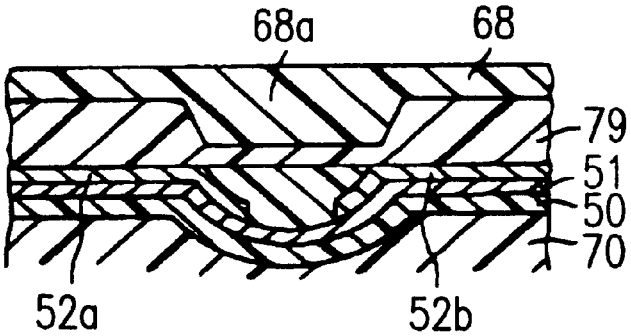
Figure 37G:
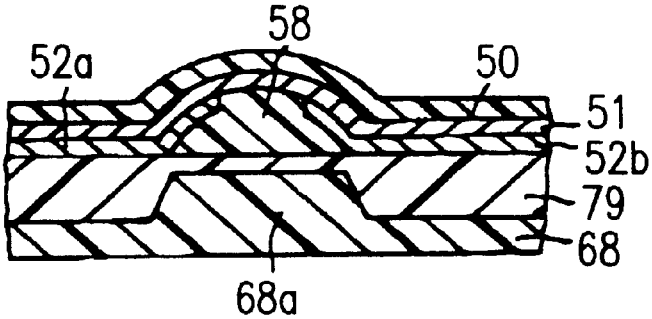

FIGS. 37A–37G show another embodiment of the method of manufacturing the thermal head according to the invention. In this embodiment, the groove 70 a was formed in the surface of the substrate 70 as shown in FIG. 37A, and then the wear-resistant layer 10 was formed on the substrate 70 including the groove surface as illustrated in FIG. 37A. Then, the heat generating layer 51 was formed as shown in FIG. 37C, and after forming the electrically conductive layers 52*a* and 52*b* as shown in FIG. 37D, the heat storage layer 58 was formed to cover the heat generating layer 51 and electrically conductive layers 52*a* and 52*b* along the groove 70*a* and the leveling (uniformity in a thickness) was done by utilizing the liquidity of the heat storage layer as shown in FIG. 37E. Then, the heat dissipating body 68 made of aluminum was adhered with the adhesive 79 as shown in FIG. 37F. In this embodiment, by facing a projected portion 68 a of the heat dissipating body 68 to the heat storage layer 58, a distance therebetween can be shortened and an efficiency of heat dissipation was improved.

Thereafter, the substrate 70 was removed only by the wet-etching or by a combination of mechanical grinding and wet-etching In this embodiment, a uniform thickness of the heat storage layer 58 can be attained.

[Embodiment 12]

Now an embodiment of the method of manufacturing the thermal head having the third principal structure shown in FIG. 7 will be explained. In the third principal structure, the printing section P, driving IC 55 and wiring section 53 are reinforced by means of the heat dissipating member 59.

Figure 38A:
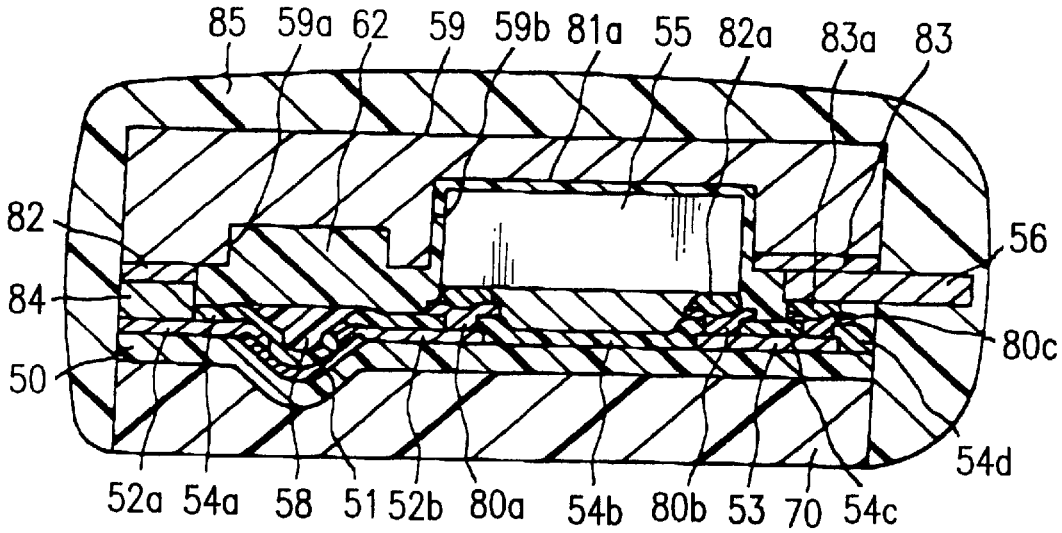
FIGS. 38A and 39B are cross sectional views showing successive steps of another embodiment of the method of manufacturing the thermal head according to the present invention.
Figure 38B:
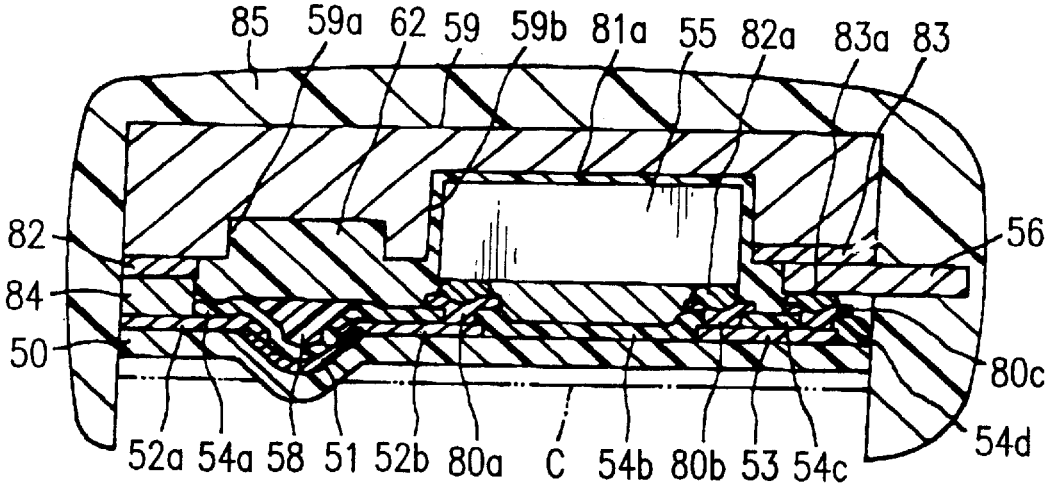

FIGS. 38A and 38B are cross sectional views showing steps near the final step of this embodiment. In the present embodiment, after the wear-resistant layer 50, heat generating layer 51, electrically conductive layers 52*a* and 52*b*, protection layers 54*a*, 54*b*, 54*c* and 54*d* and heat storage layer 58 having a low melting point were formed in succession, the driving IC 55 and the wires 56 were provided. In order to establish the electrical connections between the electrically conductive layer 52*b* and the driving IC 55, between the driving IC and the wiring section 54, and between the wiring section and the wires 56, metalized layers 80*a*, 80*b* and 80*c* were formed on the electrically conductive layer 52*b* and wires 56, and the flip chip-bonding was done with solder-bumps 81*a*, 81*b*and 81*c*. The step of forming the metalized layers 80*a*–80*c* is a step of forming metal layers on the electrically conductive layer 52*b* and wires 53, said metal layers reacting with the solder bumps 81*a*–81*c* to form good electrical connections. In the present embodiment, after depositing Ti, Cu, Ni and Au in this order on the electrically conductive layer 52*b* and wiring section 53 made of aluminum, the stacked layers were patterned by wet-etching. A reference numeral 84 denotes a common electrode which is connected to the electrically conductive layer 52*a* formed commonly to plural heat generating elements constituting the heat generating section.

Next, the common electrode 84 and wires 56 formed beside the printing section P were secured to the inner surface of the heat dissipating member 59 made of aluminum by means of both-sided adhesive tapes 82 and 83, and spaces formed between the printing section P, driving IC 55 and wiring section 53 were filled with a silicone resin 62 such that these components were reinforced. In an inner surface of the beat dissipating member 59, there were formed a groove 59*a* at a position opposing to the heat storage layer 58 of the printing section P as well as a recessed part 59*b* into which a part of the driving IC 55 was projected. In this manner, the driving IC 55 is covered with the heat dissipating member 59 and is not exposed.

In this embodiment, the common electrode 84 and wires 56 are simply secured to the heat dissipating member 59 by means of the both-sided adhesive tapes 82 and 83, and therefore they can be constructed by an automatic machine. According to the present invention, an adhesive agent may be used as the fixing member instead of the both-sided adhesive tapes 82 and 83. Since the heat storage layer 58 of the printing section P is connected to the heat dissipating member 59 by means of the resin 62 having a good thermal conductivity, a heat dissipating property of the printing section P is improved.

By completely filling the holes formed in the protection layers 54*a*–54*d* with the metalized layers 80*a*–80*c* constituting the electric connections such that the electrically conductive layers 52*a* and 52*b* and wiring section 53 are not exposed at all, the electrically conductive layers and wiring section can be prevented from be degraded in accordance with a composition of resin when the electrically conductive layers and wiring section are heated to a high temperature by flowing a current through the resin 62 which is brought into contact with the electrically conductive layers and wiring section. Moreover, by covering the driving IC 55, electrically conductive layer 52*b* and wiring section 53 with the protection layers 54*a*–54*d* except for the connecting parts between the driving IC 55 and the electrically conductive layer 52*b* and wiring section 53, a short-circuit between the driving IC and the remaining components can be prevented.

After-forming the heat dissipating member 59 as shown in FIG. 38A, but prior to the separation of the thermal head from the substrate by etching, the whole thermal head except for the substrate 70 was covered with an etching resist 85. The etching resist 85 may be made of resists manufactured and sold by Nikka Seiko Company under trade names of "Black Mask" and "Protect Wax". After the thermal head was covered with the etching resist 85, the etching resist was removed by using xylene as a solvent as shown in FIG. 38B. In this manner, the thermal head portion is molded with the resin 62 not wholly but partially, and after covering the thermal head portion with the etching resist 85, the substrate 70 is removed. Therefore, undesired bend of the thermal head due to a stress caused by a shrinkage of the resin mold and undesired breakage of the thermal head due to a soak of the etchant can be prevented. It should be noted that during the step of removing the substrate 70, the substrate is not removed wholly, but a part of the substrate is remained as shown by a two-dot chain line in FIG. 38B, a mechanical strength of the thermal head can be improved.

Now several embodiments of the method of manufacturing the thermal head having the fourth principal structure according to the invention shown in FIG. 7 will be explained. In this fourth principal structure, the reinforcement of the thermal head can be attained by supporting the printing section P, driving IC 55 and wiring section 53 by the flat plate 59.

[Embodiment 13]

Figure 39A:
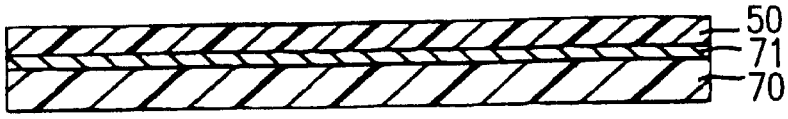

FIGS. 39A–39H are cross sectional views showing successive steps of manufacturing the thermal head shown in FIG. 7. (step A-2) Formation of Sacrificial Layer for Peeling-off As shown in FIG. 39A, the sacrificial layer 71 made of MgO was formed by sputtering on the substrate 70 made of the 7059 glass manufactured by Corning Company, which serves as the tool for manufacture. A thickness of the MgO layer was, herein, 2 $\mu$m.

(step B-1) Formation of Wear-resistant Layer

Figure 39B:
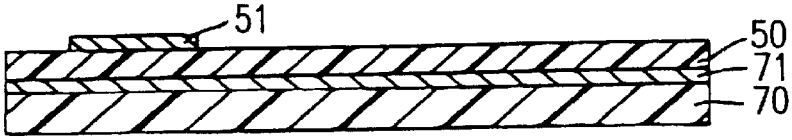

Next a SiB layer and a SiON layer constituting the wear-resistant layer 50 were formed successively by plasma CVD. The SiB layer and the SiON layer were formed to have a thickness of 7 $\mu$m and 3 $\mu$m, respectively (step B-2) Formation of Heat Generating Layer Next, as shown in FIG. 39B, a $NbSiO_2$ layer constituting the heat generating layer 51 was formed on the wear-resistant layer 50 by sputtering. A thickness of this $NbSiO_2$ layer was 0.2 $\mu$m. Then, the thus formed $NbSiO_2$ layer was dry-etched by RIE to form the heat generating layer 51 of the printing section. Upon etching, $CHF_3$ was used as an etchant.

(step B-3) Formation of Electrically Conductive Layer

Figure 39C:
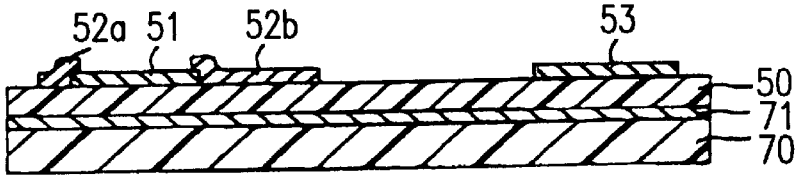
Figure 39D:
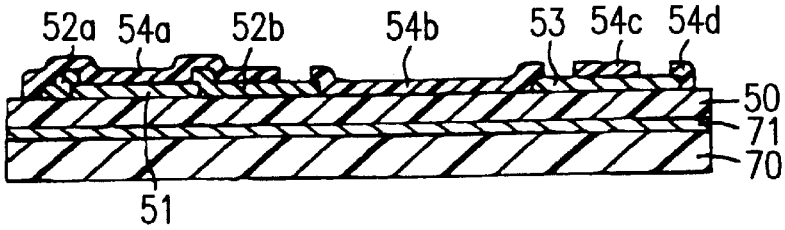

After forming the heat generating layer 51, an aluminum layer constituting the electrically conductive layers 52*a* and 52*b* and wiring section 53 was farmed by sputtering. A thickness of the aluminum layer was 0.3 $\mu$m. Then, the thus formed aluminum layer was wet-etched to form the electrically conductive layers 52*a* and 52*b* and wiring section 53 as shown in FIG. 39C. In this etching, a mixed acidic solution was used as an etchant.

(step B-4) Formation of Protection Layer

As above mentioned, after forming the electrically conductive layers 52*a* and 52*b*, a $SiO_2$ layer constituting the protection layer was formed by plasma CVD. A thickness of the $SiO_2$ layer was 0.6 $\mu$m. Then, the $SiO_2$ layer was wet-etched to form the protection layers 54*a*, 54*b*, 54*c*, and 54*d*. In this etching, HF was used as an etchant.

(step C) Formation of Heat Storage Layer

Figure 39E:
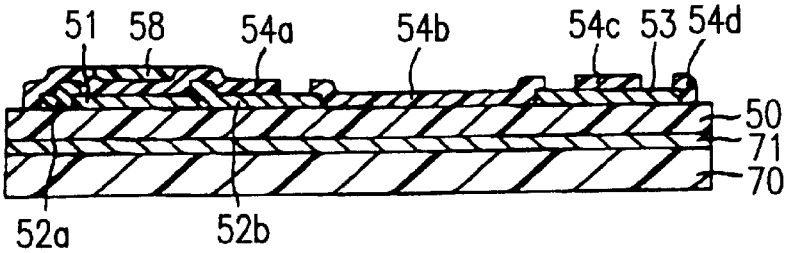
Figure 39F:
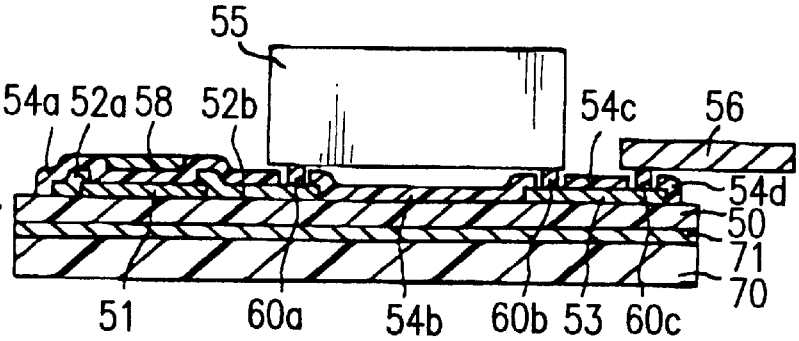

After forming the protection layers 54*a*, 54*b*, 54*c* and 54*d*, a mixed polyimide layer constituting the heat storage layer was applied by screen printing. The mixed polyimide layer was provided on the groove portion formed in the upper surface of the heat generating layer 51 through the electrically conductive layer 54*a*. A thickness of the mixed polyimide layer was 20 $\mu$m. Then, this layer was hardened by heating it at 350° C. and the integrally united assembly was obtained as shown in FIG. 39E. The mixed polyimide used in this embodiment is a polyimide having spherical alumina fillers mixed therein, (step B-5) Connection of Wires to Driving IC and External As explained above, after forming the protection layers 54*a*, 54*b*, 54*c*, and 54*d*, the wires 56 were connected to the driving IC 55 and the external as shown in FIG. 39F. The driving IC 55 was connected by flip chip-bonding to the electrically conductive layer 52*b* and wiring section 53 through the connecting portions 60*a*, 60*b*, and 60*c*. The driving IC 55 had a size of 1.0 mm×5.0 mm×0.5 mm. The wires 56 made of Cu to the external circuit were connected to the wiring section 53 through the connecting portions 60*c* formed by soldering (step D) Fixing of Respective Components As above mentioned, after connecting the wires 56 to the driving IC 55 as well as to the external circuit, the thus formed components were adhered to the flat plate 65 made of aluminum with the epoxy resin 66 and an assembly was heated to harden the epoxy resin to form an integrally united structure. In this embodiment, the hardening was effected at 150° C. The flat plate 65 made of aluminum has an opening at a position corresponding to the driving IC 55, and had a size of 5 mm×90 mm which is equal to a size of the thermal head and a thickness of 5 mm.

(step E-1) Separation of Substrate by Removing Sacrificial Layer

As above mentioned, after securing the flat plate 65 with the resin 66, the sacrificial layer 71 made of MgO was removed by etching with a $H_3PO_4$ aqua-solution, and the thermal head was made independent from the substrate 70.

By performing the above steps, the thermal head shown in FIG. 8 was obtained.

[Embodiment 14]

FIGS. 40A–40I are cross sectional views showing successive steps of manufacturing the thermal head shown in FIG. 22. The thermal head illustrated in FIG. 22 has the printing surface S which is protruded outwardly and the heat storage layer 58.

(step A-1) Processing of Substrate

Figure 40A:
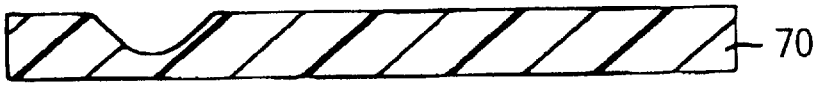
FIGS. 40A–40I are cross sectional views depicting successive steps of the method of manufacturing the thermal head shown in FIG. 22.
Figure 40B:
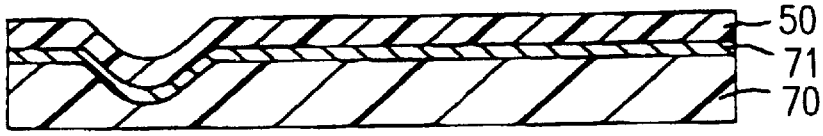
Figure 40C:
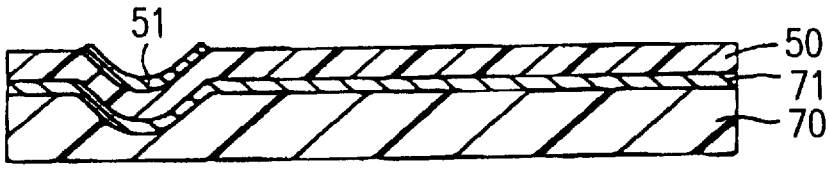
Figure 40D:
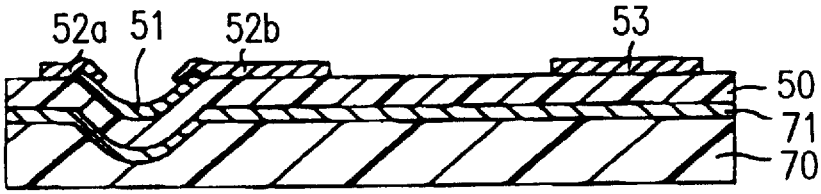
Figure 40E:
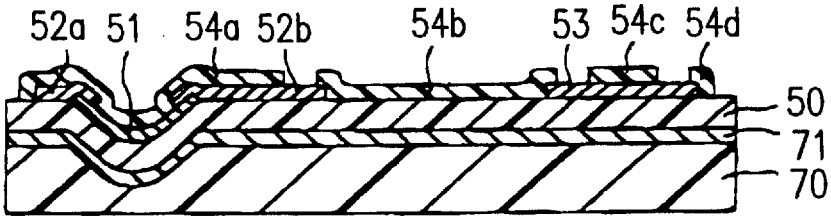
Figure 40F:
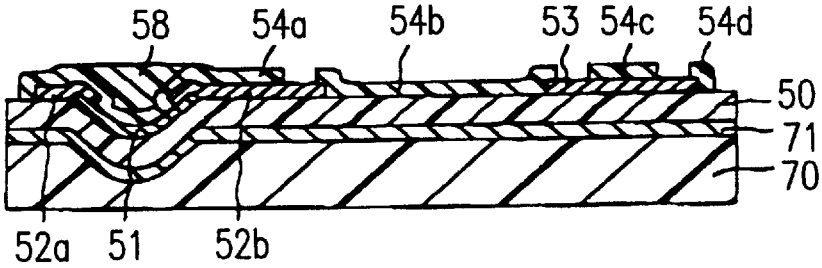

At first, the substrate 70 serving as the manufacturing tool was made of the 7059 glass manufactured by Corning Company. On this substrate 70, a resist pattern was formed by photolithography and a groove having a substantially semicircular lateral cross section was formed by wet-etching as shown in FIG. 40A. Upon photolithography, a negative-resist was used and HF was used as an etchant. After etching the substrate 70, the resist was peeled off.

Succeeding steps shown in FIGS. 40B–40I are similar to those depicted in FIGS. 39A–39H of the embodiment 13, and the thermal head shown in FIG. 22 was obtained.

[Embodiment 15]

FIGS. 41A–41H show successive steps of manufacturing the thermal head illustrated in FIG. 23. The thermal head shown in FIG. 23 has the flat printing surface S and the heat storage layer 58. The heat generating layer 58 is formed on the electrically conductive layers 52*a* and 52*b* viewed from the wear-resistant layer 50.

Figure 39G:
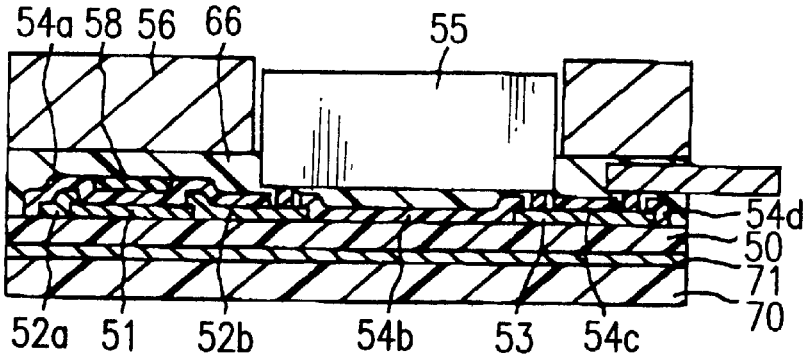
Figure 39H:
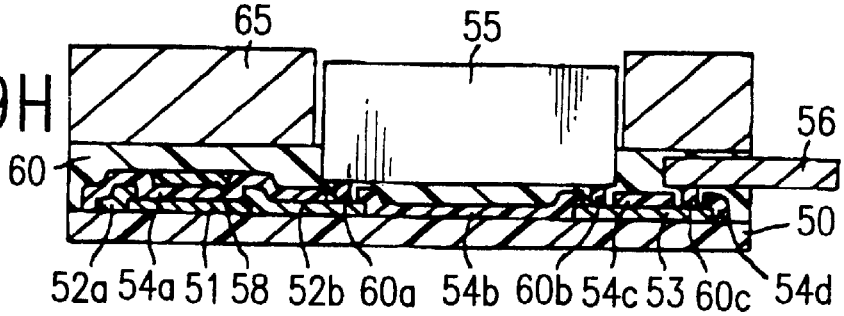
Figure 41A:
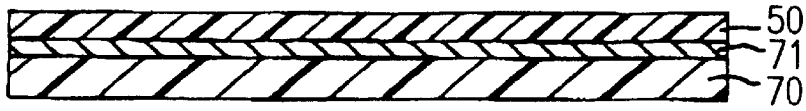
FIGS. 41A–41H are cross sectional views showing successive steps of the method of manufacturing the thermal head illustrated in FIG. 23.
Figure 41B:
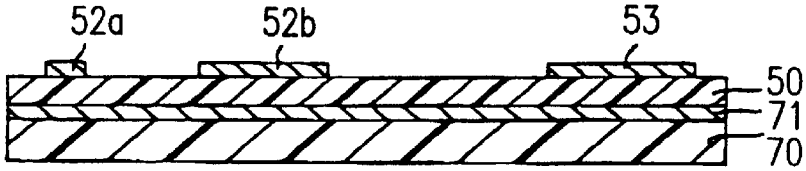
Figure 41C:
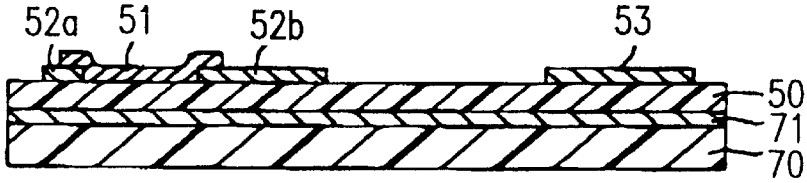
Figure 41D:
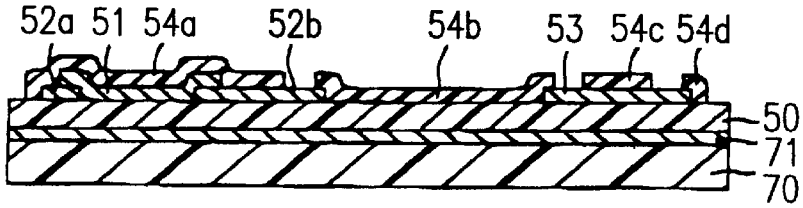
Figure 41E:
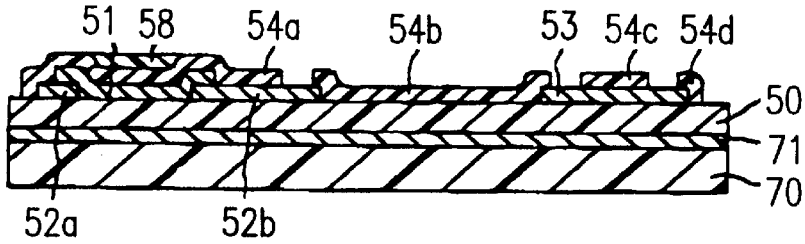
Figure 41F:
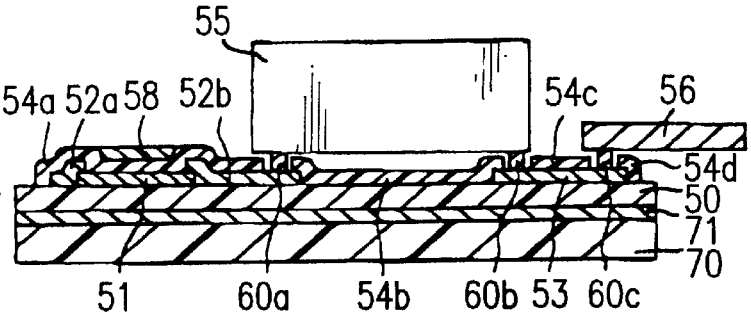
Figure 41G:
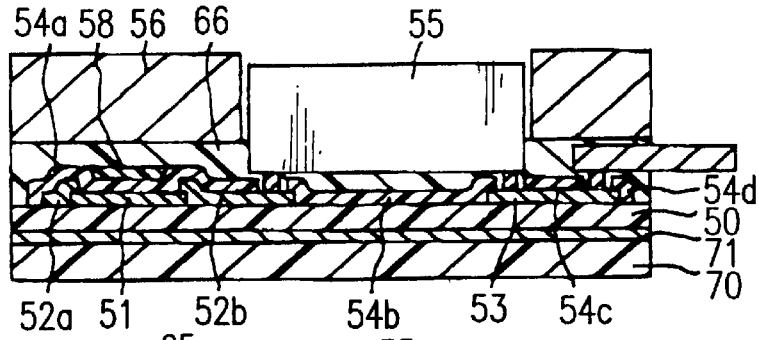
Figure 41H:
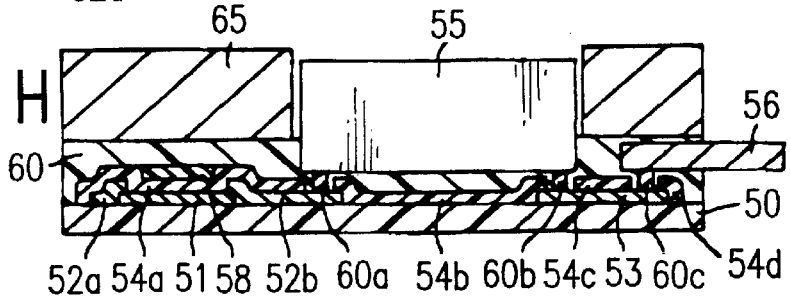

Steps shown in FIGS. 41A–41E are similar to those illustrated in FIGS. 33A–33E in the embodiment 7 and steps of FIGS. 41F–41H are similar to those depicted in FIGS. 39F–39H in the embodiment 13.

[Embodiment 16]

FIGS. 42A–42H show successive steps of manufacturing the thermal head shown in FIG. 24. The thermal head of FIG. 24 has the outwardly protruded printing surface S and the heat storage layer 58. The heat generating layer 58 is formed on the electrically conductive layers 52*a* and 52*b* viewed from the wear-resistant layer 50.

Figure 40G:
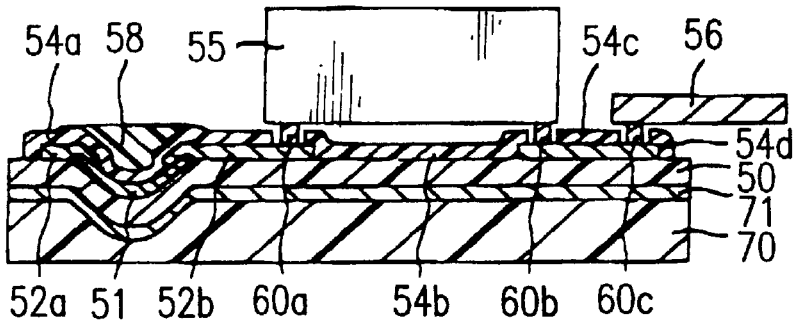
Figure 40H:
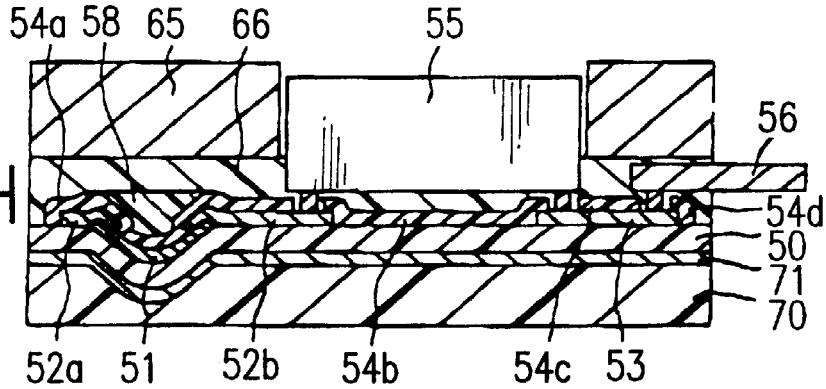
Figure 40I:
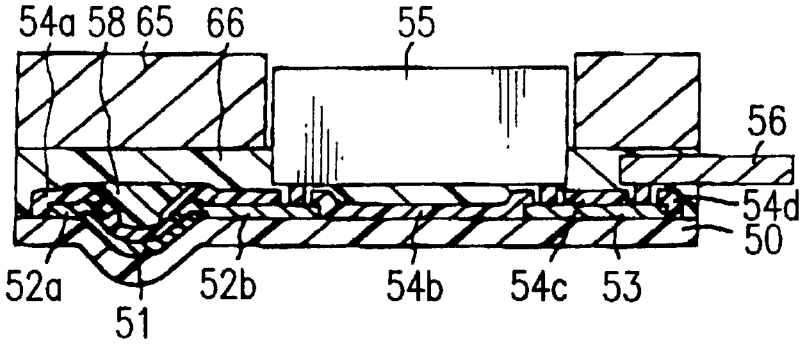
Figure 42A:
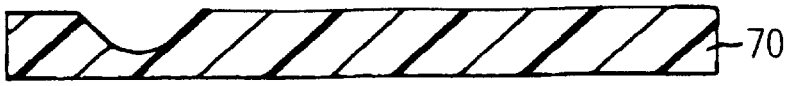
FIGS. 42A–42I are cross sectional views illustrating successive steps of the method of manufacturing the thermal head shown in FIG. 24.
Figure 42B:
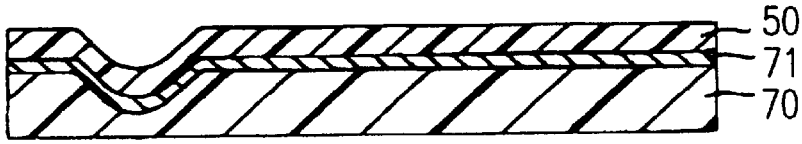
Figure 42C:
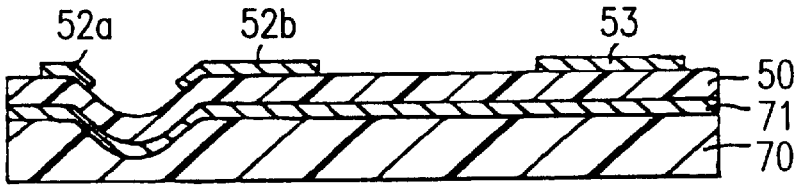
Figure 42D:
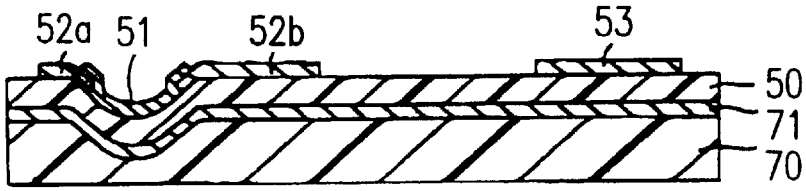
Figure 42E:
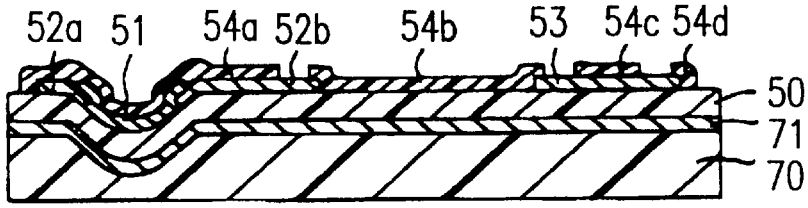
Figure 42F:
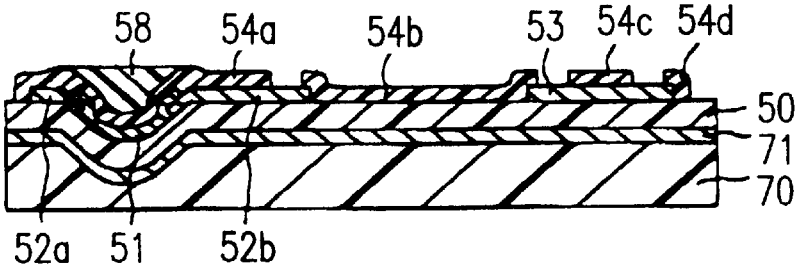
Figure 42G:
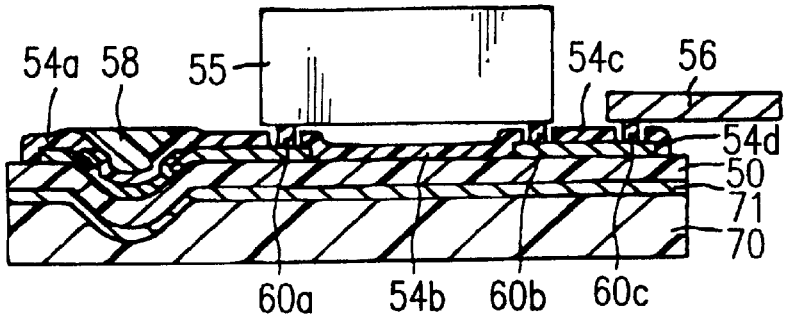
Figure 42H:
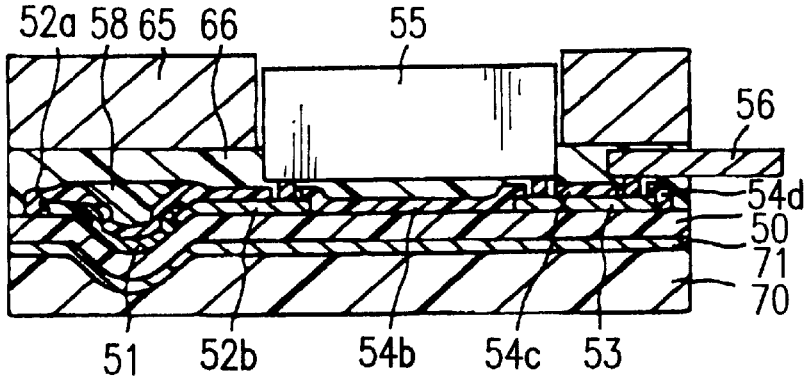
Figure 42I:
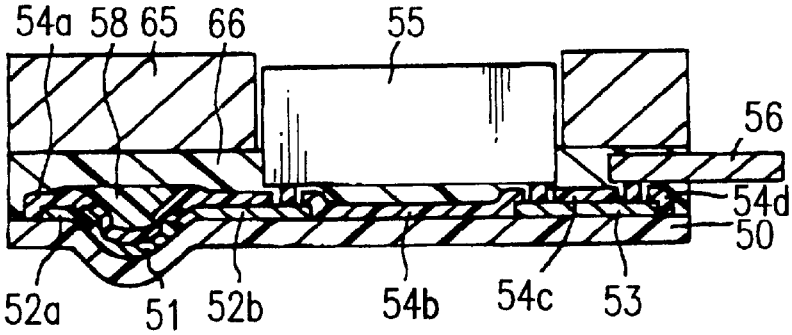

Steps shown in FIGS. 42A–42F are similar to those illustrated in FIGS. 34A–34F in the embodiment 8 and steps shown in FIGS. 42G–42I are similar to those depicted in FIGS. 40G–40I in the embodiment 13.

Next, the relationship between the thermal conductivity of the flat plate 65 and the dot broken ratio of the thermal head according to the invention will be explained.

Figure 43:
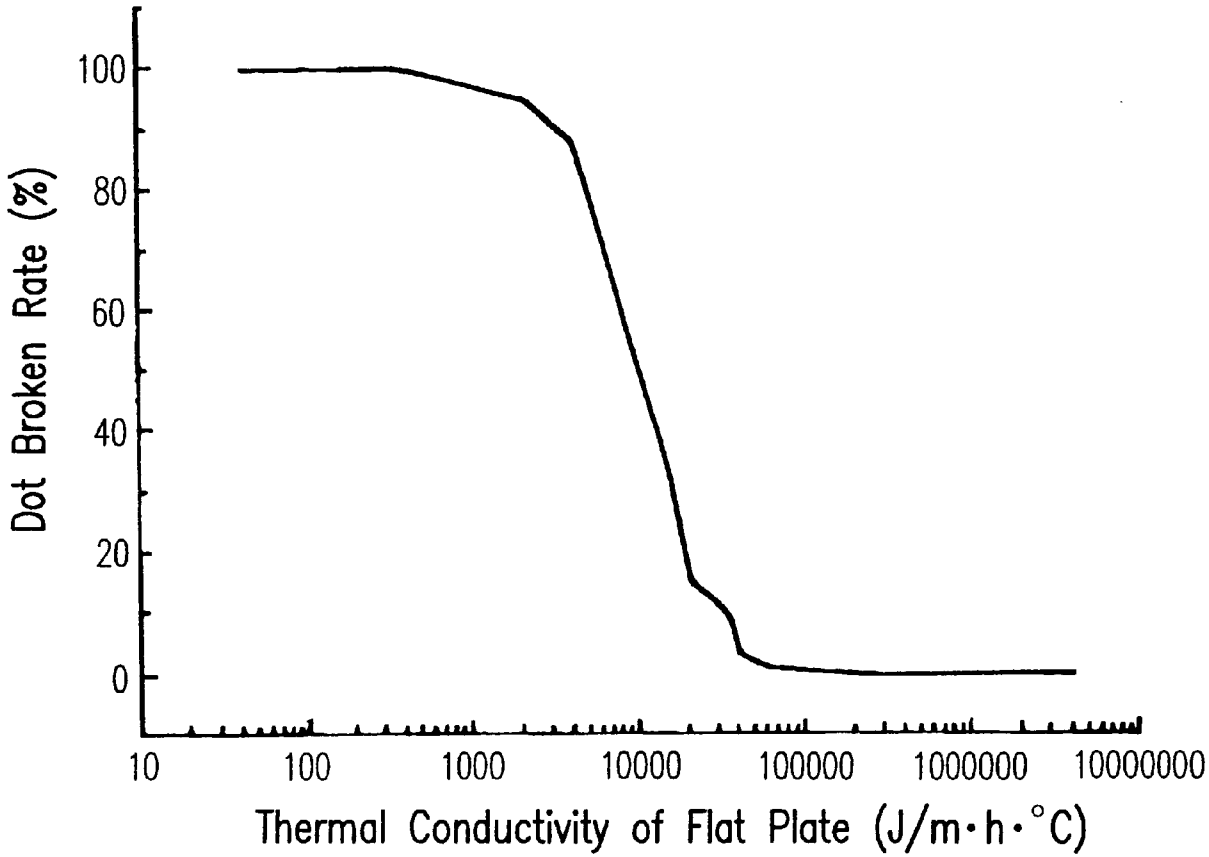
FIG. 43 is a graph showing a relationship between a thermal conductivity of a flat plate and a dot broken rate in the thermal head according to the invention.

In FIG. 43, the thermal conductivity of the flat plate 65 is denoted on the horizontal axis in logarithm scale and the dot broken ratio is denoted on the vertical axis. The dot broken ratio means a ratio of the number of broken heat generating elements to the number of the whole heat generating elements in percentage after flowing a current for 5000 hours. The heat generating layer 51 comprises an array of heat generating elements arranged with a pitch of 6 dots/mm and having a length of 85.3 mm.

As can be understood from FIG. 43, the dot broken ratio is decreased rapidly when the thermal conductivity of the flat plate 65 is higher than about $4.18\times10^4$ J/m·h·° C. and the ratio is substantially 0% when the thermal conductivity is about $4.18\times10^4$ J/m·h·° C. and more particularly the ratio is perfectly 0% when the thermal conductivity is not less than $6.27\times10^4$ J/m·h·° C. Thus the thermal conductivity of the flat plate 65 has to be higher than $4.18\times10^4$ J/m·h·° C. and more particularly it is preferably not less than $6.27\times10^4$ J/m·h·° C. The relationship between the thermal conductivity of the flat plate 65 and the dot broken ratio may be equally applied to the relationship between a thermal conductivity of the heat dissipating member 59 and a dot broken ratio.

Characteristics of tie several embodiments of the thermal head according to the present invention have been evaluated and its results are shown in the following Table 2. The evaluation has been conducted by using a print test pattern having a print surface area of 50%.

TABLE 2

| | Structure of thermal head | | | | | | |
|---|---|---|---|---|---|---|---|
| | Figure of embodiment | Shape of printing surface | Heat storage layer | Heat dissipating member | Power consumption [W/dot] | Print speed [cm/sec] | Print quality |
| 1 | FIG. 6 | flat | no | no | 0.18 | 2.5 | good |
| 2 | FIG. 8 | flat | yes | yes | 0.08 | 4.5 | good |
| 3 | FIG. 11 | flat | yes | no | 0.08 | 2.0 | good |
| 4 | FIG. 12 | flat | yes | yes | 0.08 | 6.5 | good |
| 5 | FIG. 13 | outwardly protruded | no | no | 0.18 | 2.5 | better |
| 6 | FIG. 14 | outwardly protruded | yes | no | 0.08 | 2.0 | better |
| 7 | FIG. 15 | outwardly protruded | yes | yes | 0.08 | 4.5 | better |
| 8 | FIG. 22 | outwardly protruded | yes | yes | 0.08 | 6.5 | better |

As shown in the Table 2, all the embodiments of the thermal head according to the invention have practically usable printing performance. The thermal head having any principal structures according to the present invention has superior characteristics to any conventional thermal heads.

Next advantageous effects of the thermal head according to the invention will be described.

(Configuration of Printing Section)

From the Table 2, it is clear that the printing quality can be improved by using the outwardly protruded printing surface S than the flat printing surface. It is considered that the outwardly protruded printing surface can be brought into intimate contact with a thermal paper and thus is better in the printing surface S like projecting, and thus a resolution of print is improved. In this manner, the printing section is preferably protruded outwardly.

(Heat Storage Layer)

As can be understood from the Table 2, the embodiment having the heat storage layer 58 has a smaller electric power consumption than the embodiment without the heat storage layer. This is due to a fact that the heat storage layer 58 can prevent the diffusion of heat, and therefor an efficiency of electric power is improved. Furthermore, by providing the beat storage layer 58, a degradation in a quality of print due to a thermal deformation of the resin can be prevented. Therefore, it is preferable to provide the heat storage layer 58.

(Heat Dissipating Body)

From the Table 2, it is clear that a printing speed of the embodiment having the heat dissipating body 58, heat dissipating member 59 or flat plate 65 is faster than the embodiment without the heat dissipating body 58. This is due to a fact that by providing the heat dissipating body, heat dissipating member and flat plate, the heat dissipating property is improved and a cooling time of the printing section is shortened, and therefore the high speed printing can be attained. Moreover by providing the heat dissipating body, heat dissipating member and flat plate, a degradation of the printing performance due to the deformation of the resin can be prevented, and thus a reliability is improved. In this manner, according to the invention, it is preferable to provide the heat dissipating body, heat dissipating member and flat plate.

The above mentioned properties can be equally attained in the embodiments in which a stacking order of the electrically conductive layer and the heat generating layer is reversed.

As can be understood from the above results, the embodiments shown in FIGS. 15 and 21 are particularly preferable, because in these embodiments, the printing surface is protruded outwardly and the heat storage layer 58 and heat dissipating body 68 are provided. Moreover, the embodiments shown in FIGS. 22 and 24 are particularly preferable, because in these embodiments the printing surface is protruded outwardly and the heat storage layer 58 and flat plate 65 are provided. It is matter of course that according to the present invention, the most suitable embodiment may be selected from many embodiments in accordance with a required performance and manufacturing process.

Moreover, in the embodiments having the heat dissipating member 59 as shown in FIGS. 7 and 38, it is possible to obtain a similar performance to that of the embodiment having the flat plate 65. In the embodiments having the flat plate 65 or heat dissipating member 59, in addition to the above advantages, the thermal head can be easily manufactured by an automatic assembling machine, and therefore a manufacturing cost can be decreased.

As has been explained above with reference to FIGS. 9 and 10, according to the present invention, the number of the thermal heads obtained from a single composite substrate B can be increased. This will be further investigated in the following.

In this investigation, a rectangular composite substrate B having a width a of 100 mm and a length d of 300 mm as shown in FIG. 9. The following Table 3 indicates the number of thermal heads obtained from such a composite substrate B.

TABLE 3

| | Lateral length of head (mm) | The total number of heads obtained from single composite substrate |
|---|---|---|
| Thermal head according to invention | 5 | 40 |
| Known thermal head | 10 | 20 |

In the thermal head according to the invention, the driving IC 55 and the wiring section 53 to external circuit are provided on a side of the thermal head opposite to the printing surface S. Therefore, upon printing, the driving IC and its electric connection are not brought into contact with a thermal paper and the like, and the driving IC can be closer to the printing section P. Thus, a size of the thermal head can be about ¼ of the conventional thermal head, and therefore the number of the thermal heads obtained from a single composite substrate B can be increased twice as compared with the conventional thermal head. Effect of the Invention Now advantageous effects of the thermal head and the method of manufacturing the same according to the invention will be summarized as follows.

By adopting the structure of arranging the driving IC and wiring portions to the external circuit on a side of the thermal head remote from the printing surface, the following advantageous effects can be attained.

(effect 1) The driving IC and its electric connection are not brought into contact with a thermal paper, and thus a risk of cutting-off and short-circuit of the electric system can be diminished.

(effect 2) Since the driving IC can be arranged near the printing section P, a size of the thermal head can be miniaturized, and therefore the number of the thermal heads obtained from a single composite can be increased and the following effects can be further obtained.

(effect 3) The thermal head can be manufactured in an efficient manner at a low cost, Moreover, by fixing the thermal head as a whole by means of the resin 57, heat dissipating member 59 and flat plate 65 into a single unit body, the following advantageous effect can be obtained.

(effect 4) A mechanical strength of the thermal head can be improved, and a heat dissipating property can be also improved. Particularly, in case of using the heat dissipating member 59 which can be formed in any desired shape, the heat dissipating layer can be formed in accordance with a configuration of the printing section P, driving IC and wiring section and manufacturing steps.

In the method of manufacturing the thermal head according to the invention, the following advantageous effect can be obtained in relation to the formation of the printing section.

(effect 5) The thermal head having the smooth printing surface S which is brought into good contact with a thermal paper can be obtained without special steps and operation.

Moreover, the method of manufacturing the thermal head according to the invention can expect the following additional advantageous effect.

(effect 6) By using the step of peeling-off the substrate to make the thermal head independent from the substrate, since the substrate can be used repeatedly, a manufacturing cost can be decreased.

(effect 7) After removing mechanically a part of the substrate, a part or a whole of the remaining portion of the substrate is removed by wet-etching, and the substrate can be efficiently removed. In case of using the substrate made of a glass, since the glass has a coefficient of thermal expansion closer to those of the layers constituting the printing section of the thermal head as compared with stainless steel, the printing section can be prevented from being influenced by thermal expansion and shrinkage, and therefore the characteristics of the thermal head are not influenced. Moreover, as compared with peeling-off, a degradation during the separation of the thermal head from the substrate is small and the thermal head can be easily manufactured. Therefore, the number of the thermal heads manufactured from a single composite substrate can be easily improved and the thermal head can be manufactured on a large scale.

(effect 8) By using the substrate made of Si, glass or alumina, the printing section is not influenced by the thermal expansion and shrinkage during the manufacture and characteristics of the thermal head are not influenced, because the above materials have a coefficient of thermal expansion which is closer to those of materials constituting the printing section.

(effect 9) Since after forming the supporting layer on the heat generating layer and electrically conductive layer, the substrate is removed, the arrangement of the printing section P is not influenced by the driving IC, and thus the thermal head having a higher freedom of arrangement can be obtained.

What is claimed is:

1. A thermal head comprising:

a printing section including a wear-resistant layer having a first surface constituting a printing face to be brought into contact with a thermal record medium and a second surface opposite to the first surface, a heat generating layer formed on a side of the second surface of the wear-resistant layer and generating heat to be transmitted to the thermal record medium through the wear-resistant layer, and an electrically conductive layer formed on a side of the second surface of the wear-resistant layer and connected electrically to the heat generating layer;

a driving circuit section connected to the electrically conductive layer of the printing section to control a heat generating electric power to be supplied to said printing section; and a wiring section for connecting the driving circuit section to an external circuit;

wherein said driving circuit and wiring sections are arranged on a side of the second surface of the wear-resistant layer of the printing section;

said first and second surfaces of said wear-resistant layer are curved in such a manner that said first and second surfaces are outwardly protruding in the printing section.

2. A thermal head as claimed in the claim 1, wherein said wear-resistant layer in the printing section has an extended part which extends beyond the printing section, said electrically conductive layer has an extended part which extends on a side of the second surface of the wear-resistant layer, said wiring section is provided on a side of the second surface of the extended part of the wear-resistant layer, and said driving circuit part is composed of integrated chips, terminals of which are connected electrically to the extended part of the electrically conductive layer and to the wiring section.

3. A thermal head as claimed in claim 2, wherein said printing surface of the printing section is formed as a an outwardly protruding curved surface.

4. A thermal head as claimed in claim 3, wherein said thermal head comprises a supporting member provided on a side of the second surface of the wear-resistant layer of the printing section for supporting the printing section, driving circuit section, and wiring section.

5. A thermal head as claimed in claim 4, wherein said supporting member comprises a resin member for bonding and fixing the printing section, driving circuit section and wiring section integrally.

6. A thermal head as claimed in claim 5, wherein said resin member is made of epoxy resin, acrylic resin, or silicone resin.

7. A thermal head as claimed in claimed 4, wherein said supporting member comprises a heat dissipating member and an adhesive layer for fixing at least said printing section to said heat dissipating member.

8. A thermal head as claimed in claim 4, wherein said supporting member comprises a flat plate and an adhesive layer for fixing at least said printing section to the flat plate.

9. A thermal head as claimed in claim 7, wherein said adhesive layer is made of a resin.

10. A thermal head as claimed in any of claims 7–9, wherein said supporting member has a fixing member for fixing at least said wiring section to said heat dissipating member.

11. A thermal head as claimed in claim 10, wherein said supporting member has a fixing member for fixing a common electrode provided in the vicinity of said printing section to said heat dissipating member.

12. A thermal head as claimed in claim 11, wherein said fixing member is formed by a both-sided adhesive tape.

13. A thermal head as claimed in claim 9, wherein said printing surface of the printing section is formed as an outwardly protruding curved surface.

14. A thermal head as claimed in claim 9, wherein said resin is epoxy resin, acrylic resin, or silicone resin.

15. A thermal head as claimed in claim 7, wherein said adhesive layer is made of a thermosetting adhesive.

16. A thermal head as claimed in claim 7, wherein said adhesive layer is made of a heat resistant inorganic adhesive.

17. A thermal head as claimed in claim 7, wherein said adhesive layer is made of a viscoelastic rubber.

18. A thermal head as claimed in claim 7, wherein said adhesive layer contains powders for increasing a thermal conductivity.

19. A thermal head as claimed in claim 7, wherein said printing section is constructed by stacking the wear-resistant layer, heat generating layer and electrically conductive layer in this order viewed from the printing surface.

20. A thermal head as claimed in claim 19, wherein said electrically conductive layer is made of aluminum.

21. A thermal head as claimed in claim 7, wherein said printing section is formed by stacking the wear-resistant layer, electrically conductive layer and heat generating layer in this order viewed from the printing surface.

22. A thermal head as claimed in claim 21, wherein said electrically conductive layer is made of tungsten.

23. A thermal head as claimed in claim 7, wherein said printing section has a protection layer which prevents impurities from diffusing into the heat generating layer and is provided on a surface of the heat generating layer remote from the printing surface.

24. A thermal head as claimed in claim 21, wherein said protection layer is formed to cover said electrically conductive layer and wiring section except for connecting portions of the electrically conductive layer to the driving circuit section and a connecting portions of the wiring section to the driving circuit section and an external conductor.

25. A thermal head as claimed in claim 24, wherein said protection layer is formed by a layer made of at least one of SiNx and SiNx, or a layer made of a mixture thereof.

26. A thermal head as claimed in claim 23, wherein said printing section has a heat storage layer thermally coupled with the heat generating layer through the protection layer.

27. A thermal head as claimed in claim 26, wherein said heat storage layer contains at least one of polyimide and glass.

28. A thermal head as claimed in claim 27, wherein said heat storage layer has a thermal conductivity not larger than $4.18\times10^4$ J/m·h·° C. and below.

29. A thermal head as claimed in claim 27, wherein said heat storage layer is made of a polyimide containing powders for controlling a thermal conductivity.

30. A thermal head as claimed in claim 26, wherein said thermal head further comprises a heat dissipating body thermally coupled with the beat storage layer on a side opposite to the printing surface.

31. A thermal head as claimed in claim 30, wherein said heat dissipating body has a thermal conductivity not less than $6.27\times10^4$ J/m·h·° C.

32. A thermal head as claimed in claim 31, wherein said heat dissipating body is made of at least one of Al, Cu, Fe, Ni, Mo and alumina ceramics.

33. A thermal head as claimed in claim 7, wherein said wiring section includes wires to be connected to the external circuit, and said wires are fixed to the heat dissipating member or flat plate by means of said fixing member.

34. A thermal head as claimed in any one of claims 26, wherein said heat dissipating member or flat plate has an outer configuration such that the heat dissipating member is not brought into direct contact with the driving circuit section.

35. A thermal head as claimed in claim 34, wherein said heat dissipating member or flat plate has a thermal conductivity not less than $6.27\times10^4$ J/m·h·° C.

36. A thermal head as claimed in claim 35, wherein said heat dissipating member or flat plate is made of a metal or ceramics.

37. A thermal head as claimed in claim 36, wherein said heat dissipating member or flat plate is made of at least one of Al, Cu, Fe, Ni, Mo, and alumina ceramics.

38. A method of manufacturing a thermal head comprising a printing section which includes a wear-resistant layer having a printing surface to be brought into contact with a thermal record medium, a heat generating layer which generates heat to be transmitted to the thermal record medium through the wear-resistant layer, and an electrically conductive layer connected to the heat generating layer; a driving circuit section connected to the electrically conductive layer in the printing section to control a heat generating electric power to be supplied to the printing section; and a wiring section which connects the driving circuit section to an external circuit, comprising:

a step of forming said wear-resistant layer on a substrate such that the wear-resistant layer has an extended portion which extends beyond the printing section;

a step of forming said heat generating layer and electrically conductive layer on said wear-resistant layer such that at least a part of the electrically conductive layer formed on said extended portion of the wear-resistant layer is exposed;

a step of forming said wiring section on said extended portion of the wear-resistant layer such that at least a part of the wiring section is exposed;

a step of providing said driving circuit section on the exposed parts of said electrically conductive layer and wiring section; and a step of separating said printing section, driving circuit section and wiring section from the substrate as an independent unit body.

39. A method of manufacturing a thermal head as claimed in claim 38, wherein said wear-resistant layer is formed on the surface of the substrate to have an extended portion extending beyond the printing section, said electrically conductive layer is formed to have an extended portion beyond the printing section along said extended portion of the wear-resistant layer, and said driving circuit section is provided by connecting integrated circuit chips to the extended portion of the electrically conductive layer and to wiring section.

40. A method of manufacturing a thermal head as claimed in claim 39, wherein a recessed portion is formed in the surface of the substrate and the wear-resistant layer of the printing section is formed along said recessed portion such that the printing surface to be brought into contact with the thermal record medium is formed to be an outwardly projecting curved surface.

41. A method of manufacturing a thermal head as claimed in claim 39, wherein said surface of the substrate is formed to be flat, and said wear-resistant layer of the printing section is formed along the flat surface such that the printing surface to be brought into contact with the thermal record medium is formed to be flat.

42. A method of manufacturing a thermal head as claimed in claim 40, wherein said method further comprises a step of reinforcing at least a part of the printing section, driving circuit section and wiring section prior to said step of separating the printing section, driving circuit section and wiring section from the substrate as an independent unit body.

43. A method of manufacturing a thermal head as claimed in claim 42, wherein said printing section, driving circuit section and wiring section are reinforced by adhering them into a single unit by means of a resin.

44. A method of manufacturing a thermal head as claimed in claim 43, wherein said printing section, driving circuit section and wiring section are wholly covered with said resin.

45. A method of manufacturing a thermal head as claimed in claim 42, wherein said thermal head is reinforced by adhering at least a part of the printing section, driving circuit section and wiring section to a supporting member.

46. A method of manufacturing a thermal head as claimed in claim 42, wherein said thermal head is reinforced by adhering at least the printing section to a heat dissipating member with an adhesive layer.

47. A method of manufacturing a thermal head as claimed in claim 42, wherein said thermal head is reinforced by adhering at least the printing section to a flat plate with an adhesive layer.

48. A method of manufacturing a thermal head as claimed in claim 45, wherein at least said printing section is adhered to the supporting member, heat dissipating member or flat plate with a resin.

49. A method of manufacturing a thermal head as claimed in claim 48, wherein at least said printing section is adhered to the supporting member, heat dissipating member or flat plate with an adhesive layer, and at least said wiring section is fixed to the supporting member, heat dissipating member or flat plate with a fixing member.

50. A method of manufacturing a thermal head as claimed in claim 49, wherein said adhesive layer is made of a rosin.

51. A method of manufacturing a thermal head as claimed in claim 49, wherein said fixing member is formed by a both-sided adhesive tape.

52. A method of manufacturing a thermal head as claimed in claim 51, wherein after fixing said wiring section and a common electrode provided near the printing section to the supporting member, heat dissipating member or flat plate, a resin is filled within a space between at least the printing section and the supporting member, heat dissipating member or flat plate to fix them.

53. A method of manufacturing a thermal head as claimed in claim 45, wherein at least said printing section is adhered to the supporting member, heat dissipating member or flat plate with thermosetting adhesive, silicone adhesive, heat-resistant inorganic adhesive or viscoelastic rubber.

54. A method of manufacturing a thermal head as claimed in claim 53, wherein said wear-resistant layer, heat generating layer and electrically conductive layer are formed in this order on the substrate to form the printing section.

55. A method of manufacturing a thermal head as claimed in claim 53, wherein the wear-resistant layer, electrically conductive layer and heat generating layer are formed in this order on the substrate to form the printing section.

56. A method of manufacturing a thermal head as claimed in claim 53, wherein a protection layer is formed between the printing section and an underlying part such that substances are prevented from being diffused from the underlying part into the printing section.

57. A method of manufacturing a thermal head as claimed in claim 56, wherein a heat storage layer is formed to be thermally coupled with the heat generating layer of the printing section.

58. A method of manufacturing a thermal head as claimed in claim 57, wherein a heat dissipating body is formed to be thermally coupled with the heat storage layer.

59. A method of manufacturing a thermal head as claimed in claim 58, wherein said thermal head is made independent from the substrate by removing the substrate by a wet-etching.

60. A method of manufacturing a thermal head as claimed in claim 59, wherein after covering a whole surface of the thermal head except for the substrate with an etching-resist layer, the substrate is wet-etched.

61. A method of manufacturing a thermal head as claimed in claim 58, wherein after removing a part of the substrate by mechanical grinding, at least a part of the rest thereof is removed by wet-etching to separate the thermal head from the substrate.

62. A method of manufacturing a thermal head as claimed in claim 58, wherein a sacrificial layer for peeling off the substrate is formed on the substrate before forming the printing surface of the thermal head, and after forming the thermal head, the thermal head is separated from the substrate by removing the sacrificial layer to peel off the substrate.

63. A method of manufacturing a thermal head as claimed in claim 62, wherein said sacrificial layer is made of MgO, CaO, or ZnO.

64. A method of manufacturing a thermal head as claim in claim 60, wherein said substrate is made of glass or alumina.

65. A method of manufacturing a thermal head as claim in claim 64, wherein said substrate is made of a borosilicate glass.

66. A method of manufacturing a thermal head as claimed in claim 65, wherein said supporting member is made of at least one of glass and resin.

67. A method of manufacturing a thermal head comprising a printing section including a wear-resistant layer having a printing surface to be brought into contact with a thermal record medium, a heat generating layer for generating heat to be transmitted to the thermal record medium through the wear-resistant layer, and an electrically conductive layer electrically connected to the heat generating layer, wherein said method comprises:

a step of forming said wear-resistant layer on a surface of a substrate, said surface of the substrate having a recessed portion formed therein and said wear-resistant layer being formed along said recessed portion such that a printing surface to be brought into contact with the thermal record medium is formed an outwardly projecting curved surface;

a step of forming said heat generating layer and electrically conductive layer on said wear-resistant layer such that at least a part of the electrically conductive layer formed on said extended portion of the wear-resistant layer is exposed; and a step of taking off the printing section by removing the substrate.

68. A method of manufacturing a thermal head as claimed in claim 67, wherein said substrate is removed by wet-etching during which the wear-resistant layer is used as an etching stopper.

69. A thermal head as claimed in claim 8, wherein said adhesive layer is made of a resin.

70. A thermal head as claimed in claim 8, wherein said supporting member has a fixing member for fixing at least said wiring section to said flat plate.

71. A thermal head as claimed in claim 8, wherein said adhesive layer is made of thermosetting adhesive.

72. A thermal head as claimed in claim 8, wherein said adhesive layer is made of a heat resistant inorganic adhesive.

73. A thermal head as claimed in claim 8, wherein said adhesive layer is made of a viscoelastic rubber.

74. A thermal head as claimed in claim 8, wherein said adhesive layer contains powders for increasing a thermal conductivity.

75. A thermal head as claimed in claim 8, wherein said printing section is constructed by stacking the wear-resistant layer, heat generating layer and electrically conductive layer in this order viewed from the printing surface.

76. A thermal head as claimed in claim 8, wherein said printing section is formed by stacking the wear-resistant layer, electrically conductive layer and heat generating layer in this order viewed from the printing surface.

77. A thermal head as claimed in claim 8, wherein said printing section has a protection layer which prevents impurities from diffusing into the heat generating layer and is provided on a surface of the heat generating layer remote from the printing surface.

78. A thermal head as claimed in claim 8, wherein said wiring section includes wires to be connected to the external circuit, and said wires are fixed to the heat dissipating member or flat plate by means of said fixing member.

79. A method of manufacturing a thermal head as claimed in claim 41, wherein said method further comprises a step of reinforcing at least a part of the printing section, driving circuit section and wiring section prior to said step of separating the printing section, driving circuit section and wiring section from the substrate as an independent unit body.

80. A method of manufacturing a thermal head as claimed in claim 46, wherein at least said printing section is adhered to the supporting member, heat dissipating member or flat plate with a resin.

81. A method of manufacturing a thermal head as claimed in claim 47, wherein at least said printing section is adhered to the supporting member, heat dissipating member or flat plate with a resin.

82. A method of manufacturing a thermal head as claimed in claim 46, wherein at least said printing section is adhered to the supporting member, heat dissipating member or flat plate with thermosetting adhesive, silicone adhesive, heat-resistant inorganic adhesive or viscoelastic rubber.

83. A method of manufacturing a thermal head as claimed in claim 47, wherein at least said printing section is adhered to the supporting member, heat dissipating member or flat plate with thermosetting adhesive, silicone adhesive, heat-resistant inorganic adhesive or viscoelastic rubber.

84. A method of manufacturing a thermal head as claimed in claim 61, wherein said substrate is made of glass or alumina.

* * * * *